US010286705B2

(12) United States Patent
Hong et al.

(10) Patent No.: US 10,286,705 B2
(45) Date of Patent: May 14, 2019

(54) SHEET CONSTRUCTION AND METHODS OF MAKING AND USING THE SAME

(71) Applicants: Le-Hoa Hong, San Gabriel, CA (US); Laura Rocío Meza Sanchez, Tijuana (MX); Linda Francis, Rancho Cucamonga, CA (US); Angie Chiao, San Gabriel, CA (US)

(72) Inventors: Le-Hoa Hong, San Gabriel, CA (US); Laura Rocío Meza Sanchez, Tijuana (MX); Linda Francis, Rancho Cucamonga, CA (US); Angie Chiao, San Gabriel, CA (US)

(73) Assignee: CCL LABEL, INC., Framingham, MA (US)

( * ) Notice: Subject to any disclaimer, the term of this patent is extended or adjusted under 35 U.S.C. 154(b) by 0 days.

(21) Appl. No.: 13/654,404

(22) Filed: Oct. 17, 2012

(65) Prior Publication Data

US 2014/0106132 A1 Apr. 17, 2014

(51) Int. Cl.
*B41M 5/00* (2006.01)

(52) U.S. Cl.
CPC ..... *B41M 5/00* (2013.01); *Y10T 428/24653* (2015.01)

(58) Field of Classification Search
CPC ..... B41M 5/00; Y10T 428/00; Y10T 428/24628; Y10T 428/24653
USPC ..... 428/42.2, 43, 124, 154, 156, 174, 40.1, 428/42.3, 56, 157, 192
See application file for complete search history.

(56) References Cited

U.S. PATENT DOCUMENTS

| | | | | |
|---|---|---|---|---|
| 4,150,183 | A * | 4/1979 | Reed | 428/42.3 |
| 4,626,219 | A | 12/1986 | Goldreyer | |
| 4,704,317 | A | 11/1987 | Hickenbotham et al. | |
| 5,338,122 | A | 8/1994 | Eudy | |
| 5,415,918 | A | 5/1995 | Lang et al. | |
| 5,571,587 | A | 11/1996 | Bishop et al. | |
| 5,622,758 | A | 4/1997 | Hollis | |
| 5,993,928 | A | 11/1999 | Popat | |
| 6,095,919 | A | 8/2000 | Fabel | |
| 6,482,085 | B1 | 11/2002 | Fabel | |
| 6,827,373 | B2 * | 12/2004 | Zumberge | 283/81 |
| 7,105,220 | B2 | 9/2006 | Freeman et al. | |
| 7,118,135 | B2 | 10/2006 | Tims et al. | |
| 7,625,619 | B2 | 12/2009 | Hodson et al. | |
| 7,717,469 | B2 | 5/2010 | Tims et al. | |
| 7,717,713 | B2 | 5/2010 | Wescott et al. | |
| 7,934,751 | B2 | 5/2011 | Castillo et al. | |
| 2001/0007703 | A1 | 7/2001 | Weirather et al. | |

(Continued)

*Primary Examiner* — Brian Handville
(74) *Attorney, Agent, or Firm* — McDonald Hopkins LLC

(57) ABSTRACT

A sheet construction including a first material, and methods of making and using the same. The first material can include a leading edge, a trailing edge, a first longitudinal edge, and a second longitudinal edge. The first material can define a first print-receptive medium. The sheet construction can also include a leading margin extending from the first longitudinal edge to the second longitudinal edge and bounded at least by the leading edge, the first longitudinal edge, the second longitudinal edge, and the print-receptive medium. The sheet construction can also include a first side margin bounded at least in part by the leading margin, the first longitudinal edge, and the first print-receptive medium. The first side margin can include at least one compressed region.

52 Claims, 59 Drawing Sheets

(56) References Cited

U.S. PATENT DOCUMENTS

| | | | |
|---|---|---|---|
| 2003/0148056 | A1 | 8/2003 | Utz et al. |
| 2005/0057038 | A1 | 3/2005 | Crum |
| 2006/0145470 | A1 | 7/2006 | Holmberg |
| 2007/0264461 | A1 | 11/2007 | Gelli |
| 2010/0215905 | A1 | 8/2010 | Liou |
| 2012/0145340 | A1 | 6/2012 | Middlemas et al. |

* cited by examiner

SHEET CONSTRUCTION AND METHODS OF MAKING AND USING THE SAME

FIELD OF THE INVENTION

The present invention relates generally to sheet constructions that are configured to be fed through a printer and more particularly to a sheet construction and methods of making and using the same.

BACKGROUND

Certain print-receptive media of the type used to create small-size printed products, such as, but not limited to, business cards, ROLODEX-type cards, greeting cards, place cards, invitations, identification badges, and address labels, because of their small sizes, cannot be fed individually into and easily printed onto using conventional ink jet printers, laser printers, photocopiers, and other ordinary printing and typing devices. Therefore, one known method of producing such printed products has been to print desired indicia on different portions of a standard-sized sheet of print-receptive material, such as a letter-size sheet (i.e., 8.5 inches×11 inches), a legal-size sheet (i.e., 8.5 inches×14 inches), or an A4-size sheet (i.e., 8.27 inches×11.69 inches), and then to cut the sheet with a suitable cutting device into individual small-size printed media. However, this method is disadvantageous because the user must have access to such a cutting device, and the separate cutting step is cost and time inefficient.

In order to avoid the above-described cutting step, another known product has the perimeters of the media (e.g., the business cards) formed using a grid of horizontal and vertical microperforation lines extending the full length and width of the sheet. Although these microperforations are typically small and close together, with typically more than fifty microperforations per inch, when the cards are separated from one another by tearing along the microperforation lines, perfectly clean edges for the media typically do not result. Instead, the edges for the media are usually slightly fuzzy, giving the media a less professional appearance than media produced by cutting with a cutting device.

Accordingly, a first alternate approach to the above-described use of microperforations is disclosed in U.S. Pat. No. 5,993,928, inventor Popat, which issued Nov. 30, 1999, and which is incorporated herein by reference in its entirety. According to this first alternate approach, there is provided a card stock sheet having two parallel pairs of substantial-cut lines extending the length of the sheet and engaging the sheet at both ends thereof. The substantial-cut lines extend about 90% through the thickness of the sheet from the front towards the back surface. The sheet is then die cut with short (through-cut) lines extending widthwise between the lines of each pair, or vice versa. The substantial-cut and through-cut lines form on the sheet two columns of business card blanks, with paper waste strips at the side (and end) margins and between the columns. After being passed through a printing device, the printed cards are separated from one another by tearing or pulling along the substantial-cut lines. No further separation is required along the through-cut lines.

A second alternate approach is disclosed in U.S. Patent Application Publication No. US 2001/0007703 A1, inventors Weirather et al., which was published Jul. 12, 2001, and which is incorporated herein by reference in its entirety. According to this second alternate approach, there is provided a dry laminated business card sheet construction. The construction includes a low density polyethylene film layer extrusion coated on a densified bleached kraft paper liner to form a film-coated liner sheet. A facestock sheet is adhered with a layer of hot melt adhesive to the film layer to form a laminate sheet web, which is rolled on a roll. The facestock sheet, the film layer and the adhesive layer together define a laminate feedstock. The roll is transported to and loaded on a press with the liner side up. One or both edges of the web are crushed with a calendaring die to form thin lead-in edge(s). The web is die cut on the bottom face, up through the laminate facestock, but not through the paper liner, to form the perimeters of a grid of blank business cards or other printable media, with a waste paper frame of the laminate encircling the grid. The web is then die cut from the top through the paper liner and to, but not through, the laminate facestock, to form liner strips covering the back face of the laminate facestock. According to one embodiment, alternate ones of the strips are then pulled off of the laminate facestock web. A final production step is to sheet the web to form the desired sheet width (or length) of the laminated sheet construction. The individual laminated business card sheets can be stacked into the infeed tray of an ink jet printer, for example, and the sheets individually and automatically fed, lead-in edge first, into the printer and a printing operation performed on each of the printable media, to form a sheet of printed media. The remaining strips on the back of the laminate facestock cover the lateral cut lines in the laminate facestock and, thereby, holds the facestock together as it is fed into and passed through the printer. The user then individually peels the printed media off of the strips and out from the waste paper frame. Thereby, printed business cards (or other printed media), each with its entire perimeter defined by clean die cuts, are formed.

A third alternate approach is disclosed in U.S. Patent Application Publication No. US 2003/0148056 A1, inventors Utz et al., which was published on Aug. 7, 2003, and which is incorporated herein by reference in its entirety. According to this third alternate approach, there is provided a card sheet including a top material having punched lines, the front side of the top material being printable. A carrier material of at least one polymer layer is directly applied, as by extruding, to the back side of the top material. The polymer has a stress-at-break in the range of 10 to 30 MPa and an elongation at break in the range of 10 to 120%. From the card sheet, individual cards can be broken out to form high quality calling (business) cards, photograph cards, postcards or the like.

A fourth alternate approach is disclosed in U.S. Pat. No. 7,625,619, inventors Hodson et al., which issued on Dec. 1, 2009, and which is incorporated herein by reference in its entirety. According to this fourth alternate approach, there is provided a label sheet construction including a liner sheet and a facestock sheet releasably adhered to the liner sheet. A plurality of labels and fold lines are die cut in the facestock sheet but not in the liner sheet. The fold lines extend between the labels. After the sheet construction has been passed through a printer or copier and the desired indicia printed on the labels, the construction (an upper portion thereof) is bent back along one of the fold lines. This separates an upper portion of the label from the underlying liner sheet. The user then easily grasps the upper portion and peels the label off of the liner sheet without tearing the label.

Regardless of which approach is taken to enable the standard-size sheet to be separated, following printing, into smaller-size printed products, in order to have the printed products be durable and professional looking, they must be made from relatively thick and heavy sheets, i.e., sheets typically having a thickness of at least 4 mils (i.e., 0.004 inch). However, printing devices often have difficulty picking up and advancing such thick and heavy sheets through their oftentimes tortuous printing paths. As a result, the use of such sheets often leads to registration problems, i.e., printed matter not appearing on a sheet in its intended location. As can be appreciated, such registration problems can have a significant negative impact on the appearance of the printed product. One of the most common types of registration problems is known as "start of print off-registration" (also known as "off-registration start"), which is typified by print being shifted up or down from its expected starting position relative to the top of the sheet.

One approach to dealing with registration problems resulting from the pick up and feeding of thick sheets of material into printing devices is disclosed in U.S. Pat. No. 4,704,317, inventors Hickenbotham et al., which issued Nov. 3, 1987, and which is incorporated herein by reference in its entirety. The approach of the aforementioned patent involves reducing the stiffness of the corners of a sheet by forming a diagonal path of relatively low stiffness across each of at least two adjacent corners, preferably all four corners. Such a path is said to preferably be made by forming slits, scores or a line of perforations extending at 45° to the edges of the sheet. However, a number of problems with the aforementioned method have prevented it from becoming generally commercially acceptable.

Another approach to dealing with registration problems resulting from the pick up and feeding of thick sheets of material into printing devices is disclosed in U.S. Pat. No. 5,571,587, inventors Bishop et al., which issued Nov. 5, 1996, and which is incorporated herein by reference in its entirety. The approach of the aforementioned patent involves securing a relatively thin portion of material on at least one of the longitudinal edges of a sheet to facilitate feeding the sheet into a printer or copier. After printing, the thin portion of material is removed from the sheet, and the printed products are separated from one another.

Unfortunately, despite the fact that approaches like those described above have been taken in an effort to address registration issues, such as "start of print off-registration," a satisfactory approach to dealing with such registration issues has not yet been devised.

It should, therefore, be appreciated that there is a need for a sheet construction that includes one or more print-receptive media and that reduces the occurrence of certain print registration issues, particularly "start of print off-registration," even when the sheet construction is fairly thick. The present invention satisfies this need.

SUMMARY

The present invention includes a sheet construction that includes a first material. The first material can include a leading edge, a trailing edge, a first longitudinal edge, and a second longitudinal edge. The first material can define a first print-receptive medium. The sheet construction can also include a leading margin extending from the first longitudinal edge to the second longitudinal edge and bounded at least by the leading edge, the first longitudinal edge, the second longitudinal edge, and the print-receptive medium. The sheet construction can also include a first side margin bounded at least in part by the leading margin, the first longitudinal edge, and the first print-receptive medium. The first side margin can include at least one compressed region.

In other, more detailed features of the invention, the first side margin can include a plurality of compressed regions.

In other, more detailed features of the invention, the plurality of compressed regions of the first side margin can include greater than twenty-five compressed regions.

In other, more detailed features of the invention, the plurality of compressed regions of the first side margin can include no more than one hundred twenty compressed regions.

In other, more detailed features of the invention, the plurality of compressed regions of the first side margin can include seventy-nine compressed regions.

In other, more detailed features of the invention, the plurality of compressed regions of the first side margin can include thirty-three compressed regions.

In other, more detailed features of the invention, at least one of the at least one compressed region of the first side margin can be straight.

In other, more detailed features of the invention, the at least one compressed region of the first side margin can be generally parallel to the leading edge.

In other, more detailed features of the invention, the at least one compressed region of the first side margin can be spaced from each of the first longitudinal edge and the first print-receptive medium by a distance from about 0 inch to about 0.079 inch.

In other, more detailed features of the invention, the at least one compressed region of the first side margin can be spaced from each of the first longitudinal edge and the first print-receptive medium by a distance ranging from about 0.020 inch to about 0.079 inch.

In other, more detailed features of the invention, the at least one compressed region of the first side margin can have a length that is parallel to the first longitudinal edge and the length can be from about 0.030 inch to about 0.039 inch.

In other, more detailed features of the invention, at least one of the at least one compressed region of the first side margin can have a depth of about 20 microns to about 110 microns.

In other, more detailed features of the invention, at least one of the at least one compressed region of the first side margin can have a thickness that is about 65% to about 95% of the total caliper of the sheet construction.

In other, more detailed features of the invention, the sheet construction can have a total thickness of about 4 mils to about 14 mils.

In other, more detailed features of the invention, the sheet construction can have a total thickness of about 4 mils to about 7 mils.

In other, more detailed features of the invention, the sheet construction can have a total thickness of about 8 mils to 14 mils.

In other, more detailed features of the invention, the sheet construction can be card stock.

In other, more detailed features of the invention, the first print-receptive medium can be label stock.

In other, more detailed features of the invention, the first material can further define a second side margin bounded at least in part by the leading margin and the second longitudinal edge, and the second side margin can include at least one compressed region.

In other, more detailed features of the invention, the second side margin can include a plurality of compressed regions.

In other, more detailed features of the invention, the plurality of compressed regions of the second side margin can include greater than twenty-five compressed regions.

In other, more detailed features of the invention, the plurality of compressed regions of the second side margin can include no more than one hundred twenty compressed regions.

In other, more detailed features of the invention, at least one of the at least one compressed region of the second side margin can be straight.

In other, more detailed features of the invention, the at least one compressed region of the second side margin can be generally parallel to the leading edge.

In other, more detailed features of the invention, the at least one compressed region of the second side margin can be spaced from the second longitudinal edge by a distance from about 0 inch to about 0.079 inch.

In other, more detailed features of the invention, the at least one compressed region of the second side margin can be spaced from the second longitudinal edge by a distance from about 0.020 inch to about 0.079 inch.

In other, more detailed features of the invention, the at least one compressed region of the second side margin can have a length that is parallel to the second longitudinal edge, and the length can be from about 0.030 inch to about 0.039 inch.

In other, more detailed features of the invention, at least one of the at least one compressed region of the second side margin is compressed to a depth of about 20 microns to about 110 microns.

In other, more detailed features of the invention, at least one of the at least one compressed region of the second side margin can have a thickness that is about 65% to about 95% of the total caliper of the sheet construction.

In other, more detailed features of the invention, the leading margin can include at least one compressed region.

In other, more detailed features of the invention, the leading margin can include a plurality of compressed regions.

In other, more detailed features of the invention, the plurality of compressed regions of the leading margin can include no more than four compressed regions.

In other, more detailed features of the invention, at least one of the at least one compressed region of the leading margin can be straight.

In other, more detailed features of the invention, the at least one compressed region of the leading margin can be generally parallel to the leading edge.

In other, more detailed features of the invention, at least one of the at least one compressed region of the leading margin can be arcuate.

In other, more detailed features of the invention, at least one of the at least one compressed region of the leading margin and the at least one compressed region of the first side margin can be arcuate.

In other, more detailed features of the invention, the at least one compressed region of the leading margin can have a length that is parallel to the first longitudinal edge, and the length can be from about 0.030 inch to about 0.039 inch.

In other, more detailed features of the invention, the first material can have a width, and the at least one compressed region of the leading margin can have a width that is about 0.040 inch to about 0.158 inch less than the width of the first material.

In other, more detailed features of the invention, at least one of the at least one compressed region of the leading margin is compressed to a depth of about 85 microns to about 110 microns.

In other, more detailed features of the invention, at least one of the at least one compressed region of the leading margin can have a thickness that is about 65% to about 95% of the total caliper of the sheet construction.

The present invention also includes a sheet construction including a first material. The first material can include a leading edge, a trailing edge, a first longitudinal edge, and a second longitudinal edge. The first material can define at least one print-receptive medium. The sheet construction also includes a leading margin extending from the first longitudinal edge to the second longitudinal edge and bounded at least by the leading edge, the first longitudinal edge, the second longitudinal edge, and the at least one print-receptive medium. The sheet construction also includes a trailing margin extending from the first longitudinal edge to the second longitudinal edge and bounded at least by the trailing edge, the first longitudinal edge, the second longitudinal edge, and the at least one print-receptive medium. The sheet construction also includes a first side margin bounded by the leading margin, the trailing margin, the first longitudinal edge, and the at least one print-receptive medium. The sheet construction also includes a second side margin bounded by the leading margin, the trailing margin, the second longitudinal edge, and the at least one print-receptive medium. The first side margin can include at least one compressed region.

In other, more detailed features of the invention, the second side margin can include at least one compressed region.

In other, more detailed features of the invention, the leading margin can include at least one compressed region.

In other, more detailed features of the invention, the trailing margin can include at least one compressed region.

In other, more detailed features of the invention, at least one of the second side margin, the leading margin, and the trailing margin can include at least one compressed region.

In other, more detailed features of the invention, each of the second side margin, the leading margin, and the trailing margin can include at least one compressed region.

In other, more detailed features of the invention, the sheet construction can include a sheet of printable business cards.

In other, more detailed features of the invention, the sheet construction can include a sheet of adhesive labels.

The present invention also includes a method of making a sheet construction. The method can include providing a first material, the first material including a leading edge, a trailing edge, a first longitudinal edge, and a second longitudinal edge. The method can also include defining in the first material at least one print-receptive area, a leading margin extending from the first longitudinal edge to the second longitudinal edge and bounded at least by the first longitudinal edge, the second longitudinal edge, and the at least one print-receptive area, and a first side margin bounded at least in part by the leading margin, the first longitudinal edge, and the at least one print-receptive area. The method can further include forming at least one compressed region in the first side margin.

In other, more detailed features of the invention, the forming step can include rolling a scoring roller having at least one protrusion against the first material.

In other, more detailed features of the invention, the at least one compressed region can have a length that is parallel to the first longitudinal edge, and the length can be in the range of about 0.030 inch to about 0.039 inch.

In other, more detailed features of the invention, the at least one compressed region can have a depth of about 20 microns to about 110 microns.

In other, more detailed features of the invention, the at least one compressed region can have a thickness that is about 65% to about 95% of the total caliper of the sheet construction.

In other, more detailed features of the invention, the method can further include the step of forming at least one compressed region in the leading margin.

For purposes of the present application, the term "plurality" is defined to mean two or more.

The embodiments of the present invention described below are not intended to be exhaustive or to limit the invention to the precise forms disclosed in the following detailed description. Rather, the embodiments are chosen and described so that others who are skilled in the art can appreciate and understand the principles and practices of the present invention. Other features and advantages of the present invention will become apparent to those skilled in the art from the following description of the preferred embodiments taken in conjunction with the accompanying drawings, which illustrate, by way of example, the principles of the invention, the invention not being limited to any particular preferred embodiment(s) disclosed. Many changes and modifications within the scope of the present invention can be made without departing from the spirit thereof, and the invention includes all such modifications.

BRIEF DESCRIPTION OF THE DRAWINGS

The accompanying drawings, which are hereby incorporated into and constitute a part of this specification, illustrate various embodiments of the invention and, together with the description, serve to explain the principles of the invention. It should be noted that the drawings are not necessarily drawn to scale. In the drawings wherein like reference numerals represent like parts.

DETAILED DESCRIPTION

Figure 1A:
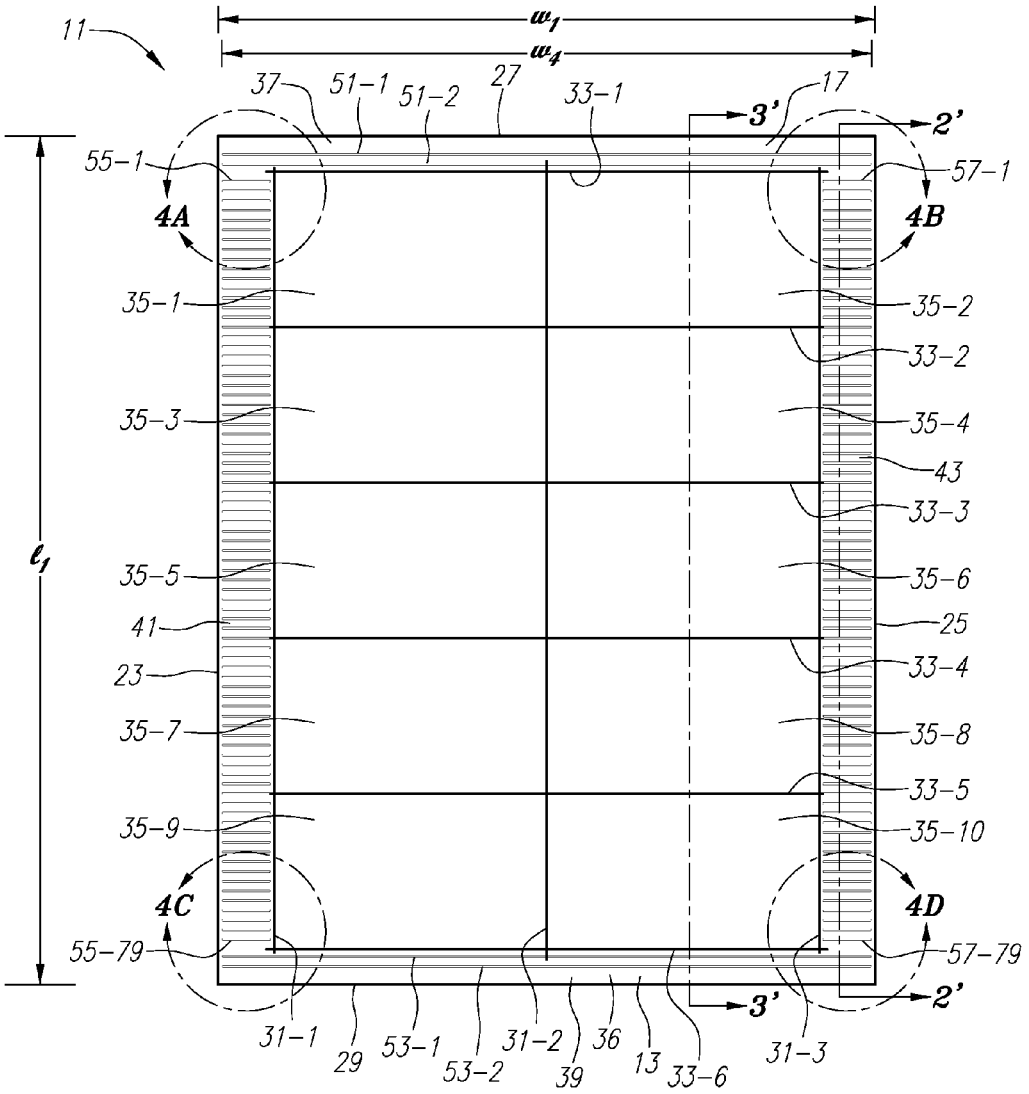
FIGS. 1(*a*), 1(*b*), 1(*c*), 1(*d*), 1(*e*), 1(*f*), and 1(*g*) are front plan, rear plan, top elevation, bottom elevation, left-side elevation, right-side elevation, and perspective views, respectively, of a first embodiment of a sheet construction according to the present invention.
Figure 1B:
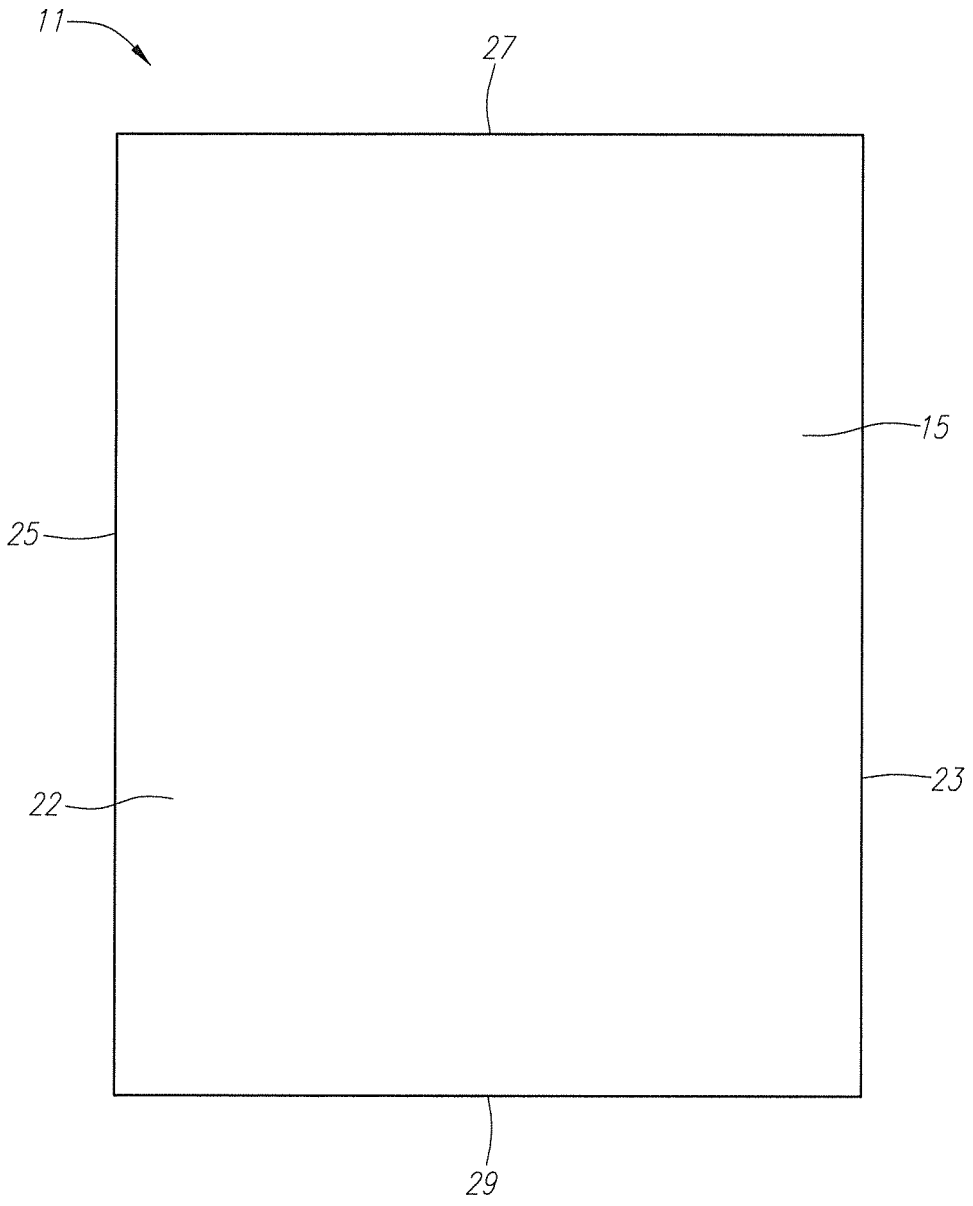
Figure 1C:
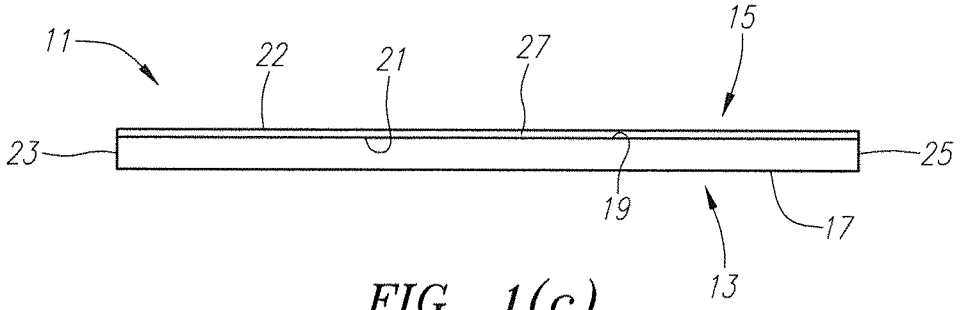
Figure 1D:
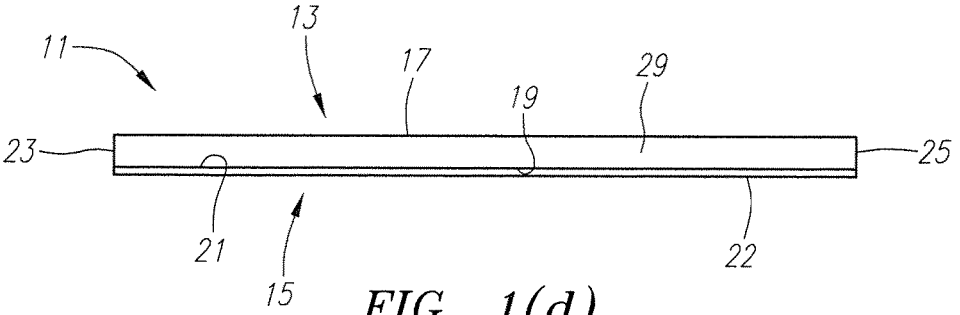
Figure 1E:
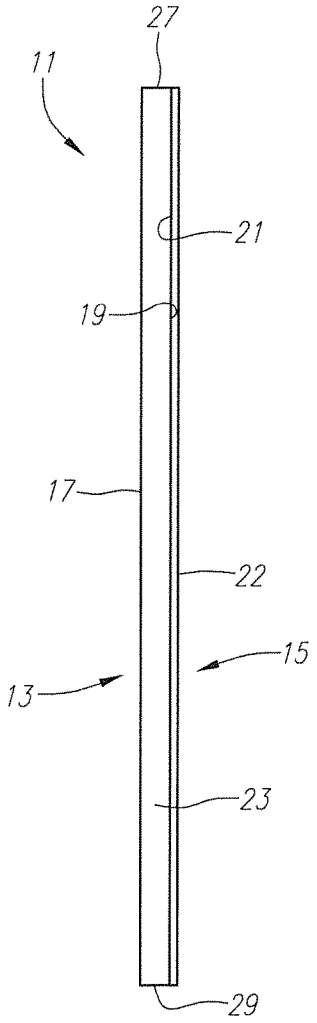
Figure 1F:
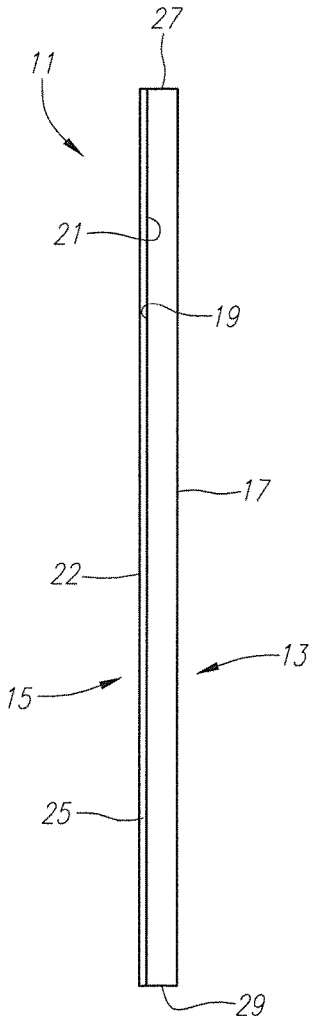
Figure 1G:
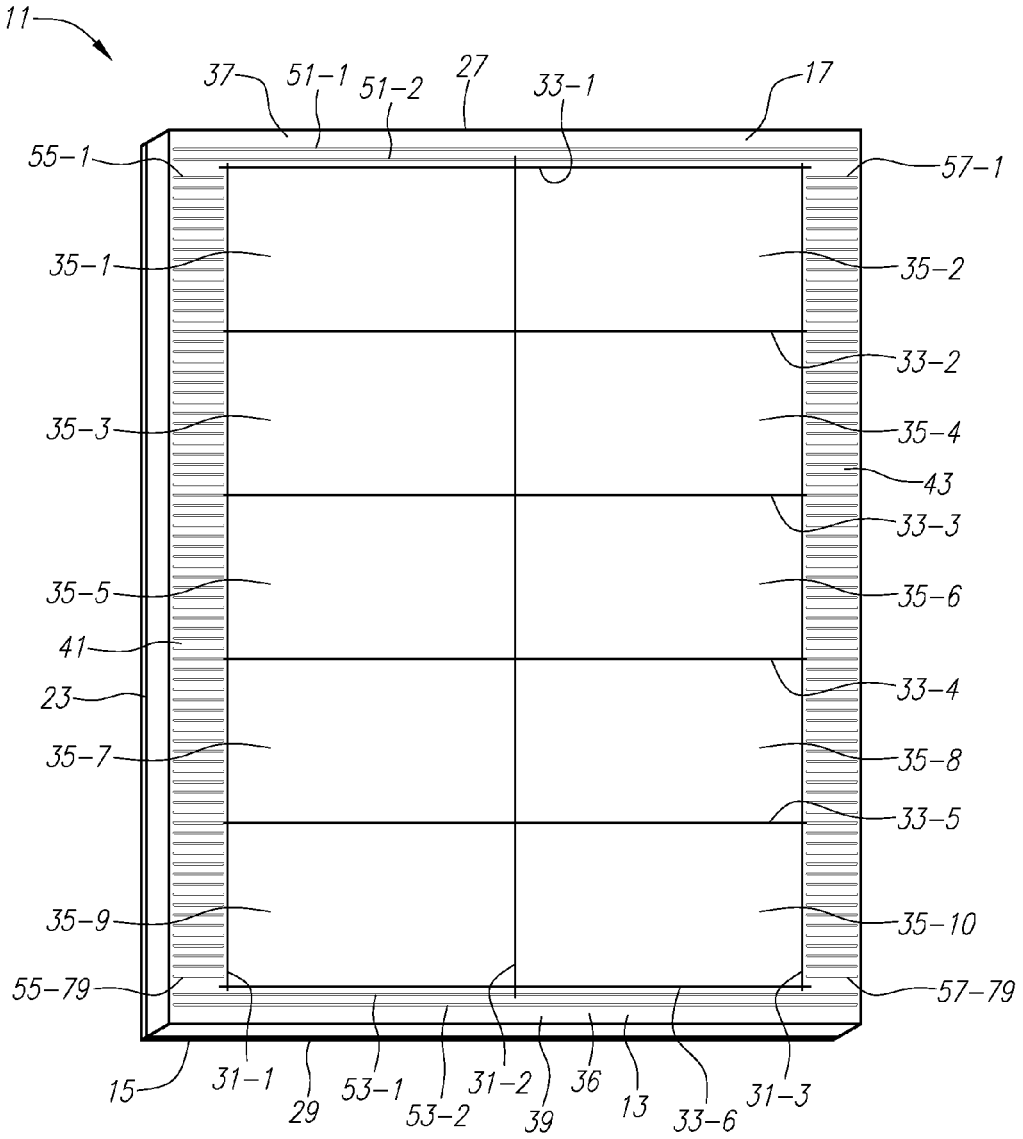
Figure 2:
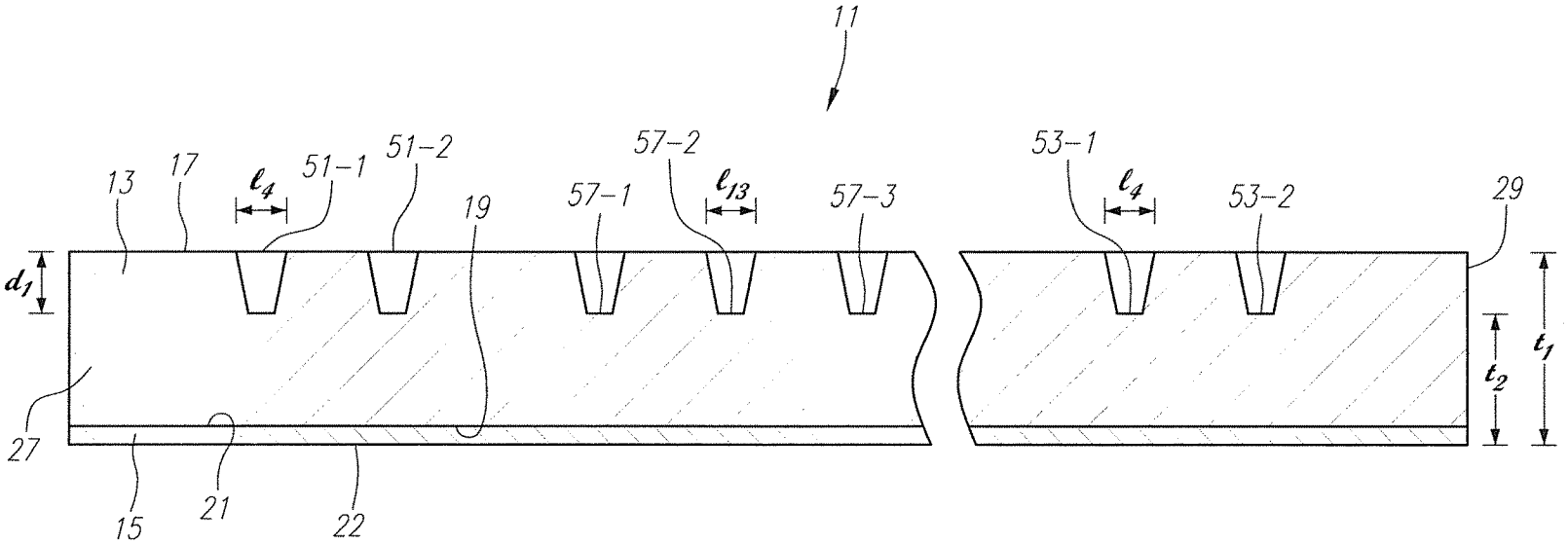
FIG. 2 is an enlarged fragmentary section view of the sheet construction of FIG. 1(*a*) taken along line 2'-2'.
Figure 3:
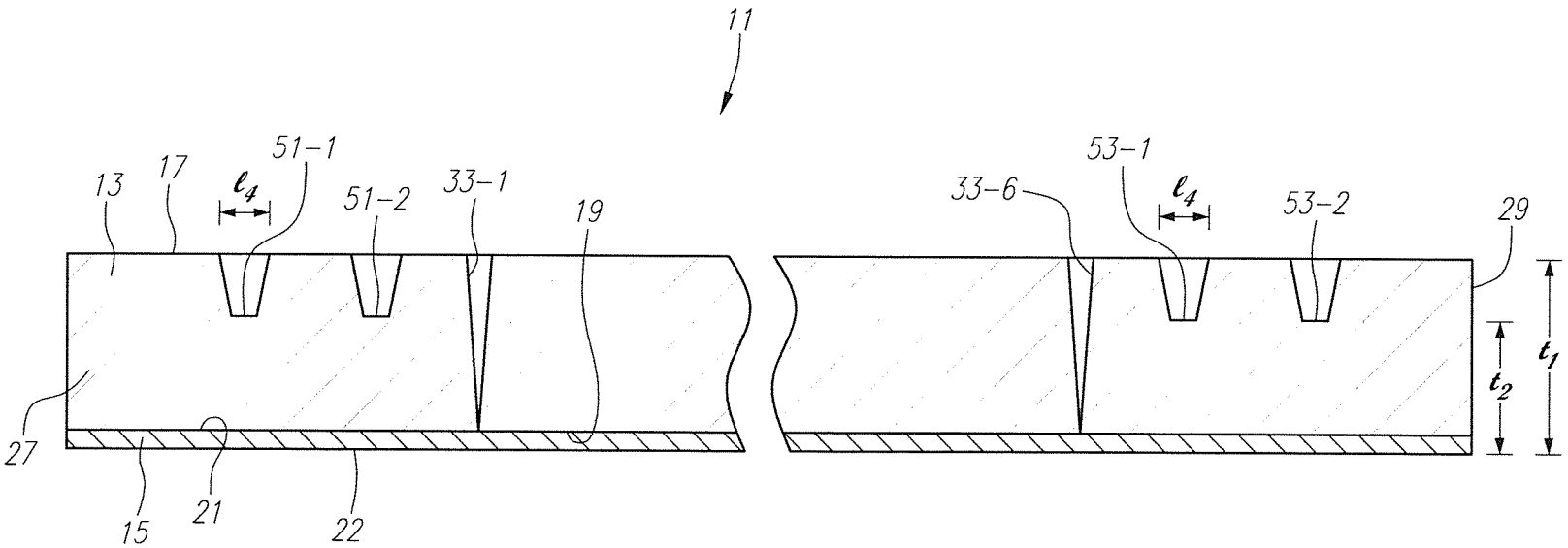
FIG. 3 is an enlarged fragmentary section view of the sheet construction of FIG. 1(*a*) taken along line 3'-3'.
Figure 4A:
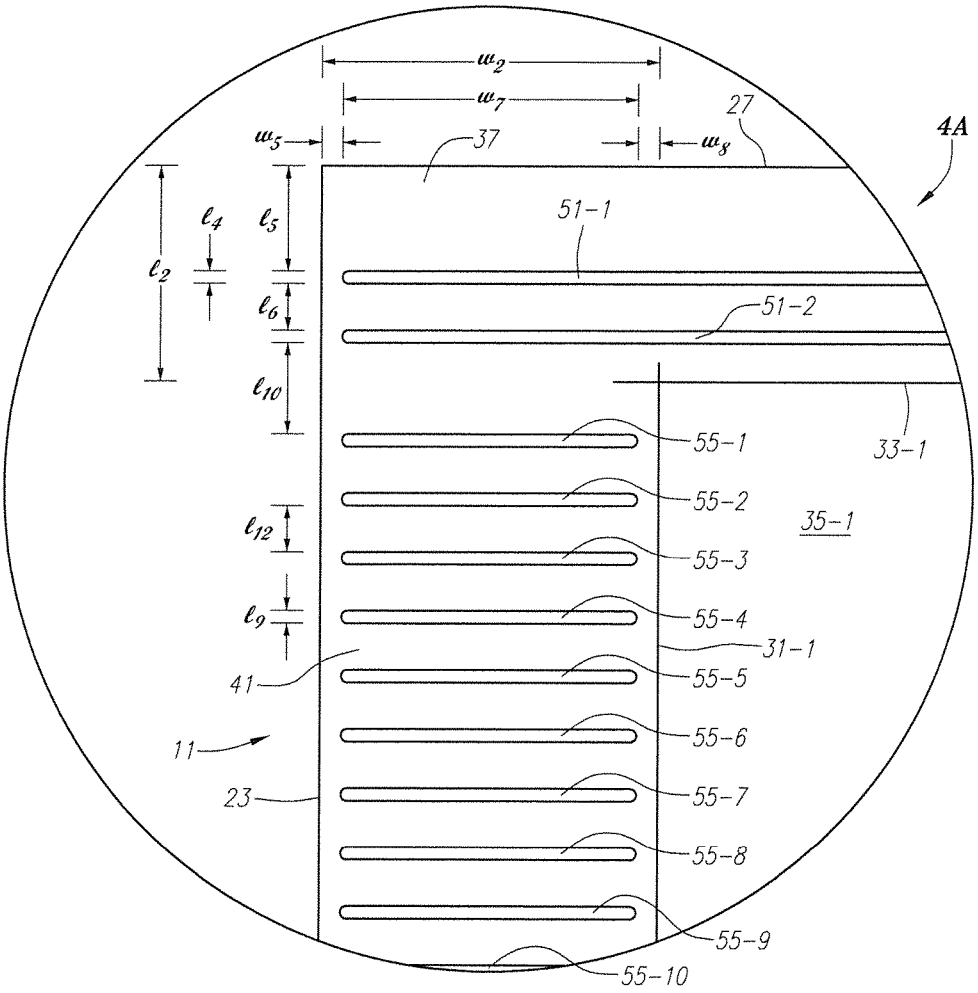
FIGS. 4(*a*), 4(*b*), 4(*c*), and 4(*d*) are enlarged fragmentary front views of portions 4A, 4B, 4C, and 4D, respectively, of FIG. 1(*a*)
Figure 4B:
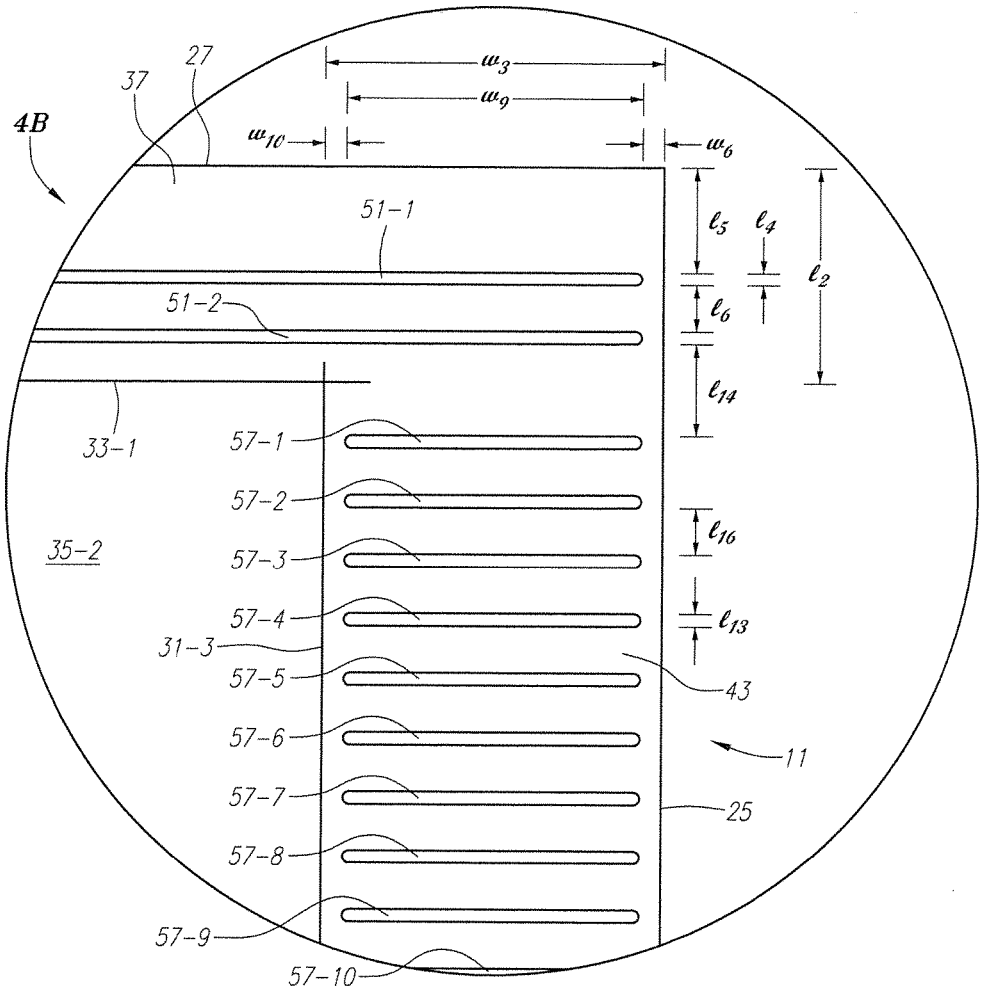
Figure 4C:
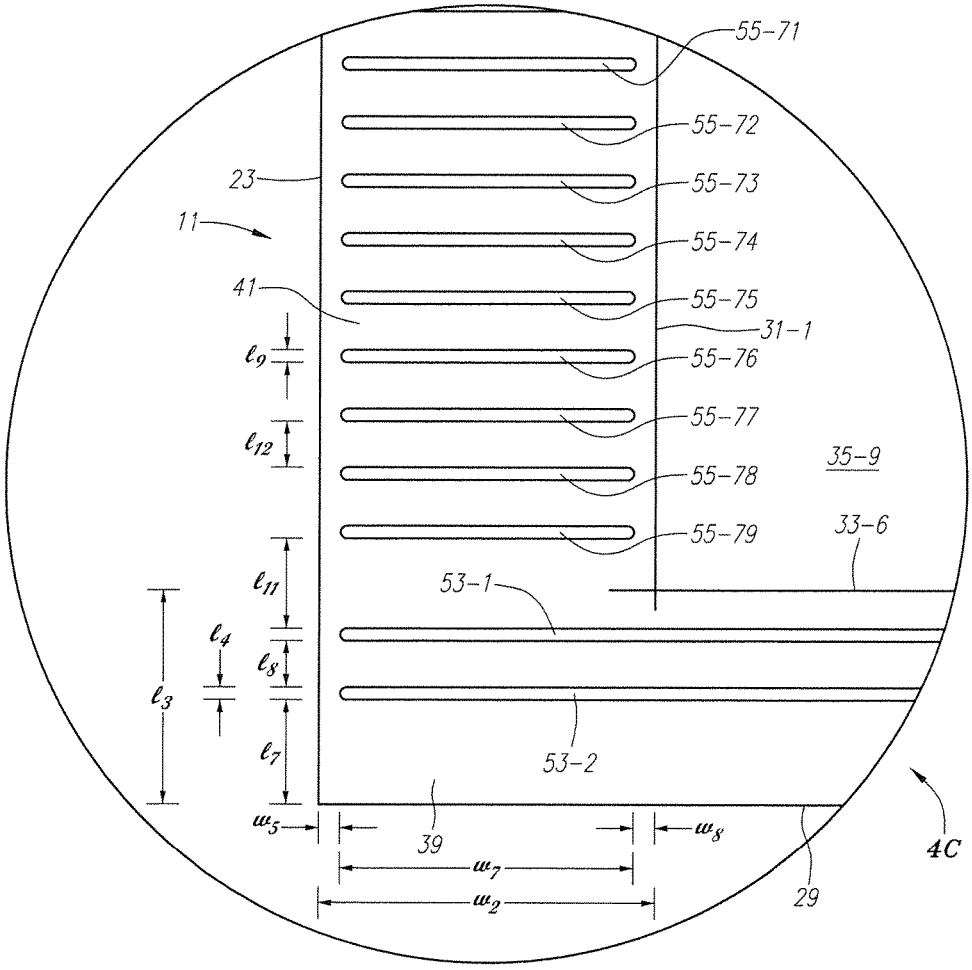
Figure 4D:
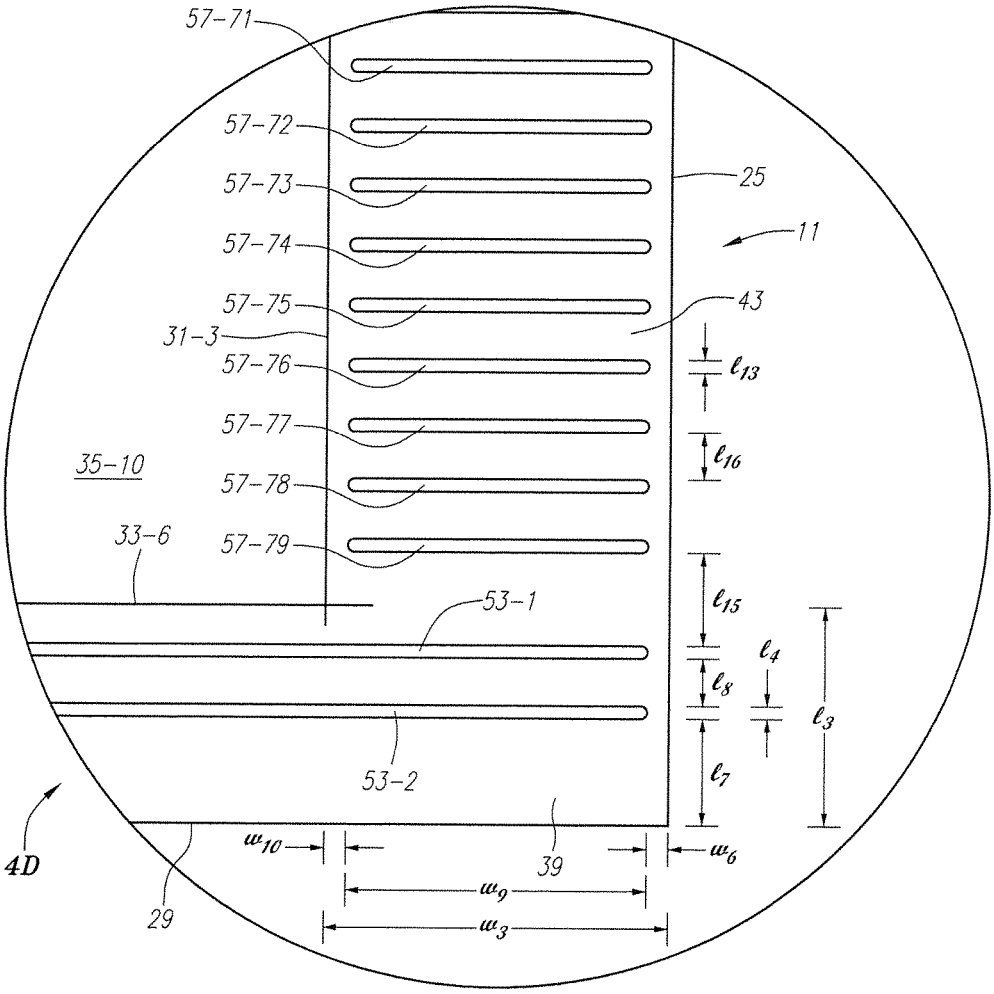

The present invention is directed, in part, at a sheet construction that includes one or more print-receptive media and that is designed to reduce the occurrence of certain print registration issues, particularly "start of print off-registration," even when the sheet construction is thick, for example, about 4 mils to about 14 mils. The present invention is also directed, in part, at methods for making and using the aforementioned sheet construction. According to the invention, sheet constructions can come in a multitude of configurations. A few non-limiting embodiments of such a sheet construction are discussed below, it being understood that additional embodiments are possible and that such embodiments come within the scope of the invention. Referring now to FIGS. 1(*a*) through 1(*g*), as well as to FIGS. 2, 3, and 4(*a*) through 4(*d*), there are shown various views, respectively, of a first embodiment of a sheet construction according to the present invention, the sheet construction being represented generally by reference numeral 11.

Sheet construction 11, which can be, for example, a sheet of printable business cards, can include a first material 13 and a second material 15. First material 13 can be a generally rectangular sheet-like structure of a standard paper size (e.g., letter-size, legal-size, A4, etc.) and can be shaped to include a first major surface 17 and an opposed second major surface 19. First major surface 17 can be receptive to markings of the type that can be made manually and/or with a printing device. Examples of markings of the type that can be made manually include, but are not limited to, hand-drawn pencil markings, hand-drawn pen markings, hand-drawn crayon markings, hand-drawn paint markings, hand-drawn dry-erase markings, hand-drawn chalk markings, hand-made stampings, including hand-made hot stampings, hand-made heat-transfers, and other hand-made markings known to those skilled in the art, as well as combinations thereof. Examples of markings of the type that can be made with a printing device include, but are not limited to, ink jet printer markings, laser printer markings, photocopier markings, and combinations thereof.

First material 13 can consist of a single layer or can include a multi-layer construction. Examples of single layer materials that can be used as material 13 can include certain paper materials and certain polymer films. Examples of such paper materials can include a sheet of cardstock, such as a sheet of 70-pound cardstock, and a sheet of label stock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

Second material 15 can be a generally rectangular sheet-like structure of standard paper size (e.g., letter-size, legal-size, A4, etc.) and can be shaped to include a first major surface 21 and an opposed second major surface 22. Second material 15 can be joined directly to first material 13, with first major surface 21 of second material 15 fixed to and in direct contact with second major surface 19 of first material 13. First material 13 and second material 15 can be coextensive so that the entirety of second major surface 19 of first material 13 can be covered by first major surface 21 of second material 15 and so that the entirety of first major surface 21 of second material 15 can be covered by second major surface 19 of first material 13. In this manner, first material 13 and second material 15 can jointly form a generally rectangular sheet-like structure including a first longitudinal edge 23, a second longitudinal edge 25, a leading edge 27, and a trailing edge 29, with first major surface 17 of first material 13 forming a first exposed surface for the structure and with second major surface 22 of second material 15 forming an opposed second exposed surface for the structure. In some embodiments, first and second materials are permanently attached while, in other embodiments, first and second materials are designed to be separated by a user.

Second material 15 can consist of a single layer or can include a multi-layer construction. For reasons to become apparent below, second material 15 can have a composition that permits second material 15 to snap-break when bent sufficiently. More specifically, second material 15 can have a stress-at-break in the range of about 10 MPa to about 30 MPa, preferably about 16 MPa, and can have an elongation at break in the range of about 10% to about 120%, preferably about 20% to about 50%. Examples of materials suitable for use as second material 15 can include coated or uncoated polymers, such polymers including polymethyl pentene, polyolefins (such as polypropylene, polyethylenes, and copolymers of propylene and ethylene), polyesters, polymethyl methacrylate, polystyrene, and compatible mixtures thereof. A particular example of a suitable polymer can be poly-4-methyl-1-pentene. Additional examples of materials suitable for use as second material 15 can be found in previously incorporated U.S. Patent Application Publication No. US 2003/0148056 A1 in connection with the discussion therein of carrier material 134.

Second material 15 can be applied directly to first material 13, for example, by extrusion. Second major surface 22 of second material 15 can be roughened, for example, in the manner described in previously incorporated U.S. Patent Application Publication No. US 2003/0148056 A1, so that first major surface 17 of first material 13 and second major surface 22 of second material 15 can have similar haptic properties, i.e., feel similar to the touch. In addition, the receptivity of second major surface 22 of second material 15 to markings of the type that can be made manually and/or with a printing device can be improved by such roughening.

First material 13 and second material 15 can have a combined total thickness of at least about 4 mils and, more specifically, can have a combined total thickness of about 4 mils to about 14 mils, or about 4 mils to about 7 mils in the case of the sheet construction including label stock, or about 8 mils to about 14 mils in the case of the sheet construction including card stock.

Sheet construction 11 can further include a plurality of defining or separation lines that can extend partially or completely through first material 13 and also partially through second material 15 but that do not extend completely through both first material 13 and second material 15. Such defining or separating lines can be, for example, die-cut lines, partial die-cut lines, perforated lines including microperforated lines, lines of cuts and ties, etched lines, and lines made by other techniques known in the art. As exemplified by the present embodiment, the aforementioned defining or separation lines can include three parallel longitudinally-extending lines 31-1 through 31-3 and six parallel laterally-extending lines 33-1 through 33-6. Longitudinally-extending lines 31-1 through 31-3 and laterally-extending lines 33-1 through 33-6 can be arranged to define an array of ten print-receptive media 35-1 through 35-10 and further to define a frame 36 surrounding print-receptive media 35-1 through 35-10, frame 36 including (i) a leading margin 37 extending from first longitudinal edge 23 to second longitudinal edge 25 and bounded by first longitudinal edge 23, second longitudinal edge 25, leading edge 27, and laterally-extending line 33-1, (ii) a trailing margin 39 extending from first longitudinal edge 23 to second longitudinal edge 25 and bounded by first longitudinal edge 23, second longitudinal edge 25, trailing edge 29, and laterally-extending line 33-6, (iii) a first side margin 41 bounded by first longitudinal edge 23, longitudinally-extending line 31-1, leading margin 37, and trailing margin 39, and (iv) a second side margin 43 bounded by second longitudinal edge 25, longitudinally-extending line 31-3, leading margin 37, and trailing margin 39.

Longitudinally-extending lines 31-1 through 31-3 and laterally-extending lines 33-1 through 33-6 can be formed, for example, in the same manner as, and can be shaped and dimensioned similarly to, separation lines 140 of previously incorporated U.S. Patent Application Publication No. US 2003/0148056 A1.

It should be understood that the number of longitudinally-extending lines 31-1 through 31-3, the number of laterally-extending lines 33-1 through 33-6, and the arrangement of longitudinally-extending lines 31-1 through 31-3 and laterally-extending lines 33-1 through 33-6 in the present embodiment are merely exemplary; consequently, the numbers of longitudinally-extending lines 31-1 through 31-3 and laterally-extending lines 33-1 through 33-6 can be increased or decreased and their arrangement can be modified.

Sheet construction 11 can further include, preferably outside the perimeters of print-receptive media 35-1 through 35-10, one or more leading compressed regions 51-1 and 51-2, trailing compressed regions 53-1 and 53-2, and side compressed regions 55-1 through 55-79 and 57-1 through 57-79, i.e., regions in which first material 13 and/or second material 15 are compressed to a reduced thickness. As seen, for example, in FIG. 2, with respect to the aforementioned one or more compressed regions, the thickness of sheet construction 11, as measured from first major surface 17 of first material 13 to second major surface 22 of second material 15, can be reduced by about 5 percent to about 35 percent from a non-compressed thickness $t_1$ of, for example, 4 mils to 14 mils, to a compressed thickness $t_2$ of, for example, about 2.6 mils to about 13.3 mils. The one or more compressed regions can be asymmetrically compressed relative to first major surface 17 of first material 13 and second major surface 22 of second material 15 and, for example, can appear in first major surface 17 of first material 13. As viewed from the front of sheet construction 11, the one or more compressed regions can include straight compressed regions (as shown, for example, in FIG. 1(*a*)), arcuate compressed regions (as shown, for example, in FIG. 18), or a mixture of straight and arcuate regions (as shown, for example, in FIG. 19). The one or more compressed regions can be positioned in one or more of leading margin 37, trailing margin 39, first side margin 41, and second side margin 43. Preferably, at least one compressed region is located 0.125 inch to 1.25 inch from leading edge 27. In the present embodiment, the one or more compressed regions can include the following: (i) two compressed regions 51-1 and 51-2, which can be disposed within leading margin 37, which can extend laterally as straight lines generally parallel to one another and to leading edge 27, and which can be evenly spaced from first longitudinal edge 23 and second longitudinal edge 25; (ii) two compressed regions 53-1 and 53-2, which can be disposed within trailing margin 39, which can extend laterally as straight lines generally parallel to one another and to leading edge 27, and which can be evenly spaced from first longitudinal edge 23 and second longitudinal edge 25; (iii) seventy-nine compressed regions 55-1 through 55-79, which can be disposed within first side margin 41, which can extend laterally as straight lines generally parallel to one another and to leading edge 27, and which can be evenly spaced from first longitudinal edge 23 and longitudinally-extending line 31-1; and (iv) seventy-nine compressed regions 57-1 through 57-79, which can be disposed within second side margin 43, which can extend laterally as straight lines generally parallel to one another and to leading edge 27, and which can be evenly spaced from longitudinally-extending line 31-3 and second longitudinal edge 25.

Turning now to FIGS. 1, 4(*a*), 4(*b*), 4(*c*), and 4(*d*), where, for example, sheet construction 11 has a width $w_1$ of 8½ inches and a length $l_1$ of 11 inches, with leading margin 37 having a length $l_2$ of 0.5 inch, with trailing margin 39 having a length $l_3$ of 0.5 inch, with first side margin 41 having a width $w_2$ of 0.75 inch, and with second side margin 43 having a width $w_3$ of 0.75 inch, each of leading compressed regions 51-1 and 51-2 and trailing compressed regions 53-1 and 53-2 can have a width $w_4$ of, for example, 8.375 inches, can have a length $l_4$ of, for example, 0.03 inch, can be spaced from first longitudinal edge 23 by a width $w_5$ of, for example, 0.063 inch, and can be spaced from second longitudinal edge 25 by a width $w_6$ of, for example, 0.063 inch. In addition, leading compressed region 51-1 can be spaced from leading edge 27 by a length $l_5$ of, for example, 0.250 inch, and leading compressed region 51-2 can be spaced from leading compressed region 51-1 by a length $l_6$ of, for example, 0.125 inch, whereby leading compressed region 51-2 can be spaced from leading edge 27 by a distance of, for example, 0.375 inch. Similarly, trailing compressed region 53-2 can be spaced from trailing edge 29 by a length $l_7$ of, for example, 0.250 inch, and trailing compressed region 53-1 can be spaced from trailing compressed region 53-2 by a length $l_8$ of, for example, 0.125 inch, whereby trailing compressed region 53-1 can be spaced from trailing edge 29 by a distance of, for example, 0.375 inch.

Each of side compressed regions 55-1 through 55-79 can have a width $w_7$ of, for example, 0.625 inch, can have a length $l_9$ of, for example, 0.03 inch, can be spaced from first longitudinal edge 23 by width $w_5$ of, for example, 0.063 inch, and can be spaced from longitudinally-extending line 31-1 by a width $w_8$ of, for example, 0.063 inch. In addition, side compressed region 55-1 can be spaced from leading compressed region 51-2 by a length $l_{10}$ of, for example, 0.250 inch, side compressed region 55-79 can be spaced from trailing compressed region 53-1 by a length $l_{11}$ of, for example, 0.250 inch, and each of side compressed regions 55-1 through 55-79 can be evenly spaced apart from one another by a length $l_{12}$ of, for example, 0.125 inch. Similarly, each of side compressed regions 57-1 through 57-79 can have a width $w_9$ of, for example, 0.625 inch, can have a length $l_{13}$ of, for example, 0.03 inch, can be spaced from second longitudinal edge 25 by width $w_6$ of, for example, 0.063 inch, and can be spaced from longitudinally-extending line 31-3 by a width $w_{10}$ of, for example, 0.063 inch. In addition, side compressed region 57-1 can be spaced from leading compressed region 51-2 by a length $l_{14}$ of, for example, 0.250 inch, side compressed region 57-79 can be spaced from trailing compressed region 53-1 by a length $l_{15}$ of, for example, 0.250 inch, and each of side compressed regions 57-1 through 57-79 can be evenly spaced apart from one another by a length $l_{16}$ of, for example, 0.125 inch.

More generally, the length $l_4$ of each of leading compressed regions 51-1 and 51-2 and trailing compressed regions 53-1 and 53-2 can be in the range of, but is not limited to, about 0.030 inch to about 0.039 inch. In addition, the width $w_4$ of each of leading compressed regions 51-1 and 51-2 and trailing compressed regions 53-1 and 53-2 can be less than the width $w_1$ of sheet construction 11 by an amount in the range of, but not limited to, from 0 inch to about 0.158 inch, more specifically about 0.040 inch to about 0.158 inch. In other words, the width $w_5$ separating each of leading compressed regions 51-1 and 51-2 and trailing compressed regions 53-1 and 53-2 from first longitudinal edge 23 and the width $w_6$ separating each of leading compressed regions 51-1 and 51-2 and trailing compressed regions 53-1 and 53-2 from second longitudinal edge 25 can be in the range of, but is not limited to, 0 inch to about 0.079 inch, more specifically about 0.020 inch to about 0.079 inch. Moreover, each of leading compressed regions 51-1 and 51-2 and trailing compressed regions 53-1 and 53-2 can be compressed to a depth $d_1$ (see FIG. 2) of about 85 microns (3.35 mils) to about 110 microns (4.33 mils), which can be about 24% to about 35% of the total caliper of sheet construction 11.

In addition, the length $l_9$ of each of side compressed regions 55-1 through 55-79 and the length $l_{13}$ of each of side compressed regions 57-1 through 57-79 can be in the range of, but is not limited to, about 0.030 inch to about 0.039 inch. In addition, each of side compressed regions 55-1 through 55-79 can be spaced apart from first longitudinal edge 23 by a width $w_5$ that can be in the range of, but is not limited to, 0 inch to about 0.079 inch, more specifically about 0.020 inch to about 0.079 inch, and can be spaced apart from longitudinally-extending line 31-1 by a width $w_8$ that can be in the range of, but is not limited to, 0 inch to about 0.079 inch, more specifically about 0.020 inch to about 0.079 inch. Similarly, each of side compressed regions 57-1 through 57-79 can be spaced apart from second longitudinal edge 25 by a width $w_6$ that can be in the range of, but is not limited to, 0 inch to about 0.079 inch, more specifically about 0.020 inch to about 0.079 inch, and can be spaced apart from longitudinally-extending line 31-3 by a width $w_{10}$ that can be in the range of, but is not limited to, 0 inch to about 0.079 inch, more specifically about 0.020 inch to about 0.079 inch. In addition, each of side compressed regions 55-1 through 55-79 and 57-1 through 57-79 can be compressed to a depth $d_1$ (see FIG. 2) of about 20 microns (0.787 mils) to about 110 microns (3.35 mils), which can be about 5% to about 35% of the total caliper of sheet construction 11.

Without wishing to be limited to any particular theory behind the invention, it is believed that the one or more compressed regions in leading margin 37 and trailing margin 39, which compressed regions are exemplified in the present embodiment by leading compressed regions 51-1 and 51-2 and trailing compressed regions 53-1 and 53-2, can serve to decrease the stiffness of sheet construction 11 in the direction along first longitudinal edge 23 and second longitudinal edge 25, i.e., along length $l_1$. In particular, it is believed that, by including leading compressed regions 51-1 and 51-2 in leading margin 37, one can decrease the force needed to bend sheet construction 11, at laterally-extending line 33-1, around the internal bends of a printing device by about 24% to about 38%. Such a reduction in force is believed to reduce the incidence of "start of print off-registration" errors. This is believed to be because the increased flexibility of sheet construction 11 along its length $l_1$, attributable at least in part to leading compressed regions 51-1 and 51-2 and trailing compressed regions 53-1 and 53-2, enables sheet construction 11 to bend more easily through the tortuous path of a printing device.

In addition, without wishing to be limited to any particular theory behind the invention, it is believed that side compressed regions 55-1 through 55-79 and/or side compressed regions 57-1 through 57-79 enable the rollers inside a printing device to better engage sheet construction 11, thereby allowing more continuous indexing of sheet construction 11 through the printing device. This may be because the side compressed regions allow the printing device to better frictionally engage the sheet construction as it is being fed through the printing device.

It should be understood that the present embodiment discloses an exemplary number and arrangement of leading compressed regions 51-1 and 51-2, trailing compressed regions 53-1 and 53-2, and side compressed regions 55-1 through 55-79 and 57-1 through 57-79; consequently, the number of leading compressed regions 51-1 and 51-2, trailing compressed regions 53-1 and 53-2, and side compressed regions 55-1 through 55-79 and 57-1 through 57-79 can be increased or decreased, and the dimensions and placement of leading compressed regions 51-1 and 51-2, trailing compressed regions 53-1 and 53-2, and side compressed regions 55-1 through 55-79 and 57-1 through 57-79 can be modified. Notwithstanding the above, it is believed that sheet construction 11 can include, for example, from twenty-six to one hundred twenty compressed regions in one or both of first side margin 41 and second side margin 43 and can include, for example, from one to four compressed regions in one or both of leading margin 37 and trailing margin 39.

Figure 5:
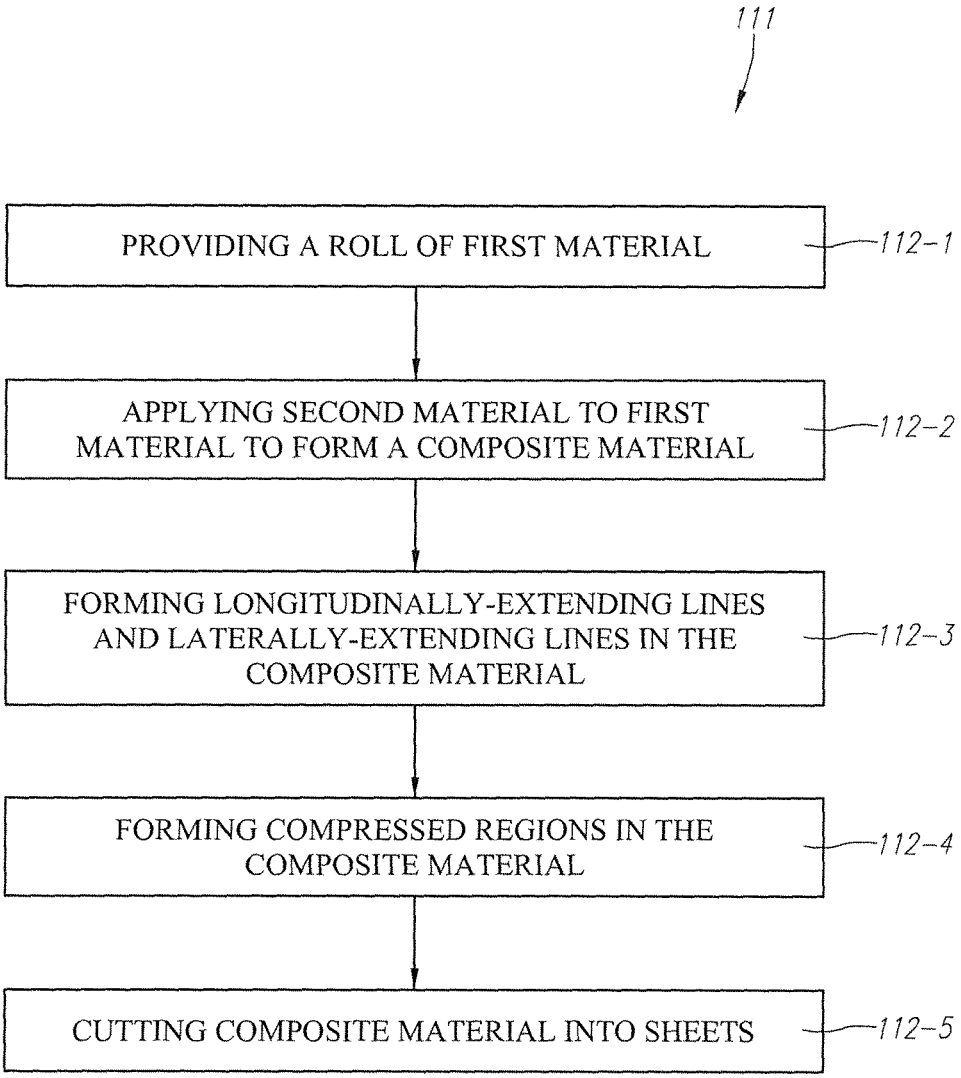
FIG. 5 is a flowchart, schematically depicting one method of making the sheet construction of FIGS. 1(*a*) through 1(*g*)

Referring now to FIG. 5, there is shown a flowchart, schematically depicting one embodiment of a method for making sheet construction 11, the method being represented generally by reference numeral 111. Method 111 can begin in a step 112-1 with the provision of a roll of first material 13. As noted above, first material 13 can be a single layer or a multilayer structure. Examples of single layer materials that can be used as first material 13 can include certain paper materials and certain polymer films. Examples of such paper materials can include a sheet of cardstock, such as a sheet of 70-pound cardstock, and a sheet of label stock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

Method 111 can then continue in a step 112-2 with the application of second material 15 to second major surface 19 of first material 13 to form a composite roll. As noted above, second material 15 can consist of a single layer or can include a multi-layer construction. Examples of materials suitable for use as second material 15 can include coated or uncoated polymers, such polymers including polymethyl pentene, polyolefins (such as polypropylene, polyethylenes, and copolymers of propylene and ethylene), polyesters, polymethyl methacrylate, polystyrene, and compatible mixtures thereof. A particular example of a suitable polymer can be poly-4-methyl-1-pentene. Additional examples of materials suitable for use as second material 15 can be found in previously incorporated U.S. Patent Application Publication No. US 2003/0148056 A1 in connection with the discussion therein of carrier material 134. Where second material 15 is a polymer, such as poly-4-methyl-1-pentene or a similar substance, the application of second material 15 to first material 13 can be by extrusion. This allows second material 15 to be coupled to first material 13 without requiring an adhesive layer therebetween.

Method 111 can then continue in a step 112-3 with the formation of longitudinally-extending lines 31-1 through 31-3 and laterally-extending lines 33-1 through 33-6 in the composite roll. The formation of longitudinally-extending lines 31-1 through 31-3 and laterally-extending lines 33-1 through 33-6 can be achieved, for example, by die-cutting and preferably involves cutting through first material 13 from first major surface 17 without cutting through second material 15. Method 111 can then continue in a step 112-4 with the formation of leading compressed regions 51-1 and 51-2, trailing compressed regions 53-1 and 53-2, and side compressed regions 55-1 through 55-79 and 57-1 through 57-79 in the composite roll. The formation of leading compressed regions 51-1 and 51-2, trailing compressed regions 53-1 and 53-2, and side compressed regions 55-1 through 55-79 and 57-1 through 57-79 can be performed by pressing a scoring roller having protrusions that are complementary in shape to the compressed regions one wishes to create against first major surface 17 of first material 13. It should be understood that, although step 112-3 is described above as taking place before step 112-4, the order of these two steps could be reversed. Method 111 can then conclude in a step 112-5 with the cutting of the composite roll into sheets, preferably of standard paper size.

Figure 6:
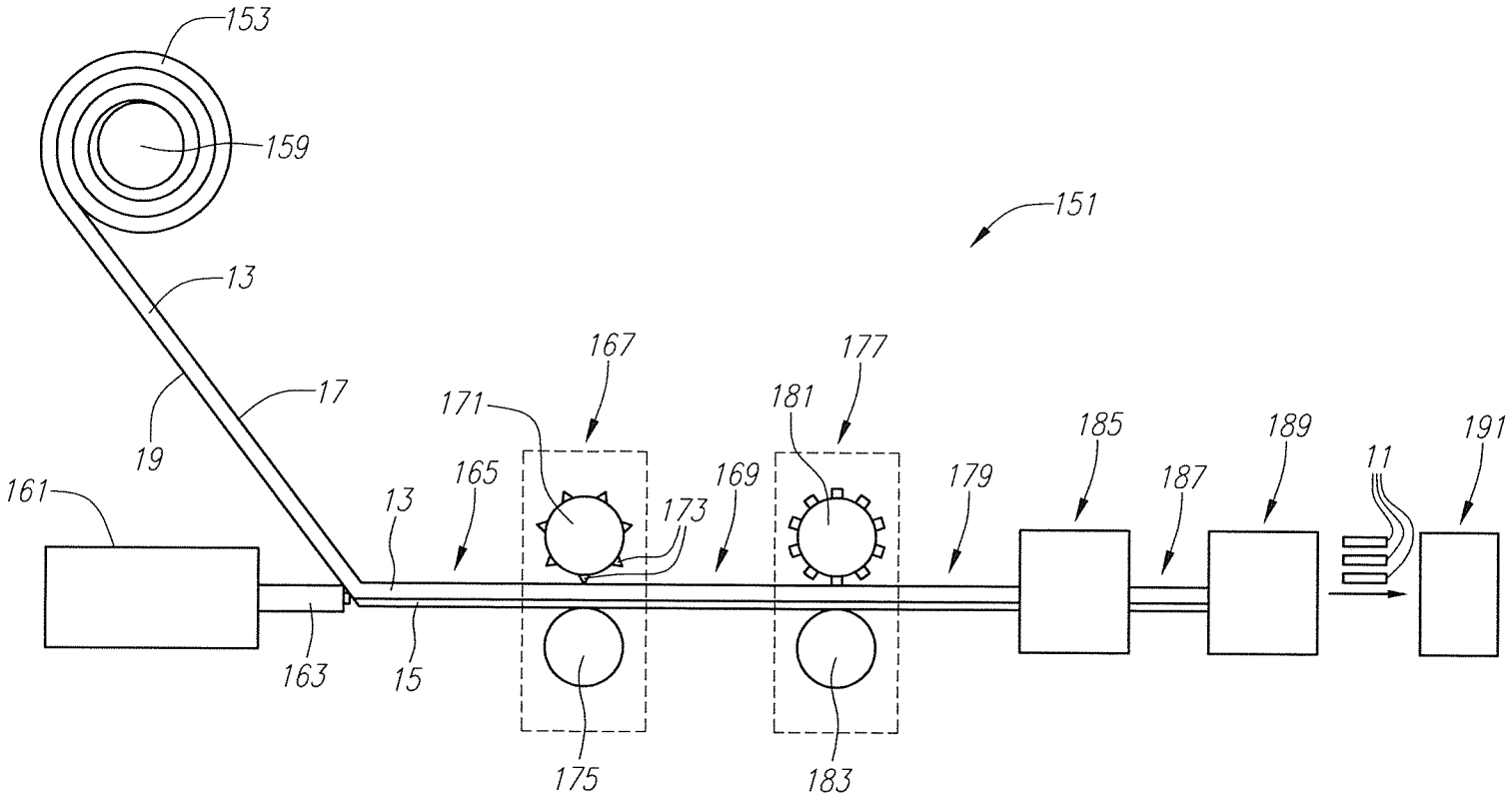
FIG. 6 is a simplified schematic view of one embodiment of an apparatus that can be used to make the sheet construction of FIGS. 1(*a*) through 1(*g*)

Referring now to FIG. 6, there is schematically shown an apparatus that can be used to make sheet construction 11, the apparatus being represented by reference numeral 151.

Apparatus 151 can include a supply roll 153 of first material 13, which supply roll 153 can be unwound from a reel 159. Apparatus 151 can further include an extruder 161 equipped with a die head 163. First material 13 can be fed past die head 163 so that second material 15 can be continuously extruded onto second major surface 19 of first material 13, thereby forming a composite material 165 of first material 13 and second material 15. Apparatus 151 can further include a media defining station 167 through which composite material 165 can be passed so that individual print-receptive media 35-1 through 35-10 can be defined in composite material 165, thereby yielding a first modified composite material 169. Station 167 can include the combination of a cylindrical die 171 having knife elements 173 arranged on its periphery and a smooth anvil roller 175.

Figure 7:
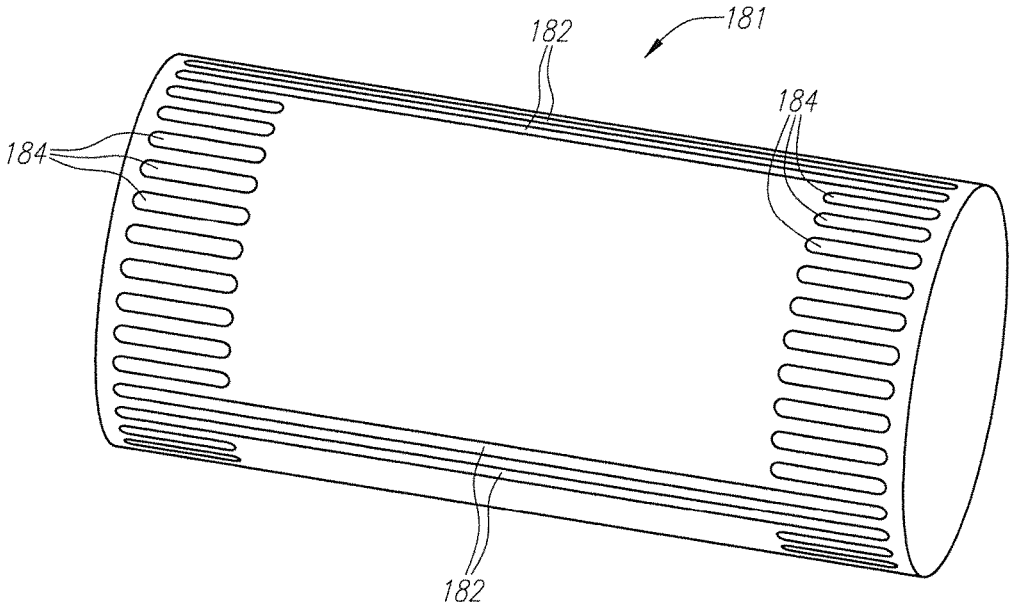
FIG. 7 is an enlarged perspective view of the scoring roller shown in FIG. 6.

Apparatus 151 can further include a compressing station 177 through which first modified composite material 169 can be passed so that leading compressed regions 51-1 and 51-2, trailing compressed regions 53-1 and 53-2, and side compressed regions 55-1 through 55-79 and 57-1 through 57-79 can be formed in first modified composite material 169, thereby yielding a second modified composite material 179. Station 177 can include the combination of a scoring roller 181 (also shown in FIG. 7 and including a plurality of longer protrusions 182, which can be used, for example, to form leading compressed regions 51-1 and 51-2 and trailing compressed regions 53-1 and 53-2, and a plurality of shorter protrusions 184, which can be used, for example, to form side compressed regions 55-1 through 55-79 and 57-1 through 57-79) and a smooth anvil roller 183. Apparatus 151 can further include a printing station 185 through which second modified composite material 179 can be passed so that indicia (e.g., trademarks, instructions, etc.) can be imprinted on first material 13 and/or second material 15, thereby yielding a third modified composite material 187. Apparatus 151 can further include a sheeting station 189 for cutting third modified composite material 187 into standard paper-sized sheets, thereby yielding sheet construction 11. Apparatus 151 can further include a packaging station 191 for packaging one or more sheet constructions 11.

Figure 8:
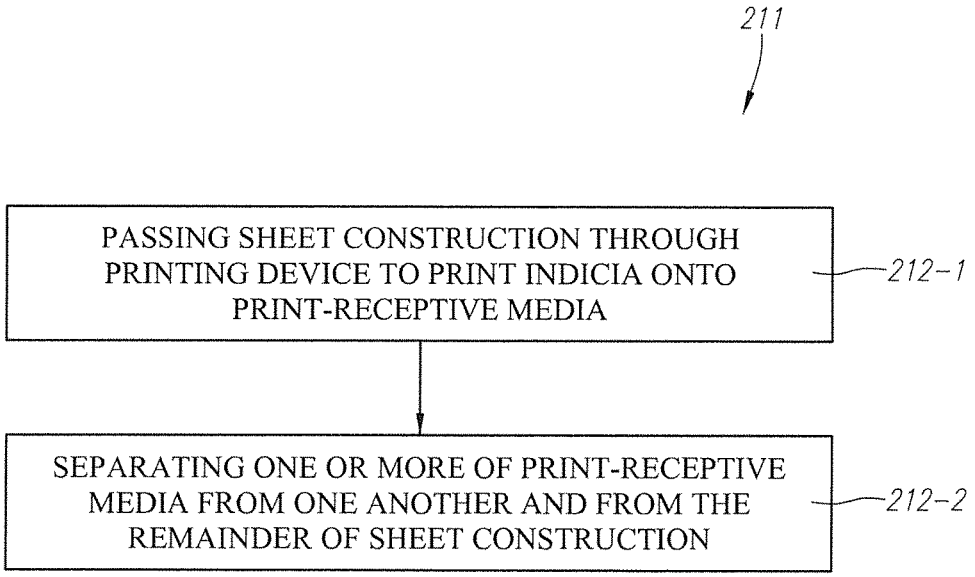
FIG. 8 is a flowchart, schematically depicting one method of using the sheet construction of FIGS. 1(*a*) through 1(*g*)
Figure 9A:
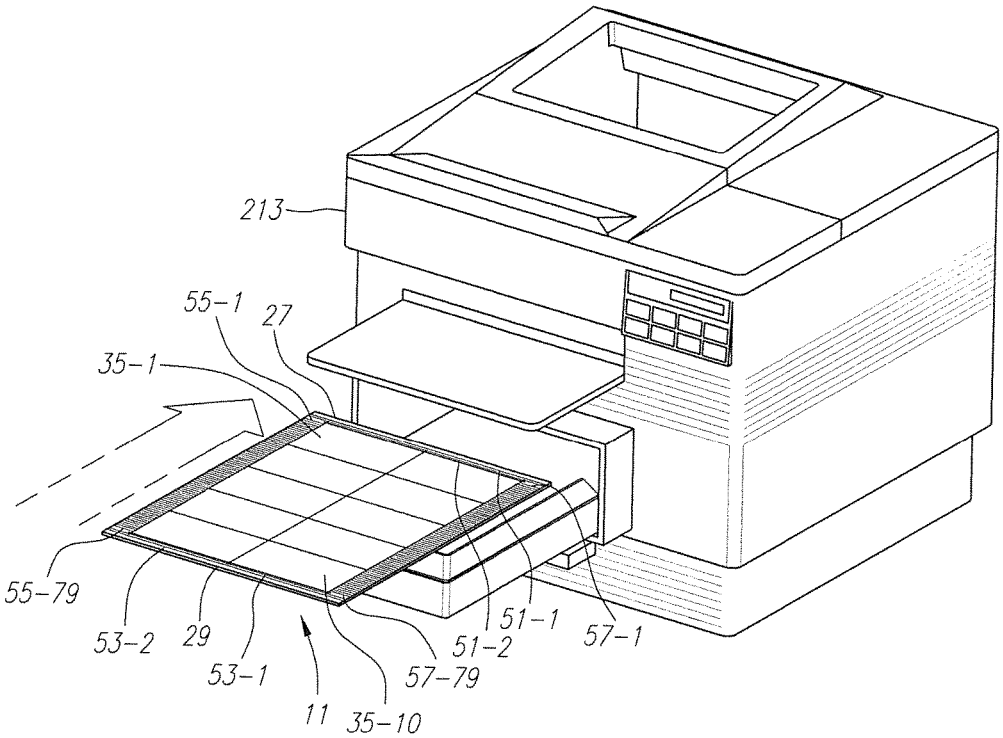
FIGS. 9(*a*) and 9(*b*) are perspective and enlarged fragmentary section views, respectively, illustrating the performance of certain steps of the method of FIG. 8.
Figure 9B:
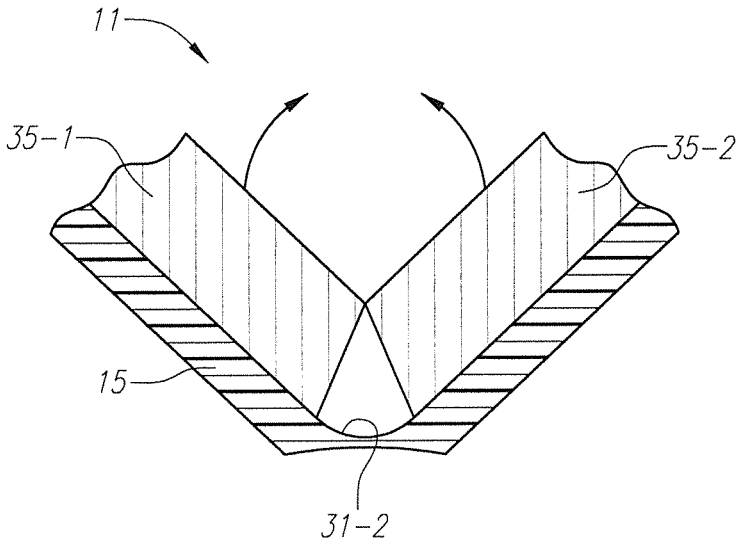

Referring now to FIG. 8, there is shown a flowchart, schematically depicting one embodiment of a method for using sheet construction 11, the method being represented generally by reference numeral 211. Method 211 can begin in a step 212-1 with the passing of sheet construction 11 through a printing device 213 (see also FIG. 9(*a*)), whereby indicia can be printed on one or more of print-receptive media 35-1 through 35-10. Because of the presence of leading compressed regions 51-1 and 51-2, trailing compressed regions 53-1 and 53-2, and side compressed regions 55-1 through 55-79 and 57-1 through 57-79 on sheet construction 11, the occurrence of "start of print off-registration" errors can be reduced. Method 211 can then conclude in a step 212-2 with the separation of one or more of print-receptive media 35-1 through 35-10 from one another and from the remainder of sheet construction 11, one or more of said print-receptive media 35-1 through 35-10 preferably bearing printed indicia thereon. Such separation can be achieved, for example, by bending sheet construction 11 until second material 15 breaks in an area underlying one or more of longitudinally-extending lines 31-1 through 31-3 and laterally-extending lines 33-1 through 33-6 (see also FIG. 9(*b*)).

Figure 10A:
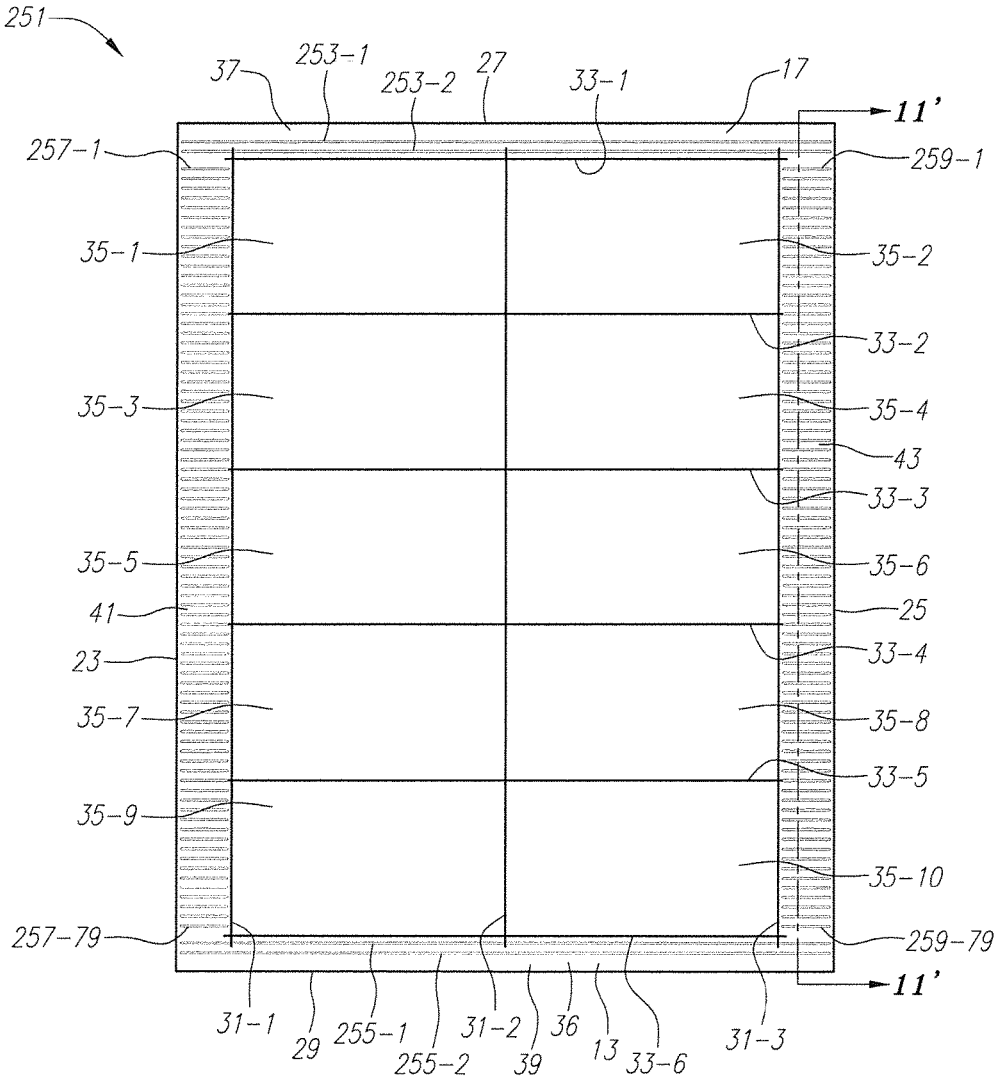
FIGS. 10(*a*) and 10(*b*) are front plan and rear plan views, respectively, of a second embodiment of a sheet construction according to the present invention.
Figure 10B:
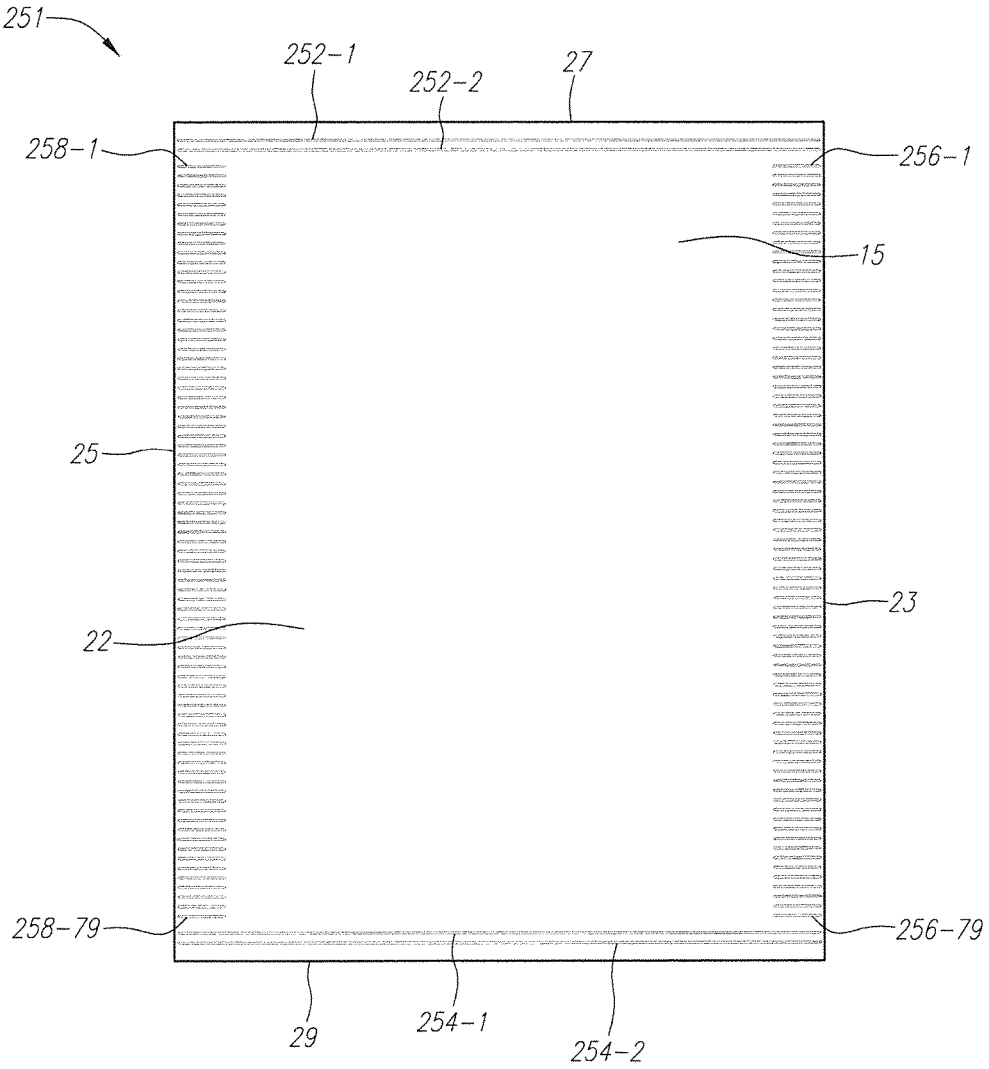
Figure 11:
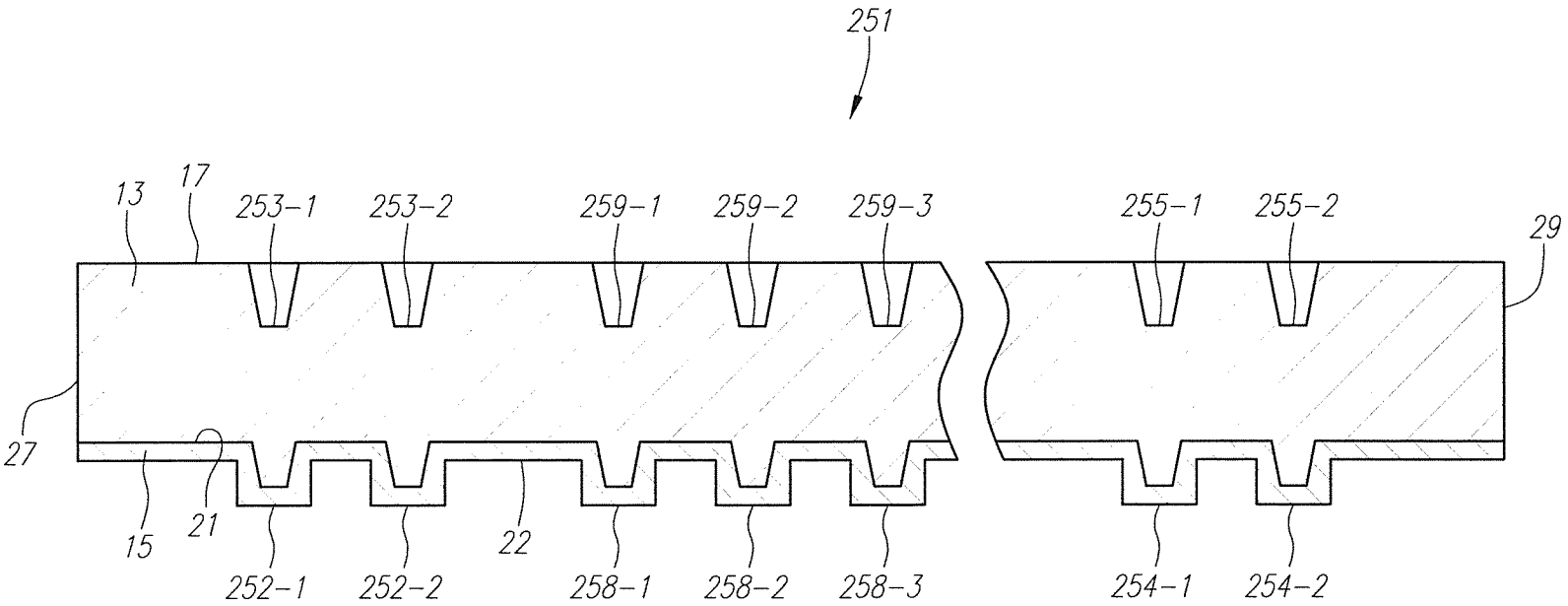
FIG. 11 is a section view of the sheet construction of FIG. 10(*a*) taken along line 11'-11'.

Referring now to FIGS. 10(*a*), 10(*b*), and 11, there are shown various views of a second embodiment of a sheet construction according to the present invention, the sheet construction being represented generally by reference numeral 251.

Sheet construction 251 can be similar in most respects to sheet construction 11. A principal difference between sheet construction 251 and sheet construction 11 can be that, whereas sheet construction 11 can include compressed regions 51-1, 51-2, 53-1, 53-2, 55-1 through 55-79, and 57-1 through 57-79 that appear in first major surface 17 of first material 13 but do not appear as protrusions in second major surface 22 of second material 15, sheet construction 251 can include compressed regions 253-1, 253-2, 255-1, 255-2, 257-1 through 257-79, and 259-1 through 259-79 in first major surface 17 of first material 13 and protrusions 252-1, 252-2, 254-1, 254-2, 256-1 through 256-79, and 258-1 through 258-79 in second major surface 22 of second material 15. Compressed regions 253-1, 253-2, 255-1, 255-2, 257-1 through 257-79, and 259-1 through 259-79 can be made by a process that is essentially identical to that described above for making compressed regions 51-1, 51-2, 53-1, 53-2, 55-1 through 55-79, and 57-1 through 57-79. It is believed that whether or not such a process results in compressed regions like compressed regions 51-1, 51-2, 53-1, 53-2, 55-1 through 55-79, and 57-1 through 57-79, which do not exhibit corresponding protrusions in second major surface 22 of second material 15, or in compressed regions like compressed regions 253-1, 253-2, 255-1, 255-2, 257-1 through 257-79, and 259-1 through 259-79, which do exhibit protrusions 252-1, 252-2, 254-1, 254-2, 256-1 through 256-79, and 258-1 through 258-79 in second major surface 22 of second material 15, can be affected, to some degree, by the amount of support provided to second major surface 22 of second material 15 as the regions are being compressed. In other words, when comparatively lesser support is provided to second major surface 22 of second material 15 as compression takes place, compressed regions resembling compressed regions 253-1, 253-2, 255-1, 255-2, 257-1 through 257-79, and 259-1 through 259-79 and protrusions 252-1, 252-2, 254-1, 254-2, 256-1 through 256-79, and 258-1 through 258-79 can tend to be formed whereas, when comparatively greater support is provided to second major surface 22 of second material 15 as compression takes place, compressed regions resembling compressed regions 51-1, 51-2, 53-1, 53-2, 55-1 through 55-79, and 57-1 through 57-79 can tend to be formed.

Sheet construction 251 can be used in the same fashion as sheet construction 11.

Figure 12:
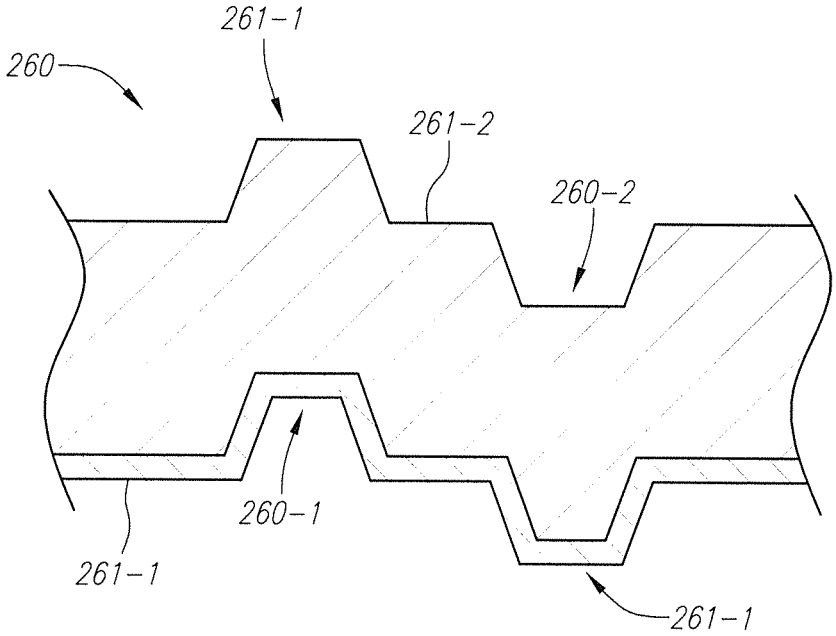
FIG. 12 is a fragmentary section view of a first alternate embodiment to the sheet construction shown in FIG. 11.
Figure 13:
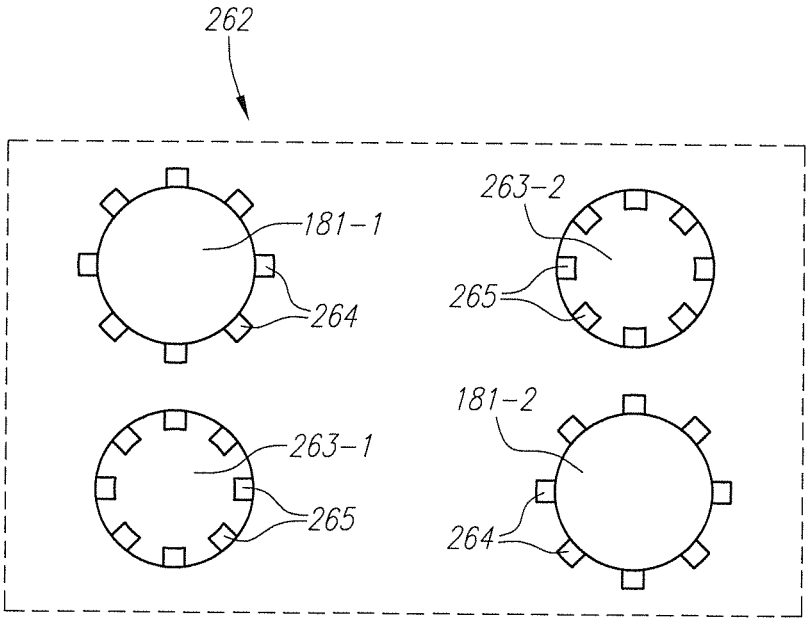
FIG. 13 is a simplified schematic view of a first alternate embodiment to the compressing station shown in FIG. 6.

A partial section view of a first alternate embodiment to sheet construction 251 is shown in FIG. 12 as sheet construction 260. Sheet construction 260, which includes compressed regions 260-1 and 260-2 and protrusions 261-1 and 261-2, can be formed by modifying apparatus 151 of FIG. 6 by replacing compressing station 177 with a compressing station 262, which is shown in FIG. 13. Compressing station 262 can include the combination of a first scoring roller 181-1, a first anvil roller 263-1, a second scoring roller 181-2, and a second anvil roller 263-2. First scoring roller 181-1 and second scoring roller 181-2 can be provided with protrusions 264, and first anvil roller 263-1 and second anvil roller 263-2 can be provided with complementary recesses 265. Second scoring roller 181-2 and second anvil roller 263-2 can be indexed relative to first scoring roller 181-1 and first anvil roller 263-1 to produce the alternating pattern of compressed regions 260-1 and 260-2 and protrusions 261-1 and 261-2 shown in FIG. 12.

Figure 14:
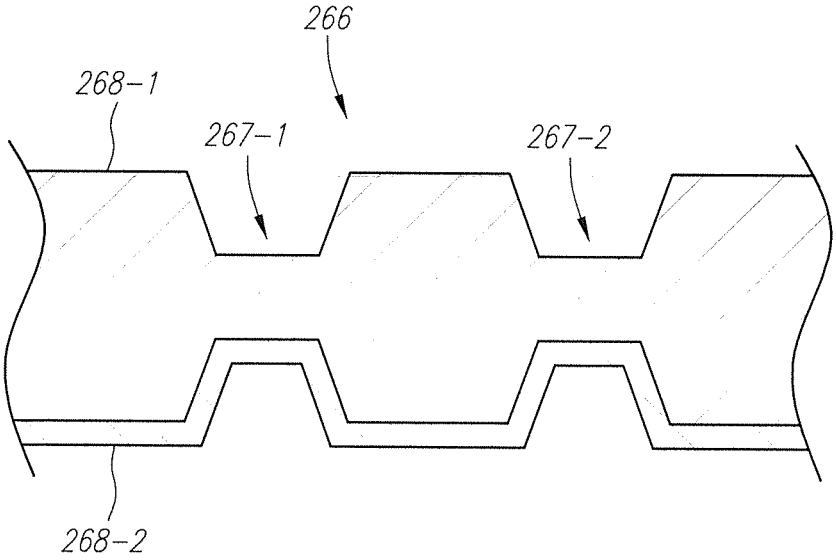
FIG. 14 is a fragmentary section view of a second alternate embodiment to the sheet construction shown in FIG. 11.
Figure 15:
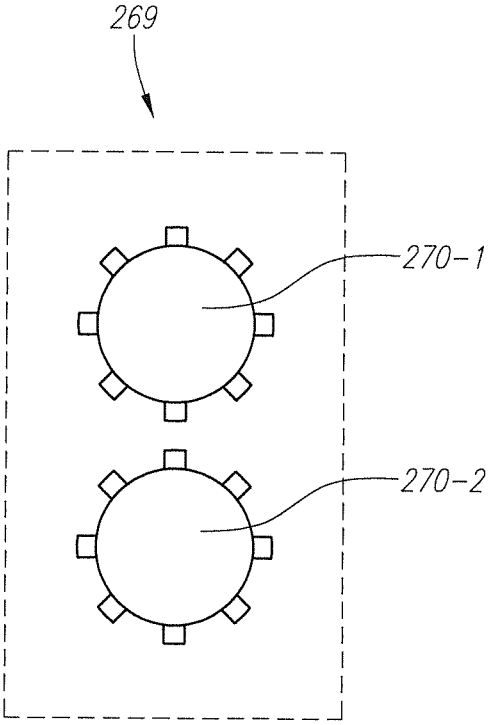
FIG. 15 is a simplified schematic view of a second alternate embodiment to the compressing station shown in FIG. 6.
Figure 16A:
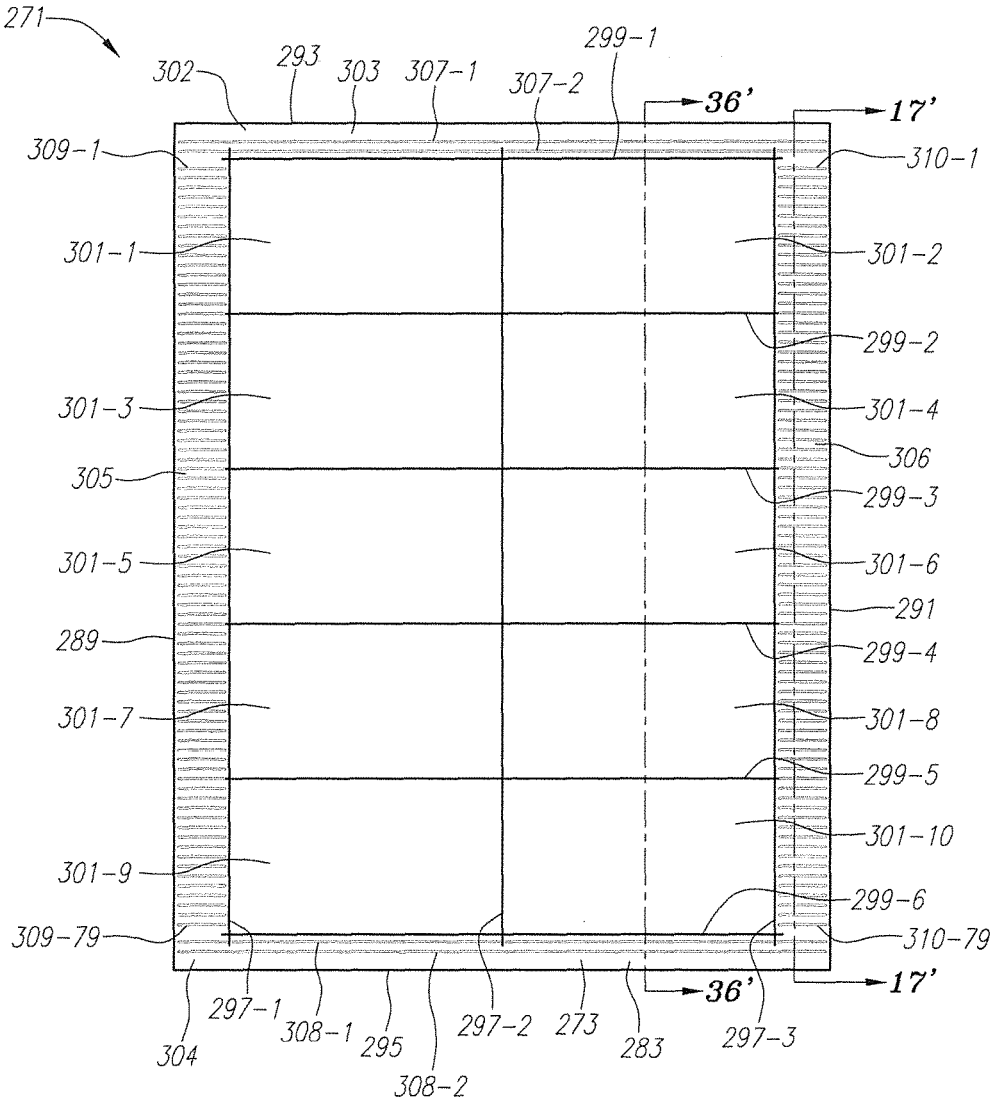
FIGS. 16(*a*), 16(*b*), 16(*c*), 16(*d*), 16(*e*), and 16(*f*) are front plan, rear plan, top elevation, bottom elevation, left-side elevation, and right-side elevation views, respectively, of a fifth embodiment of a sheet construction according to the present invention.
Figure 16B:
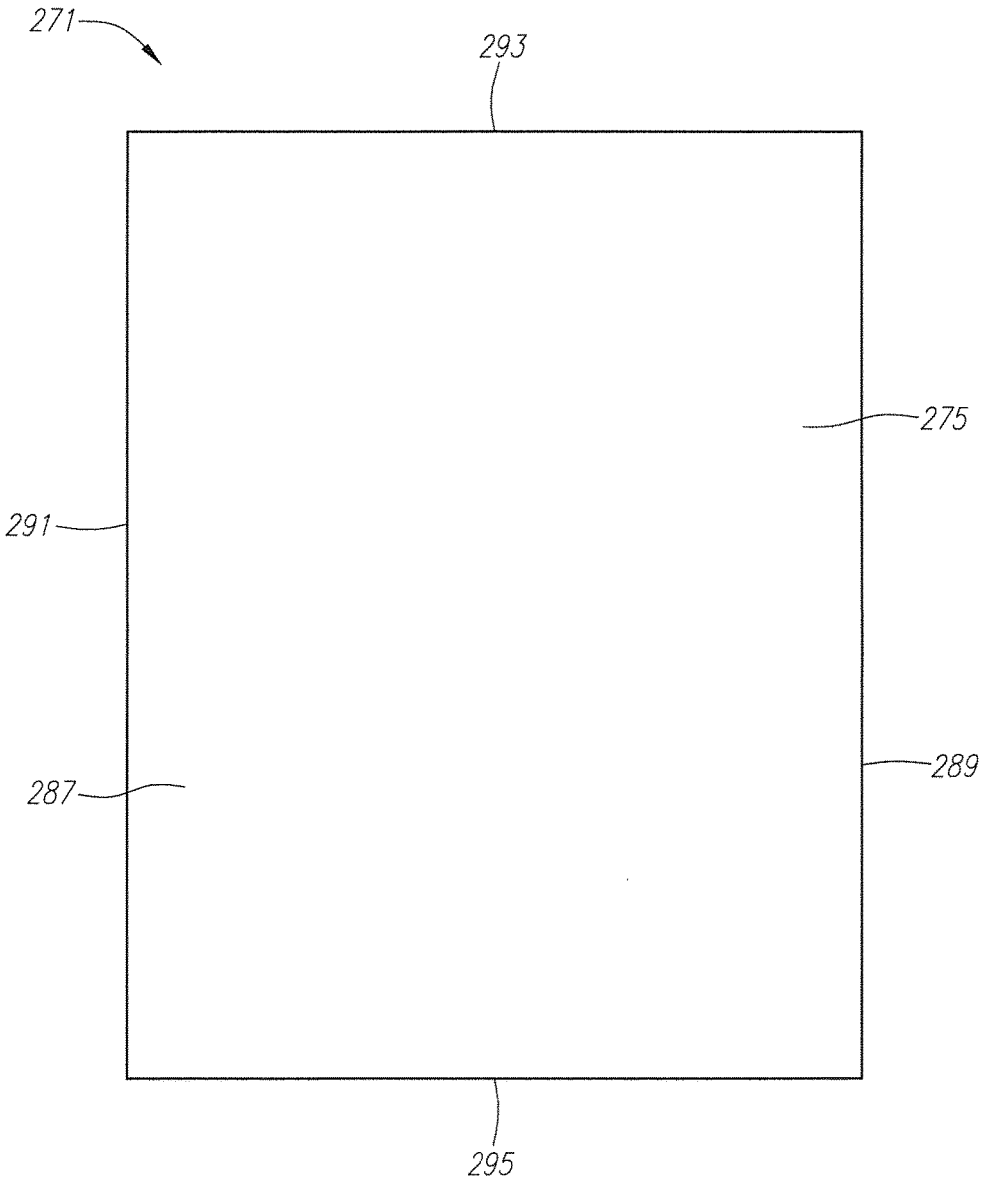
Figure 16C:
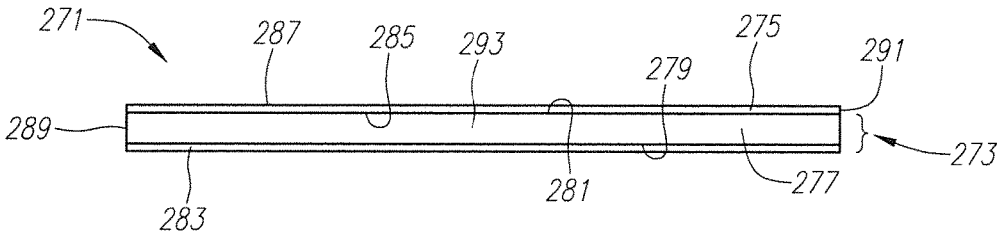
Figure 16D:
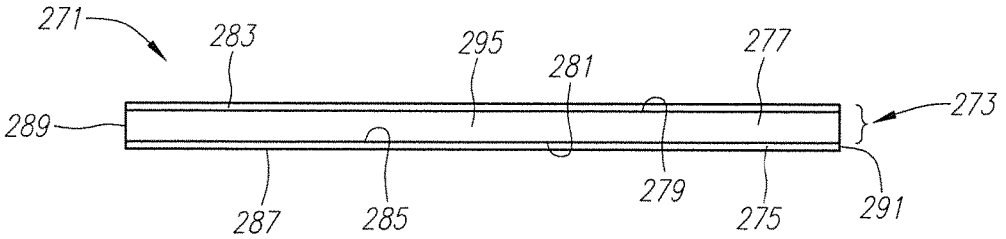
Figure 16E:
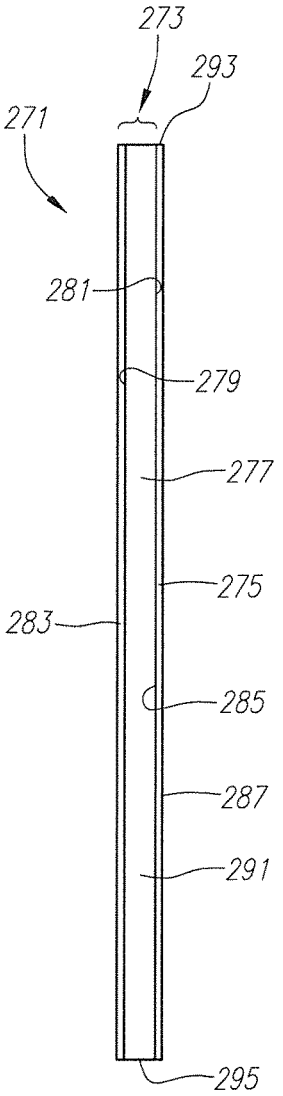
Figure 16F:
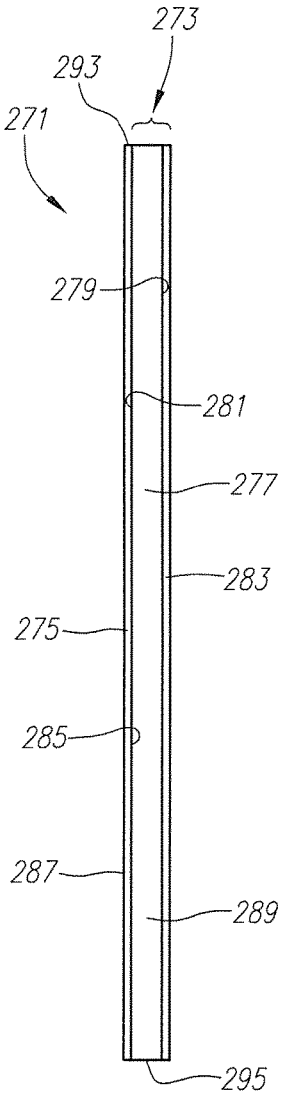

A partial section view of a second alternate embodiment to sheet construction 251 is shown in FIG. 14 as sheet construction 266. Sheet construction 266, which includes compressed regions 267-1 and 267-2 compressed from opposite surfaces 268-1 and 268-2, respectively, of sheet construction 266, can be formed by modifying apparatus 151 of FIG. 6 by replacing compressing station 177 with a compressing station 269, which is shown in FIG. 15. Compressing station 269 can include a pair of scoring rollers 270-1 and 270-2 which are aligned with one another to produce the symmetric pattern of compressed regions 267-1 and 267-2 shown in FIG. 14.

Figure 17:
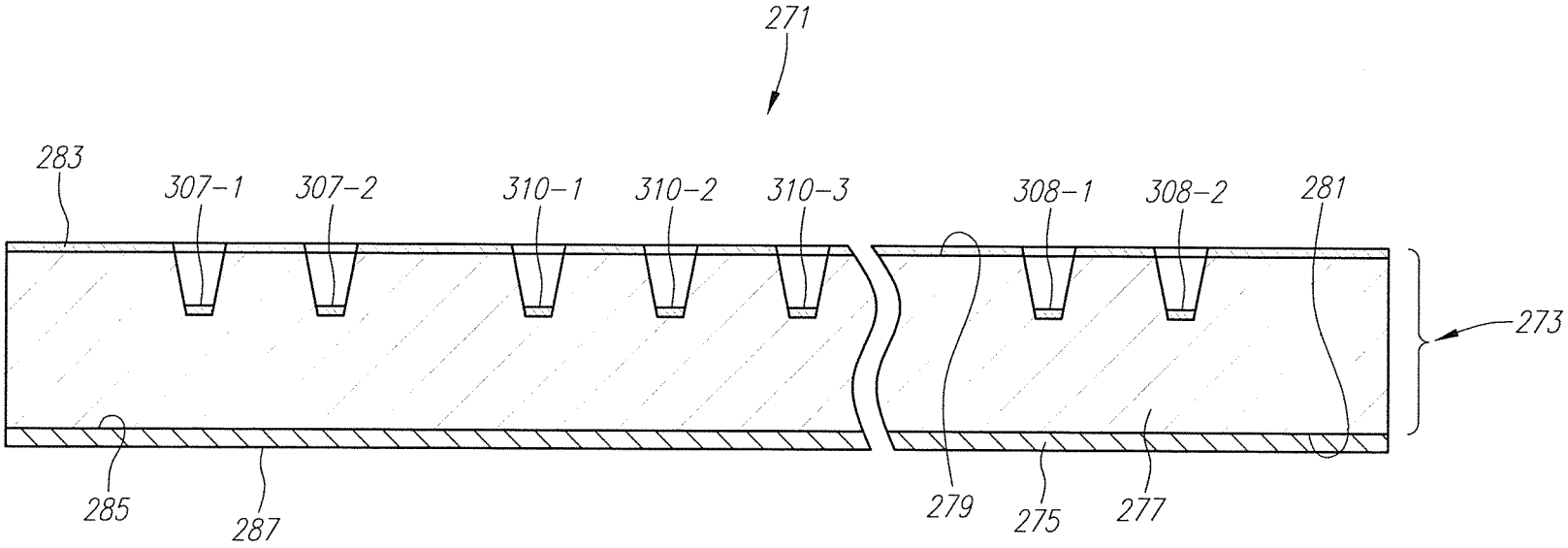
FIG. 17 is an enlarged fragmentary section view of the sheet construction of FIG. 16(*a*) taken along line 17'-17'.

Referring now to FIGS. 16(*a*) through 16(*f*), as well as FIG. 17, there are shown various views of a fifth embodiment of a sheet construction according to the present invention, the sheet construction being represented generally by reference numeral 271.

Sheet construction 271, which can be similar in many respects to sheet construction 11, can include a first material 273 and a second material 275. First material 273 can include a substrate 277 having a first major surface 279 and an opposed second major surface 281. Substrate 277 can consist of a single layer or can include a multi-layer construction. Examples of single layer materials that can be used as substrate 277 can include certain paper materials and certain polymer films. Examples of such paper materials can include a sheet of cardstock, such as a sheet of 70-pound cardstock, and a sheet of label stock. Examples of such polymer films can include an oriented polyolefin film, a polyester film, and a polyurethane film. Examples of multilayer constructions can include, for example, coated papers, laminated papers, coated polymer films, laminated polymer films, and combinations thereof.

First material 273 can further include a print-receptive coating 283 disposed directly on first major surface 279 of substrate 277. Print-receptive coating 283 can be any one or more print-receptive materials known to those skilled in the art for use in receiving markings made by hand or by a printing device. For example, where one wishes to make dry-erase markings on first material 273, print-receptive coating 283 can include a conventional dry-erase film, such as a polyethylene terephthalate (PET) film, a polypropylene film, or the like. Additional examples of materials suitable for use as print-receptive coating 283 can be found in previously incorporated U.S. Patent Application Publication No. US 2003/0148056 A1 in connection with the discussion therein of top material 130.

Second material 275, which can be identical in construction and composition to second material 15 of sheet construction 11, can be shaped to include a first major surface 285 and an opposed second major surface 287. Second material 275 can be joined directly to first material 273, with first major surface 285 of second material 275 fixed to and in direct contact with second major surface 281 of substrate 277. First material 273 and second material 275 can be coextensive so that the entirety of second major surface 281 of substrate 277 can be covered by first major surface 285 of second material 275 and so that the entirety of first major surface 285 of second material 275 can be covered by second major surface 281 of substrate 277. In this manner, first material 273 and second material 275 can jointly form a generally rectangular sheet-like structure including a first longitudinal edge 289, a second longitudinal edge 291, a leading edge 293, and a trailing edge 295, with print-receptive coating 283 of first material 273 forming a first exposed surface for the structure and with second major surface 287 of second material 275 forming an opposed second exposed surface for the structure.

Second material 275 can be applied directly to first material 273, for example, by extrusion. Second major surface 287 of second material 275 can be roughened, for example, in the manner described in previously incorporated U.S. Patent Application Publication No. US 2003/0148056 A1, so that print-receptive coating 283 of first material 273 and second major surface 287 of second material 275 can have similar haptic properties, i.e., feel similar to the touch. In addition, the receptivity of second major surface 287 of second material 275 to markings of the type that can be made manually and/or with a printing device can be improved by such roughening.

First material 273 and second material 275 can have a combined thickness of at least about 4 mils and, more specifically, can have a combined thickness of about 4 mils to about 14 mils, or about 4 mils to about 7 mils in the case of the sheet construction including label stock, or about 8 mils to about 14 mils in the case of the sheet construction including card stock.

Sheet construction 271 can further include a plurality of lines for defining one or more smaller-size print-receptive media. Such defining lines can be, for example, die-cut lines, partial die-cut lines, perforated lines including microperforated lines, lines of cuts and ties, etched lines, and lines made by other techniques known in the art. As exemplified by the present embodiment, the aforementioned defining lines can include three parallel longitudinally-extending lines 297-1 through 297-3, and six parallel laterally-extending lines 299-1 through 299-6. Longitudinally-extending lines 297-1 through 297-3 and laterally-extending lines 299-1 through 299-6, which can extend partially or completely through first material 273 and also partially but not completely through second material 275, can be arranged to define an array of ten print-receptive media 301-1 through 301-10 and a frame 302 surrounding print-receptive media 301-1 through 301-10. Frame 302 can include (i) a leading margin 303 extending from first longitudinal edge 289 to second longitudinal edge 291 and bounded by first longitudinal edge 289, second longitudinal edge 291, leading edge 293, and laterally-extending line 299-1, (ii) a trailing margin 304 extending from first longitudinal edge 289 to second longitudinal edge 291 and bounded by first longitudinal edge 289, second longitudinal edge 291, trailing edge 295, and laterally-extending line 299-6, (iii) a first side margin 305 bounded by first longitudinal edge 289, longitudinally-extending line 297-1, leading margin 303, and trailing margin 304, and (iv) a second side margin 306 bounded by second longitudinal edge 291, longitudinally-extending line 297-3, leading margin 303, and trailing margin 304.

Longitudinally-extending lines 297-1 through 297-3 and laterally-extending lines 299-1 through 299-6 can be formed in the same manner as, and can be shaped and dimensioned similarly to, longitudinally-extending lines 31-1 through 31-3 and laterally-extending lines 33-1 through 33-6, respectively, of sheet construction 11.

It should be understood that the number of longitudinally-extending lines 297-1 through 297-3, the number of laterally-extending lines 299-1 through 299-6, and the arrangement of longitudinally-extending lines 297-1 through 297-3 and laterally-extending lines 299-1 through 299-6 in the present embodiment are merely exemplary; consequently, the numbers of longitudinally-extending lines 297-1 through 297-3 and laterally-extending lines 299-1 through 299-6 can be increased or decreased and their arrangement can be modified.

Sheet construction 271 can further include two leading compressed regions 307-1 and 307-2 disposed within leading margin 303, two trailing compressed regions 308-1 and 308-2 disposed within trailing margin 304, seventy-nine side compressed regions 309-1 through 309-79 disposed within first side margin 305, and seventy-nine side compressed regions 310-1 through 310-79 disposed within second side margin 306. The arrangement and dimensions of leading compressed regions 307-1 and 307-2, trailing compressed regions 308-1 and 308-2, and side compressed regions 309-1 through 309-79 and 310-1 through 310-79 can be similar to those of leading compressed regions 51-1 and 51-2, trailing compressed regions 53-1 and 53-2, and side compressed regions 55-1 through 55-79 and 57-1 through 57-79, respectively, of sheet construction 11 or to those of leading compressed regions 253-1 and 253-2, trailing compressed regions 255-1 and 255-2, and side compressed regions 257-1 through 257-79 and 259-1 through 259-79, respectively, of sheet construction 251.

It should be understood that the number and arrangement of leading compressed regions 307-1 and 307-2, trailing compressed regions 308-1 and 308-2, and side compressed regions 309-1 through 309-79 and 310-1 through 310-79 in sheet construction 271 is merely exemplary; consequently, the number of leading compressed regions 307-1 and 308-1, trailing compressed regions 308-1 and 308-2, and side compressed regions 309-1 through 309-79 and 310-1 through 310-79 in sheet construction 271 can be increased or decreased, and the dimensions and placement of leading compressed regions 307-1 and 308-1, trailing compressed regions 308-1 and 308-2, and side compressed regions 309-1 through 309-79 and 310-1 through 310-79 can be modified. Notwithstanding the above, it is believed that sheet construction 271 can include, for example, from twenty-six to one hundred twenty compression regions in one or both of first side margin 305 and second side margin 306 and can include, for example, from one to four compressed regions in one or both of leading margin 303 and trailing margin 304.

Sheet construction 271 can be made and used similarly to sheet construction 11.

Figure 18:
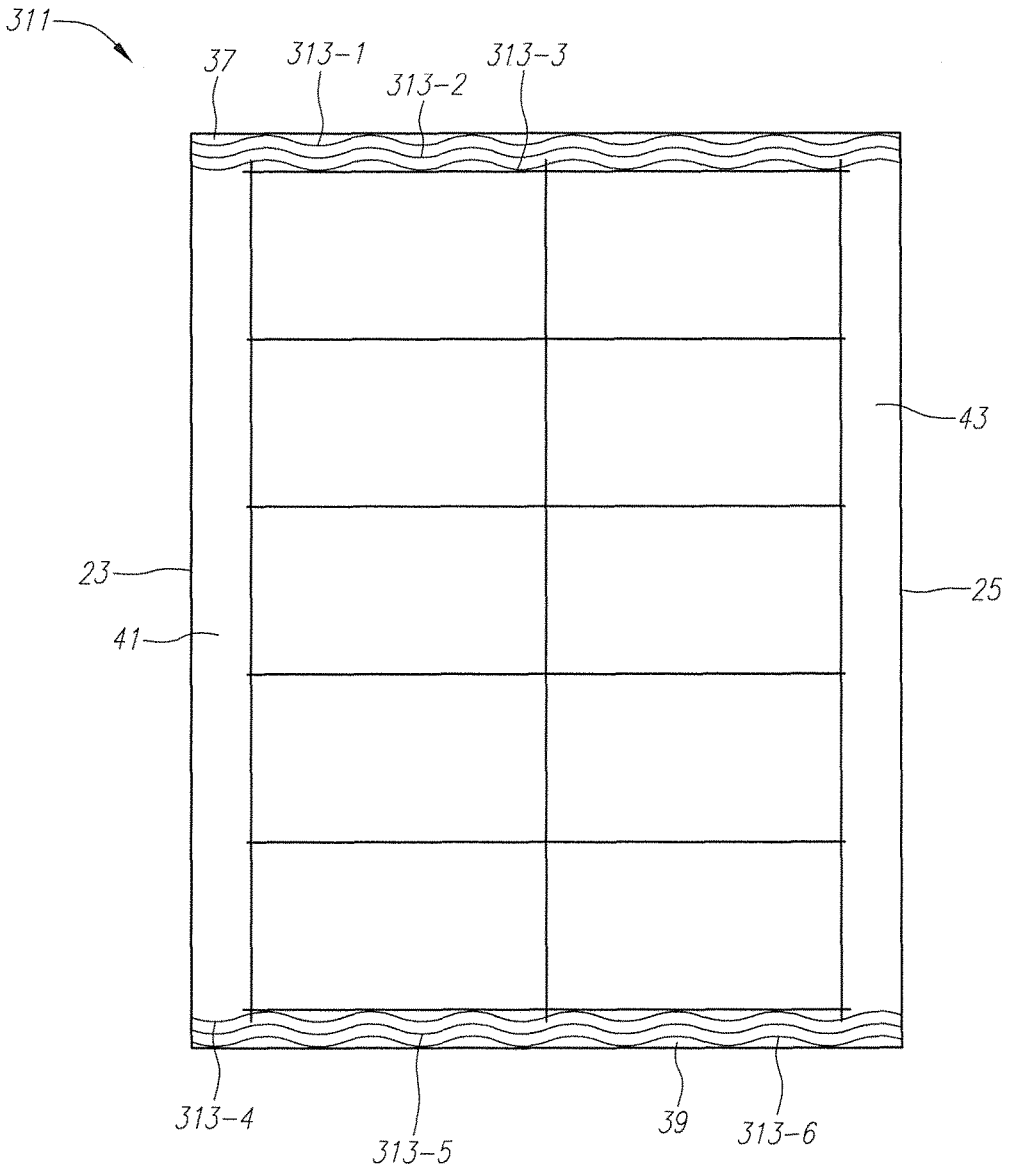
FIG. 18 is a front view of a sixth embodiment of a sheet construction according to the present invention.

Referring now to FIG. 18, there is a front view of a sixth embodiment of a sheet construction according to the present invention, the sheet construction being represented generally by reference numeral 311.

Sheet construction 311 can be similar in most respects to sheet construction 11. One difference between the two sheet constructions can be that, whereas sheet construction 11 can include leading compressed regions 51-1 and 51-2 in leading margin 37 that can have a generally straight profile and can also include trailing compressed regions 53-1 and 53-2 in trailing margin 39 that can have a generally straight profile, sheet construction 311 can include leading compressed regions 313-1 through 313-3 in leading margin 37 that can have a generally arcuate or wavy profile and can also include trailing compressed regions 313-4 through 313-6 in trailing margin 39 that can have a generally arcuate or wavy profile. Leading compressed regions 313-1 through 313-3 and trailing compressed regions 313-4 through 313-6 can also differ from leading compressed regions 51-1 and 51-2 and trailing compressed regions 53-1 and 53-2 in that leading compressed regions 313-1 through 313-3 and trailing compressed regions 313-4 through 313-6 can extend between longitudinal edges 23 and 25 whereas leading compressed regions 51-1 and 51-2 and trailing compressed regions 53-1 and 53-2 can be spaced from longitudinal edges 23 and 25. Alternatively, leading compressed regions 313-1 through 313-3 and trailing compressed regions 313-4 through 313-6 can be spaced from longitudinal edges 23 and 25 similarly to leading compressed regions 51-1 and 51-2 and trailing compressed regions 53-1 and 53-2. Leading compressed regions 313-1 through 313-3 and trailing compressed regions 313-4 through 313-6 can form corresponding protrusions on the rear of sheet construction 311, similar to those of sheet construction 251; alternatively, leading compressed regions 313-1 through 313-3 and trailing compressed regions 313-4 through 313-6 can be devoid of any such corresponding protrusions, similar to sheet construction 11.

Sheet construction 311 can also differ from sheet construction 11 in that, whereas sheet construction 11 can include side compressed regions 55-1 through 55-79 and 57-1 through 57-59, sheet construction 311 can omit such compressed regions.

Sheet construction 311 can be made and used analogously to sheet construction 11.

Figure 19:
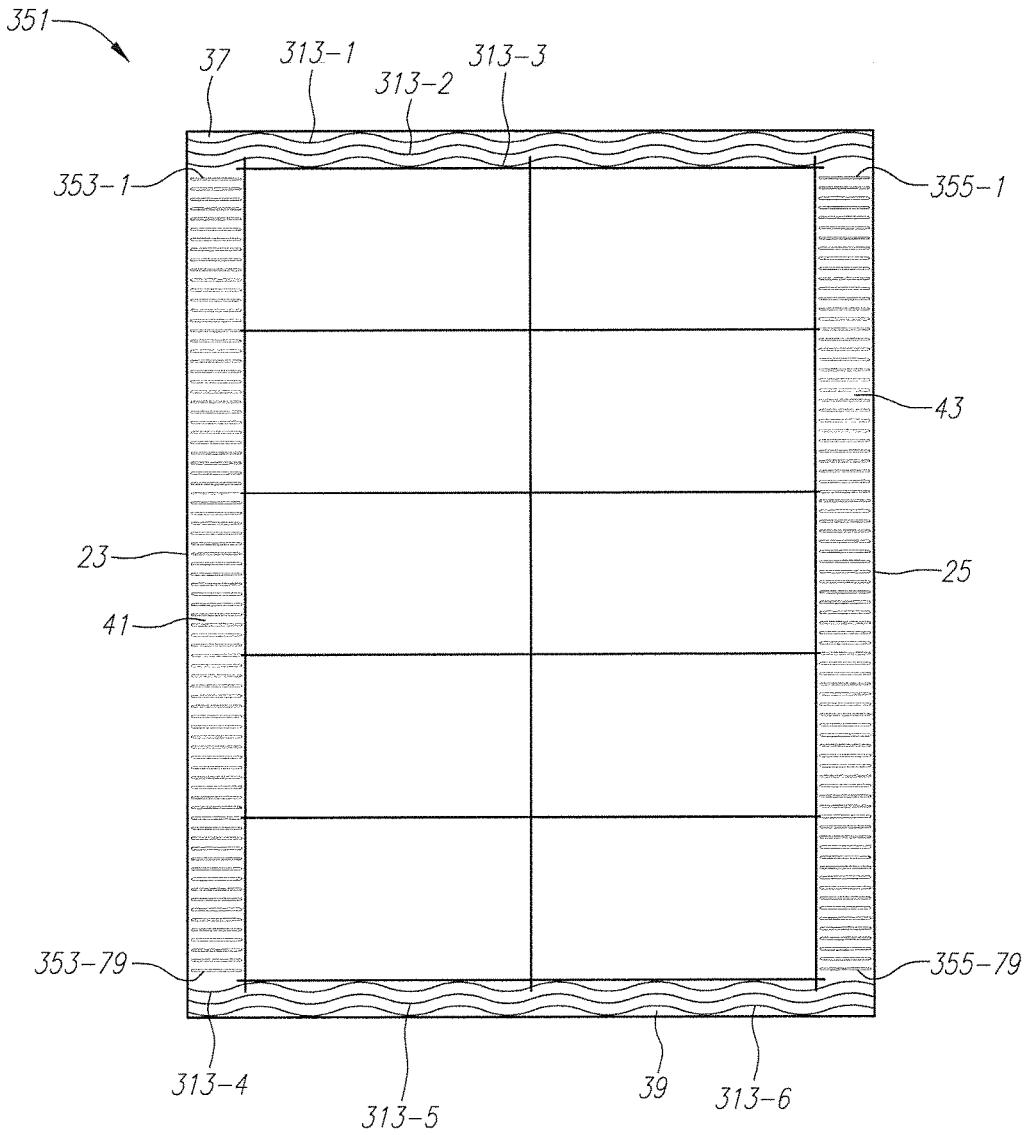
FIG. 19 is a front view of a seventh embodiment of a sheet construction according to the present invention.
Figure 20A:
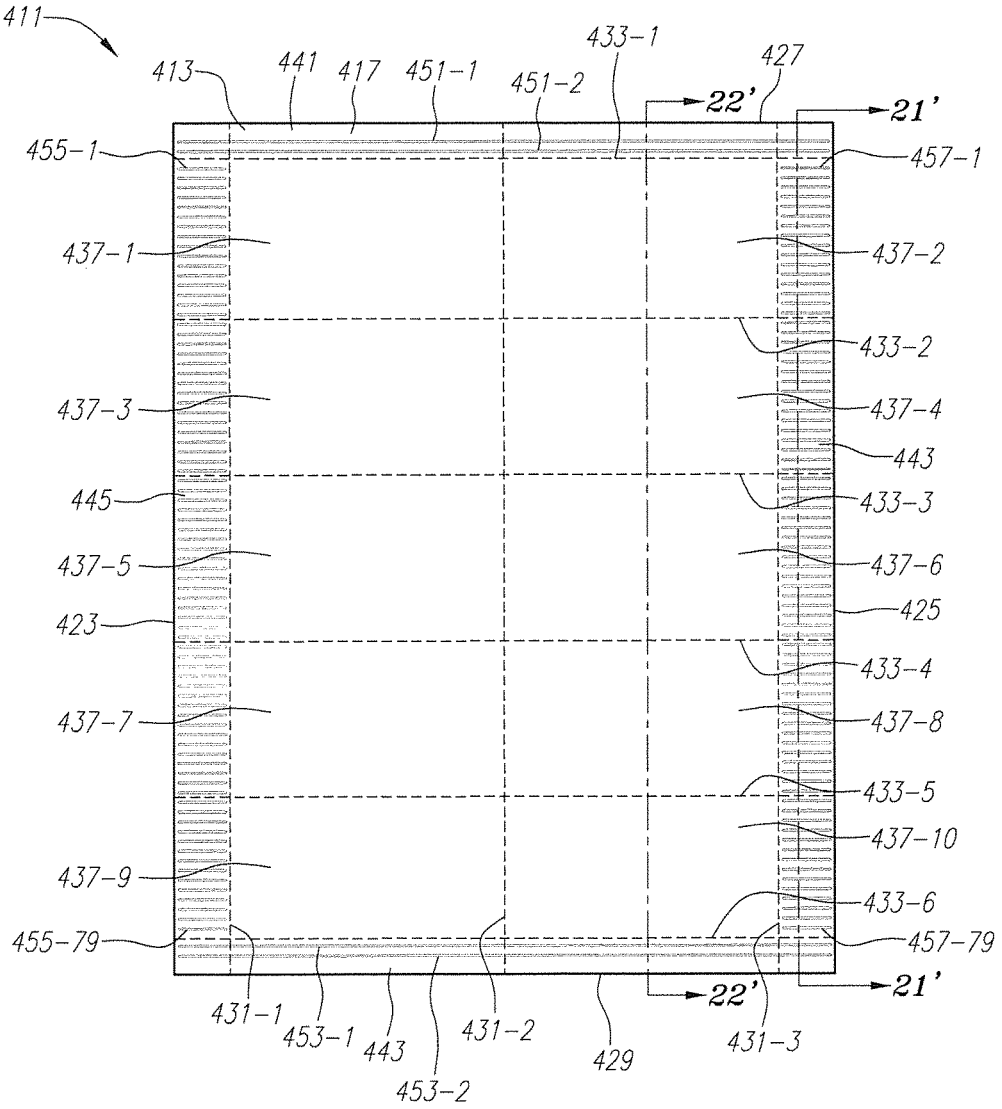
FIGS. 20(*a*), 20(*b*), 20(*c*), 20(*d*), 20(*e*), and 20(*f*) are front plan, rear plan, top elevation, bottom elevation, left-side elevation, and right-side elevation views, respectively, of an eighth embodiment of a sheet construction according to the present invention.
Figure 20B:
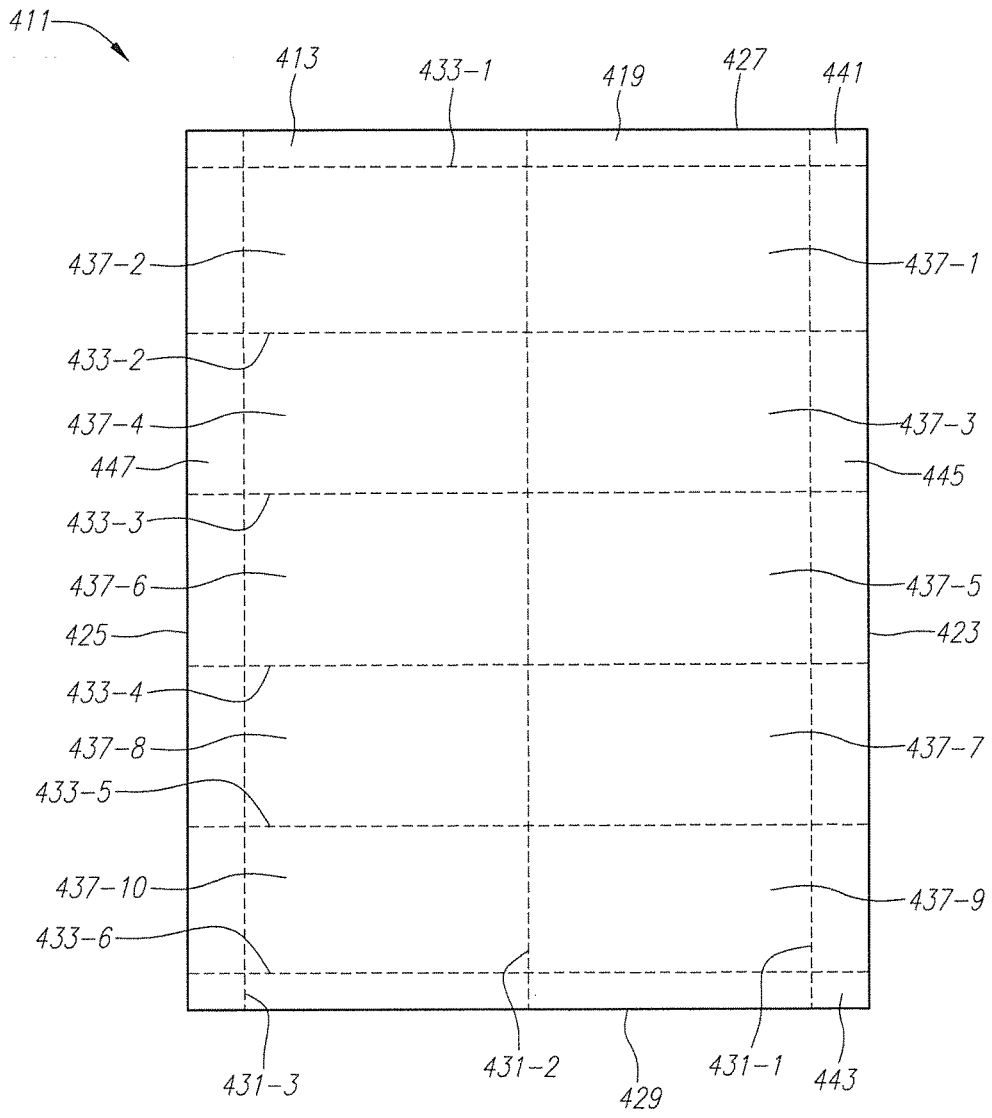
Figure 20C:
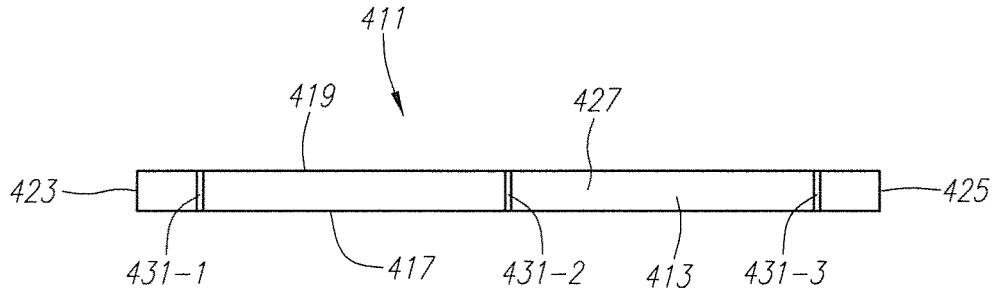
Figure 20D:
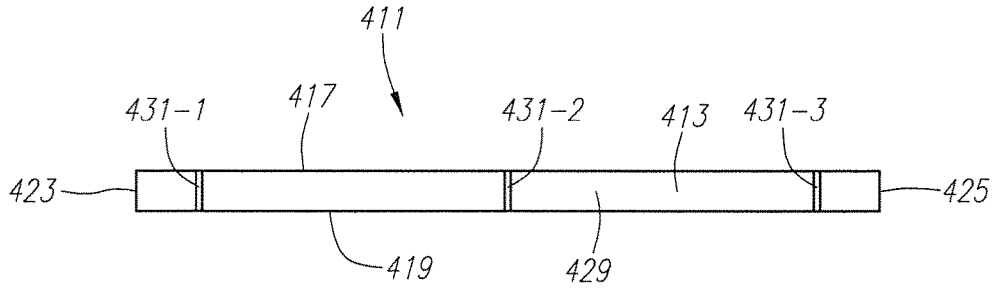
Figure 20E:
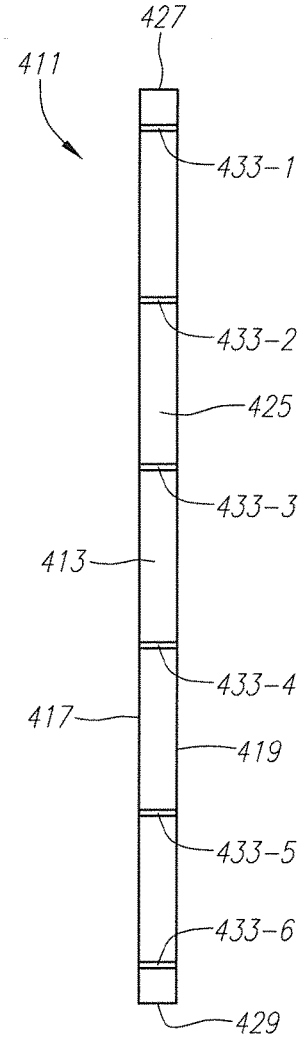
Figure 20F:
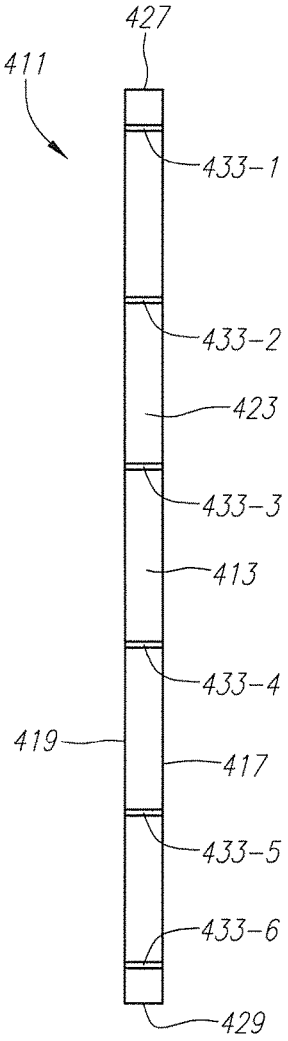

Referring now to FIG. 19, there is a front view of a seventh embodiment of a sheet construction according to the present invention, the sheet construction being represented generally by reference numeral 351.

Sheet construction 351 can be similar in most respects to sheet construction 311. One difference between the two sheet constructions can be that, whereas sheet construction 311 can omit compressed regions in side margins 41 and 43, sheet construction 351 can include side compressed regions 353-1 through 353-79 in first side margin 41 and can include side compressed regions 355-1 through 355-79 in second side margin 43. Side compressed regions 353-1 through 353-79 and 355-1 through 355-79 can be similar to side compressed regions 55-1 through 55-79 and 57-1 through 57-79, respectively, of sheet construction 11 or can be similar to side compressed regions 257-1 through 257-79 and 259-1 through 259-79, respectively, of sheet construction 251. Moreover, although each of side compressed regions 353-1 through 353-79 and 355-1 through 355-79 is shown as being straight, some or all of side compressed regions 353-1 through 353-79 and 355-1 through 355-79 can be arcuate or wavy.

Sheet construction 351 can be made and used analogously to sheet construction 311.

Figure 21:
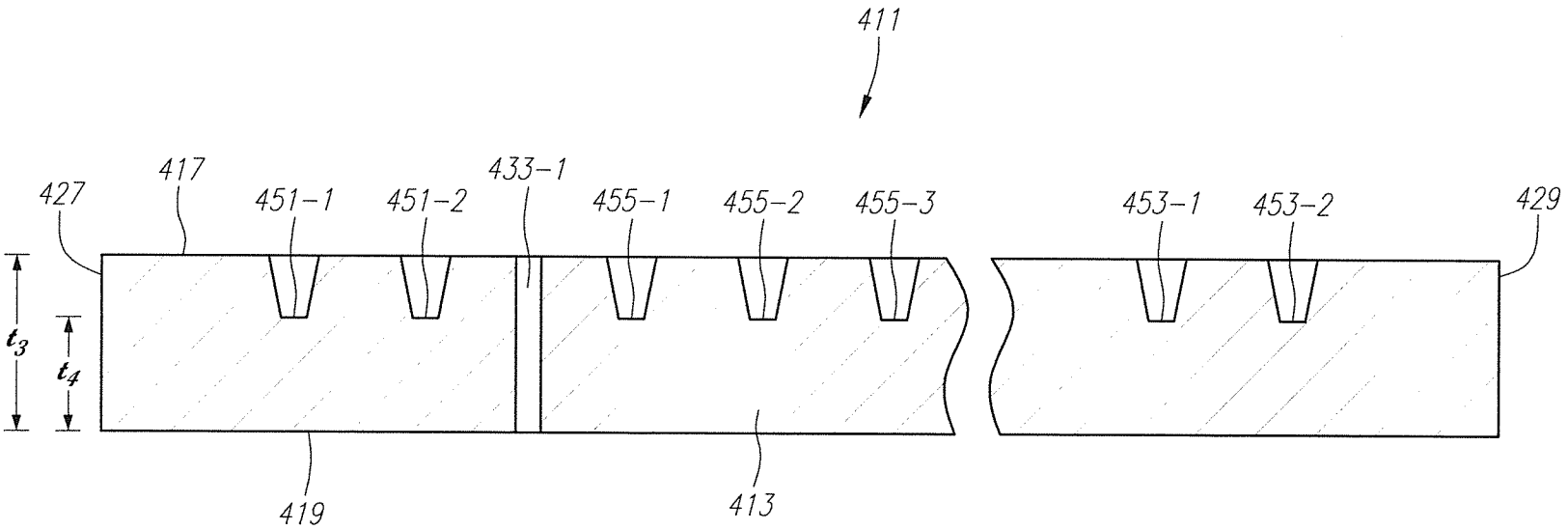
FIG. 21 is an enlarged fragmentary section view of the sheet construction of FIG. 20(*a*) taken along line 21'-21'.
Figure 22:
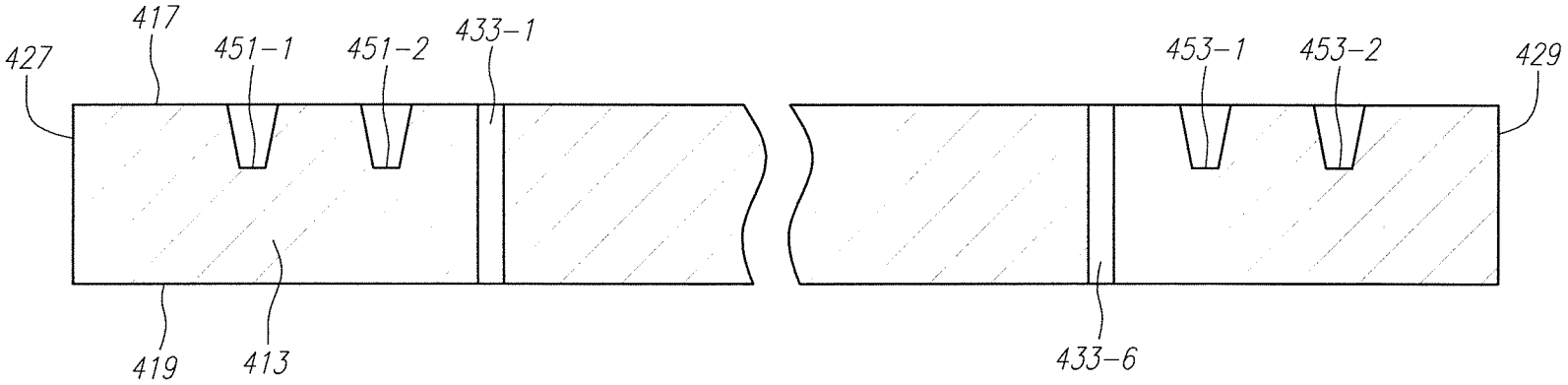
FIG. 22 is an enlarged fragmentary section view of the sheet construction of FIG. 20(*a*) taken along line 22'-22'.

Referring now to FIGS. 20(*a*) through 20(*f*), as well as FIGS. 21 and 22, there are shown various views of a eighth embodiment of a sheet construction made according to the present invention, the sheet construction being represented generally by reference numeral 411.

Sheet construction 411 can include a sheet of material 413. Material 413 can be a generally rectangular sheet-like structure of a standard paper size (e.g., letter-size, legal-size, A4, etc.) and can be shaped to include a first major surface 417, an opposed second major surface 419, a first longitudinal edge 423, a second longitudinal edge 425, a leading edge 427, and a trailing edge 429. One or both of first major surface 417 and second major surface 419 can be receptive to markings of the type that can be made manually and/or with a printing device. Examples of markings of the type that can be made manually include, but are not limited to, hand-drawn pencil markings, hand-drawn pen markings, hand-drawn crayon markings, hand-drawn paint markings, hand-drawn dry-erase markings, hand-drawn chalk markings, hand-made stampings, including hand-made hot stampings, hand-made heat-transfers, and other hand-made markings known to those skilled in the art, as well as combinations thereof. Examples of markings of the type that can be made with a printing device include, but are not limited to, ink jet printer markings, laser printer markings, photocopier markings, and combinations thereof.

Material 413 can consist of a single layer or can include a multi-layer construction. Examples of single layer materials that can be used as material 413 can include certain paper materials and certain polymer films. Examples of such paper materials can include a sheet of cardstock, such as a sheet of 70-pound cardstock, and a sheet of label stock. Examples of such polymer films can include a film of an oriented polyolefin, a polyester film, and a polyurethane film. Examples of multi-layer constructions can include, for example, coated papers, laminated papers, coated polymer films, laminated polymer films, and combinations thereof. If material 413 includes a print-receptive material coated on one or both of its major surfaces, such a print-receptive material can be any one or more print-receptive materials known to those skilled in the art. For example, where one wishes to make dry-erase markings on first major surface 417 of material 413, such a print-receptive material can include a conventional dry-erase film, such as a polyethylene terephthalate (PET) film, a polypropylene film, or the like. Additional examples of materials suitable for use as material 413 can be found in previously incorporated U.S. Pat. No. 5,993,928 in connection with the discussion therein of paper 160.

Material 413 can have a thickness of at least about 4 mils and, more specifically, can have a thickness of about 4 mils to about 14 mils, or about 4 mils to about 7 mils in the case of the sheet construction including label stock, or about 8 mils to about 14 mils in the case of the sheet construction including card stock.

Sheet construction 411 can further include a plurality of perforation lines in material 413 for defining one or more smaller-size print-receptive media. As exemplified by the present embodiment, the aforementioned perforation lines can include three lengthwise perforation lines 431-1 through 431-3 extending parallel to first longitudinal edge 423 and second longitudinal edge 425 and six widthwise perforation lines 433-1 through 433-6 extending parallel to leading edge 427 and trailing edge 429. Lengthwise perforation lines 431-1 through 431-3 and widthwise perforation lines 433-1 through 433-6 can together define ten print-receptive media 437-1 through 437-10. A leading margin 441 can be bounded by first longitudinal edge 423, second longitudinal edge 425, leading edge 427, and widthwise perforation line 433-1. A trailing margin 443 can be bounded by first longitudinal edge 423, second longitudinal edge 425, trailing edge 429, and widthwise perforation line 433-6. A first side margin 445 can be bounded by first longitudinal edge 423, longitudinal line 431-1, leading margin 441, and trailing margin 443. A second side margin 447 can be bounded by second longitudinal edge 425, longitudinal line 431-3, leading margin 441, and trailing margin 443.

It is to be understood that, although lines 431-1 through 431-3 and lines 433-1 through 433-6 are shown in the present embodiment as perforation lines, which can include microperforation lines, such lines need not be perforation lines and can alternatively be substantial cut lines, score lines, lines of cuts and ties, or any other type of defining line other than a continuous through-cut line.

It should be understood that the number of lengthwise perforation lines 431-1 through 431-3, the number of widthwise perforation lines 433-1 through 433-6, and the arrangement, including the length and/or width, of lengthwise perforation lines 431-1 through 431-3 and widthwise perforation lines 433-1 through 433-6 in the present embodiment are merely exemplary; consequently, the numbers of lengthwise perforation lines 431-1 through 431-3 and widthwise perforation lines 433-1 through 433-6 can be increased or decreased and their arrangement can be modified. Additionally, the perforations lines can engage the edges of construction 411, as shown, or, in other embodiments, the perforation lines can end before engaging the edges of construction 411.

As can be seen, for example, in FIGS. 21 and 22, sheet construction 411 can further include one or more leading compressed regions 451-1 and 451-2, trailing compressed regions 453-1 and 453-2, and side compressed regions 455-1 through 455-79 and 457-1 through 457-79, i.e., regions in which material 413 is compressed to a reduced thickness. With respect to the aforementioned one or more compressed regions, the thickness of material 413, as measured from first major surface 417 to second major surface 419, can be reduced by about 5% to about 35% from a non-compressed thickness $t_3$ of, for example, about 4 mils to about 14 mils, to a compressed thickness $t_4$ of, for example, about 2.6 mils to about 13.3 mils. The one or more compressed regions can be asymmetrically compressed relative to first major surface 417 and second major surface 419 and, for example, can appear in first major surface 417, either with or without corresponding protrusions in second major surface 419. As viewed from the front of sheet construction 411, the one or more compressed regions can include straight compressed regions (as shown in FIG. 20(*a*)), arcuate compressed regions (as shown in FIG. 18), or a mixture of straight and arcuate regions (as shown in FIG. 19). The one or more compressed regions can be positioned in one or more of leading margin 441, trailing margin 443, first side margin 445, and second side margin 447. In the present embodiment, the one or more compressed regions can include leading compressed regions 451-1 and 451-2 in leading margin 441, trailing compressed regions 453-1 and 453-2 in trailing margin 443, side compressed regions 455-1 through 455-79 in first side margin 445, and side compressed regions 457-1 through 457-79 in second side margin 447. The dimensions and layout of leading compressed regions 451-1 and 451-2, trailing compressed regions 453-1 and 453-2, and side compressed regions 455-1 through 455-79 and 457-1 through 457-79 can be similar to those of leading compressed regions 51-1 and 51-2, trailing compressed regions 53-1 and 53-2, and side compressed regions 55-1 through 55-79 and 57-1 through 57-79, respectively, or can be modified as necessary or desired.

It should be understood that the present embodiment discloses an exemplary number and arrangement of leading compressed regions 451-1 and 451-2, trailing compressed regions 453-1 and 453-2, and side compressed regions 455-1 through 455-79 and 457-1 through 457-79; consequently, the number of leading compressed regions 451-1 and 451-2, trailing compressed regions 453-1 and 453-2, and side compressed regions 455-1 through 455-79 and 457-1 through 457-79 can be increased or decreased, and the dimensions and placement of leading compressed regions 451-1 and 451-2, trailing compressed regions 453-1 and 453-2, and side compressed regions 455-1 through 455-79 and 457-1 through 457-79 can be modified. Notwithstanding the above, it is believed that sheet construction 411 can include, for example, from twenty-six to one hundred twenty compressed regions in one or both of first side margin 445 and second side margin 447 and can include, for example, from one to four compressed regions in one or both of side margin 441 and side margin 443.

Figure 23:
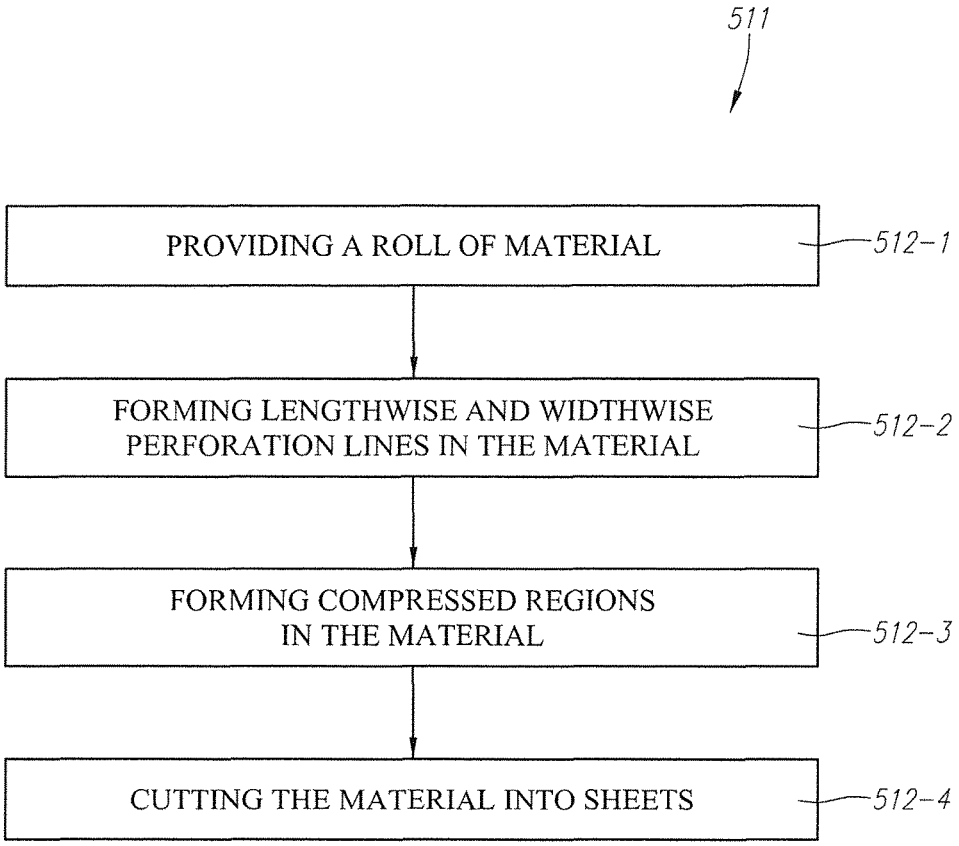
FIG. 23 is a flowchart, schematically depicting one method of making the sheet construction of FIGS. 20(*a*) through 20(*f*)

Referring now to FIG. 23, there is shown a flowchart, schematically depicting one embodiment of a method for making sheet construction 411, the method being represented generally by reference numeral 511. Method 511 can begin in a step 512-1 with the provision of a roll of material 413. As noted above, material 413 can be a single layer or a multilayer structure. Examples of single layer materials that can be used as material 413 can include certain paper materials and certain polymer films. Examples of such paper materials can include a sheet of cardstock, such as a sheet of 70-pound cardstock, and a sheet of label stock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

Method 511 can then continue in a step 512-2 with the formation of lengthwise perforation lines 431-1 through 431-3 and widthwise perforation lines 433-1 through 433-6 in material 413. Method 511 can then continue in a step 512-3 with the formation of leading compressed regions 451-1 and 451-2, trailing compressed regions 453-1 and 453-2, and side compressed regions 455-1 through 455-79 and 457-1 through 457-79 in material 413. The formation of leading compressed regions 451-1 and 451-2, trailing compressed regions 453-1 and 453-2, and side compressed regions 455-1 through 455-79 and 457-1 through 457-79 can be performed by pressing a scoring roller having protrusions that are complementary in shape to the compressed regions one wishes to create against first major surface 417 of material 413. It should be understood that, although step 512-2 is described above as taking place before step 512-3, the order of these two steps could be reversed. Method 511 can then conclude in a step 512-4 with the cutting of the perforated and compressed roll into sheets, preferably of standard paper size.

Figure 24:
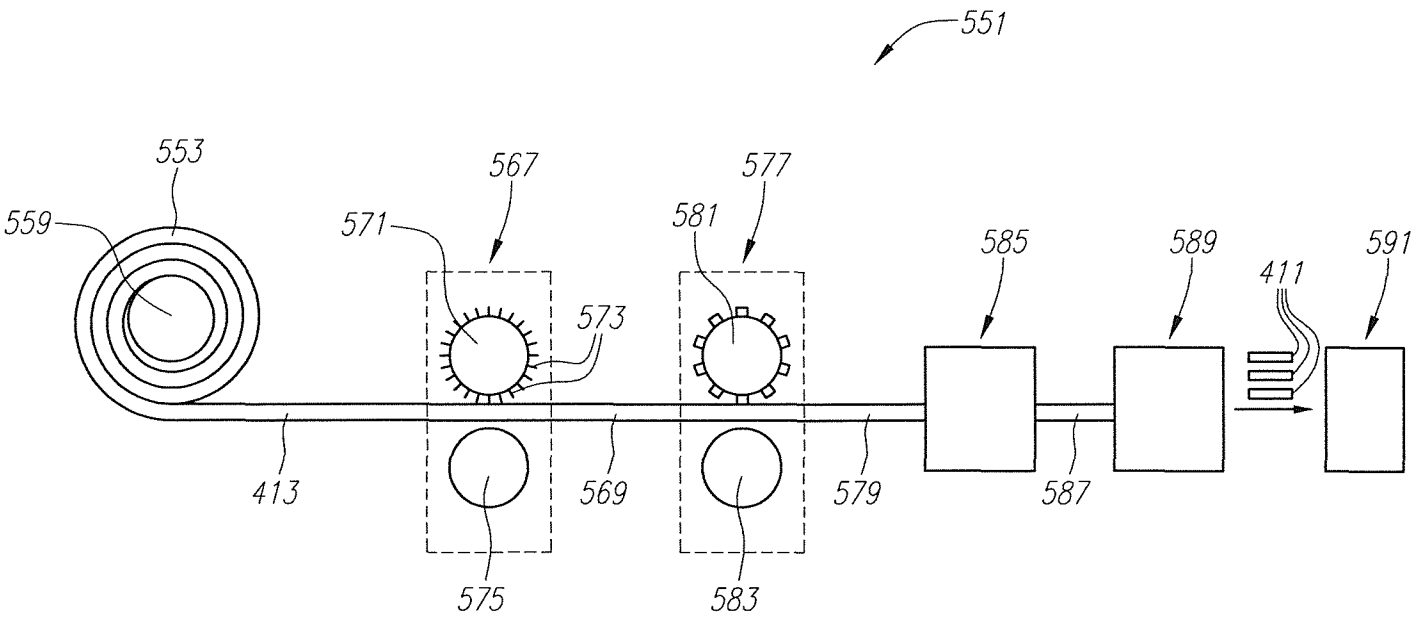
FIG. 24 is a simplified schematic view of one embodiment of an apparatus that can be used to make the sheet construction of FIGS. 20(*a*) through 20(*f*)

Referring now to FIG. 24, there is schematically shown an apparatus that can be used to make sheet construction 411, the apparatus being represented by reference numeral 551.

Apparatus 551 can include a supply roll 553 of material 413, which supply roll 553 can be unwound from a reel 559. Apparatus 551 can further include a media defining station 567 through which material 413 can be passed so that individual media 437-1 through 437-10 can be defined in material 413, thereby yielding a first modified material 569. Station 567 can include the combination of a cylindrical die 571 having perforating elements 573 arranged on its periphery and a smooth anvil roller 575.

Apparatus 551 can further include a compressing station 577 through which material 569 can be passed so that leading compressed regions 451-1 and 451-2, trailing compressed regions 453-1 and 453-2, and side compressed regions 455-1 through 455-79 and 457-1 through 457-79 can be formed in material 569, thereby yielding a second modified material 579. Station 577 can include the combination of a scoring roller 581 and a smooth anvil roller 583. Apparatus 551 can further include a printing station 585 through which material 579 can be passed so that indicia (e.g., trademarks, instructions, etc.) can be imprinted on one or both major surfaces of material 413, thereby yielding a third modified material 587. Apparatus 551 can further include a sheeting station 589 for cutting material 587 into standard paper-sized sheets, thereby yielding sheet construction 411. Apparatus 551 can further include a packaging station 591 for packaging one or more sheet constructions 411.

Figure 25:
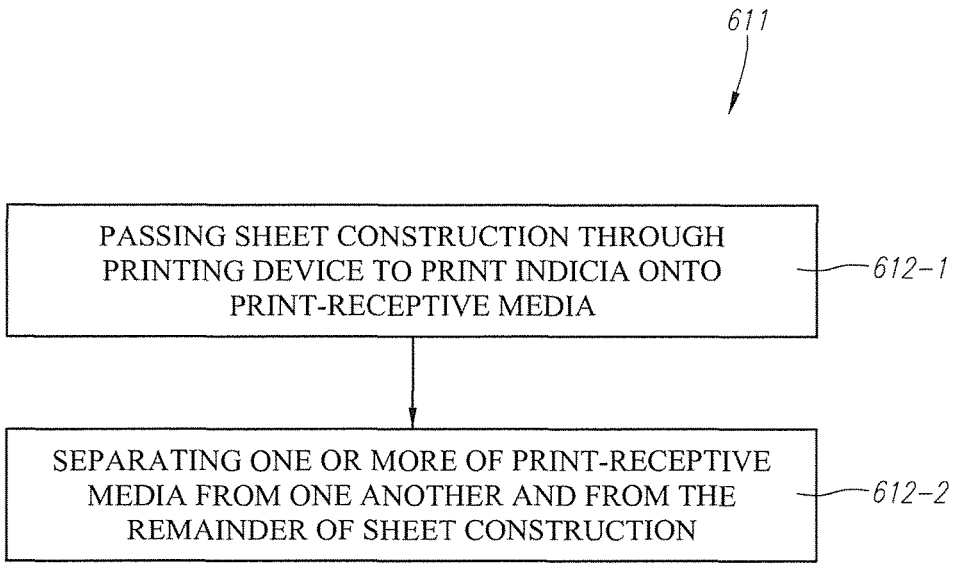
FIG. 25 is a flowchart, schematically depicting one method of using the sheet construction of FIGS. 20(*a*) through 20(*f*)
Figure 26A:
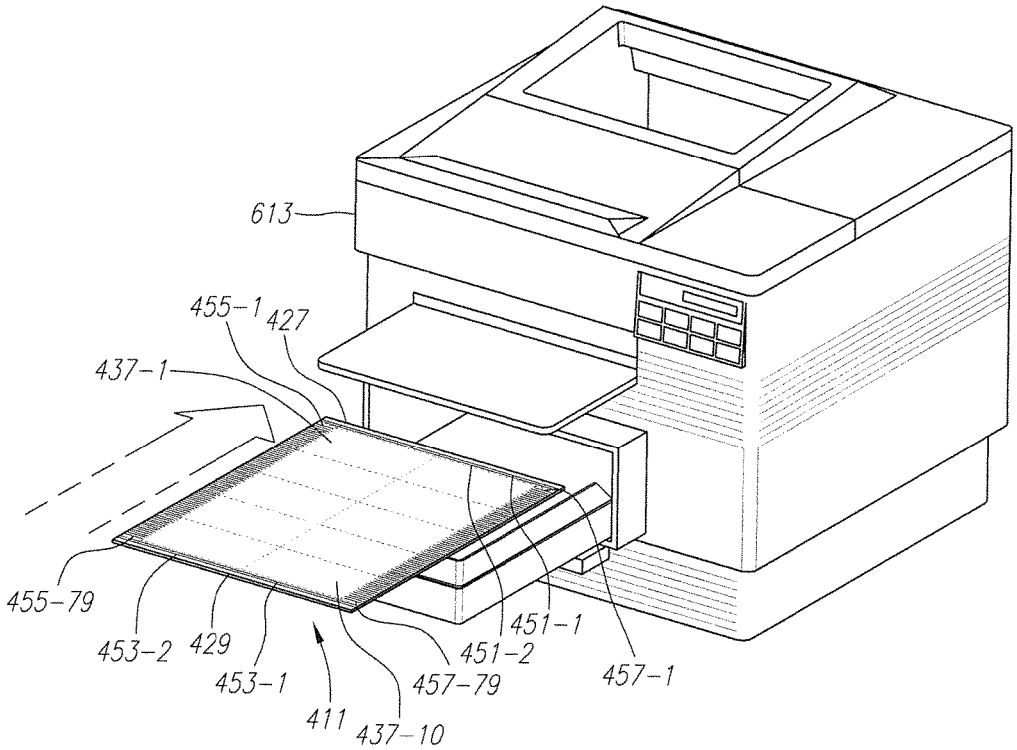
FIGS. 26(*a*) and 26(*b*) are views illustrating the performance of certain steps of the method of FIG. 25.
Figure 26B:
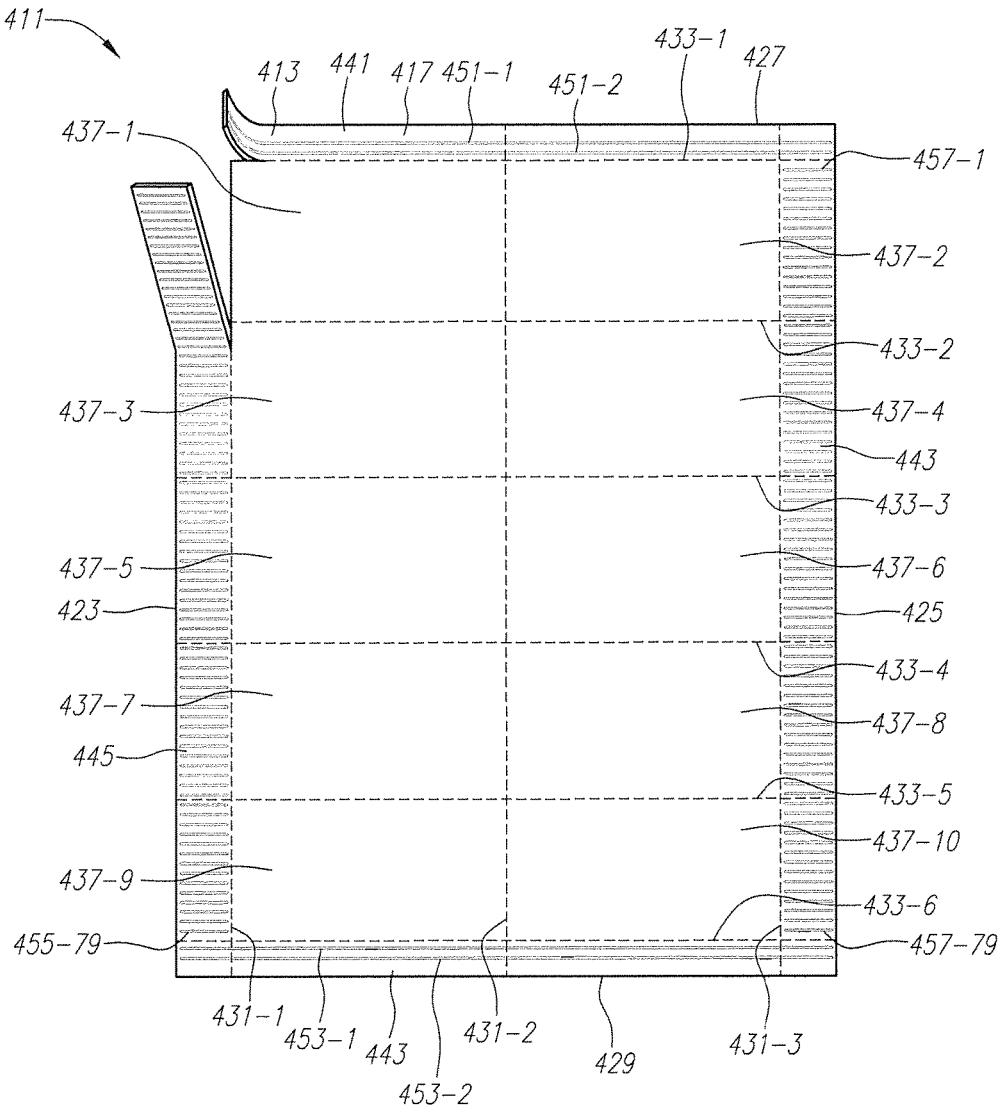
Figure 27A:
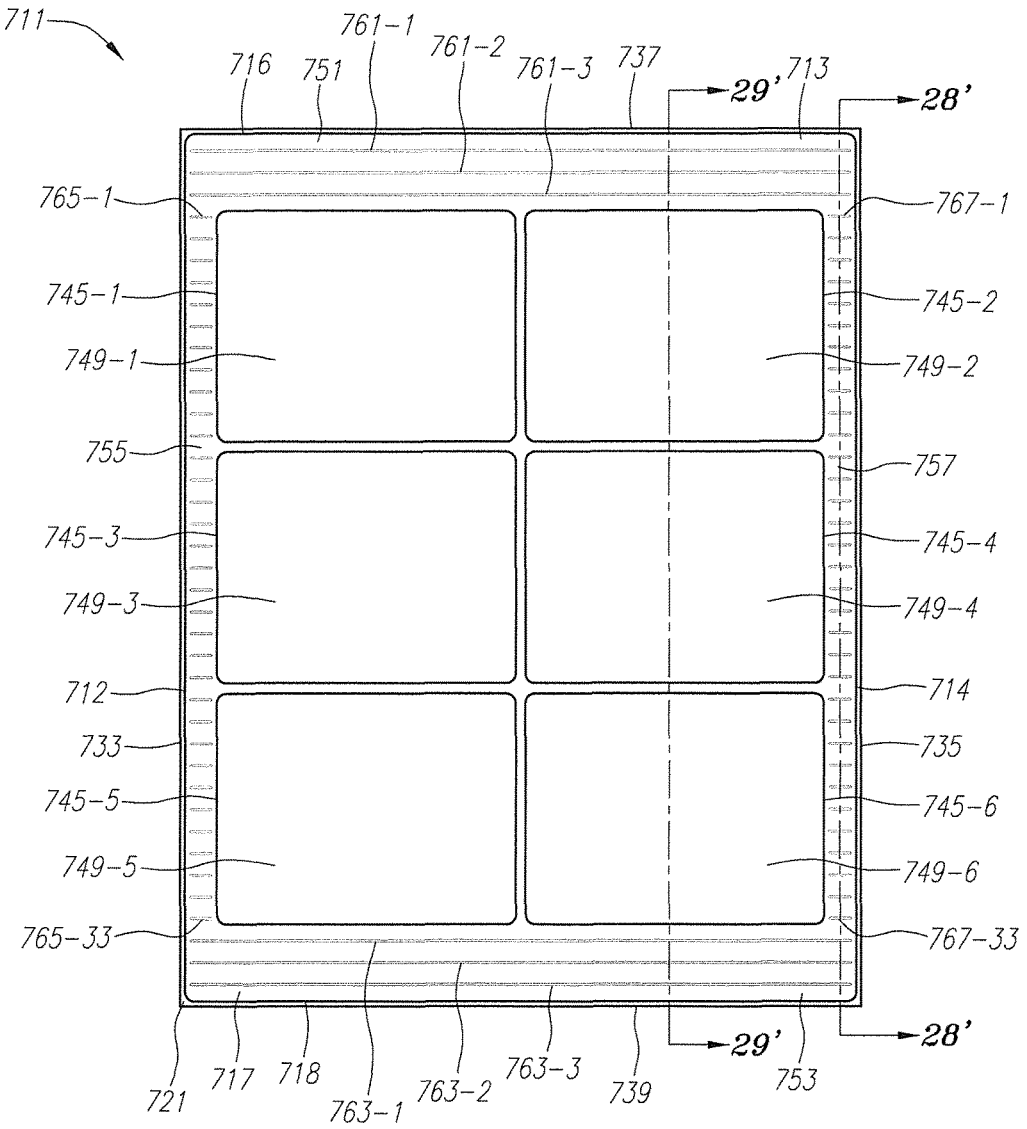
FIGS. 27(*a*), 27(*b*), 27(*c*), 27(*d*), 27(*e*), and 27(*f*) are front plan, rear plan, top elevation, bottom elevation, left-side elevation, and right-side elevation views, respectively, of a ninth embodiment of a sheet construction according to the present invention.
Figure 27B:
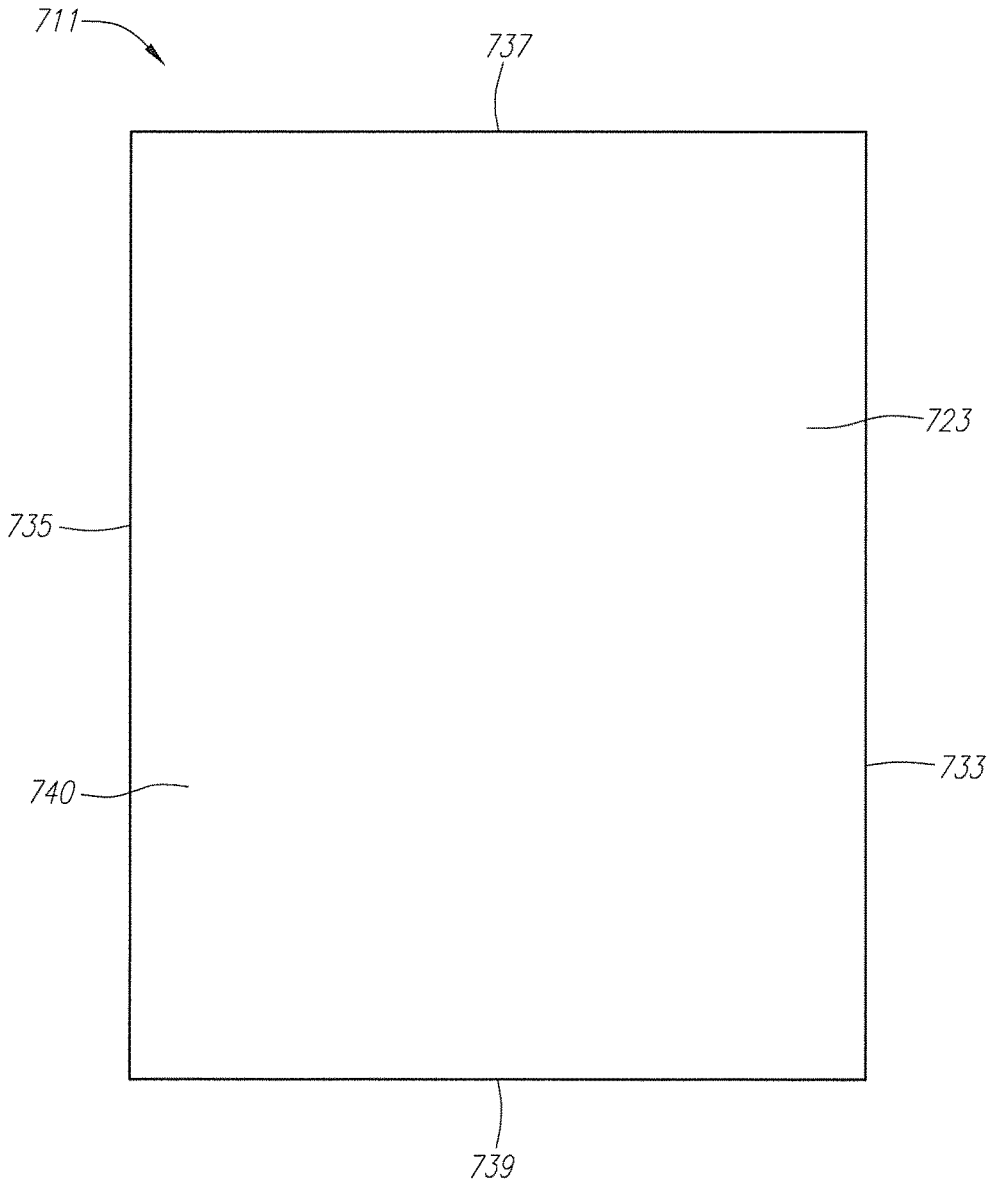
Figure 27C:
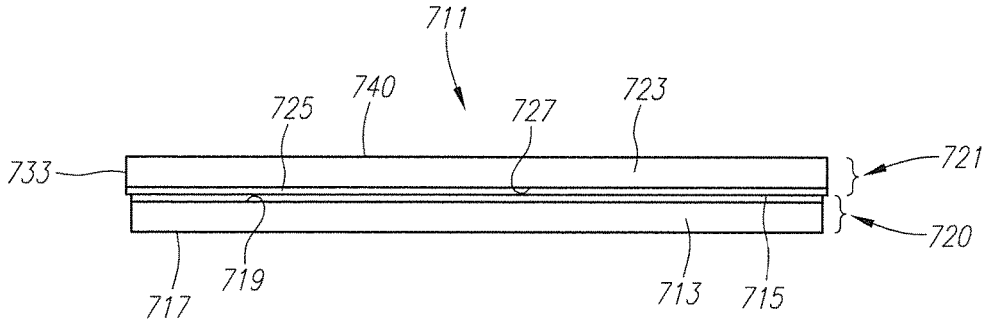
Figure 27D:
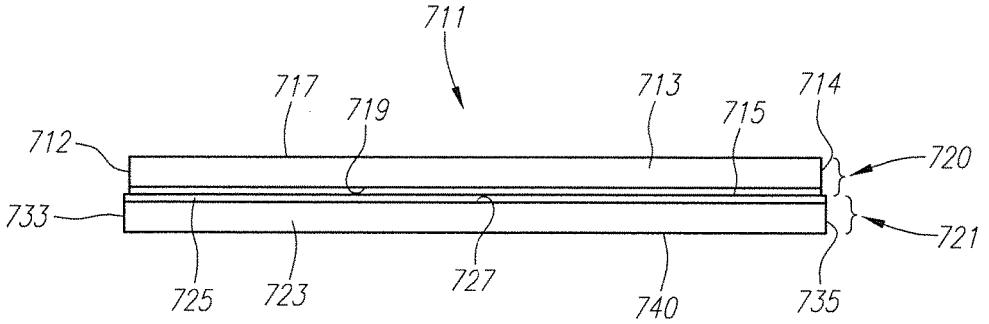
Figure 27E:
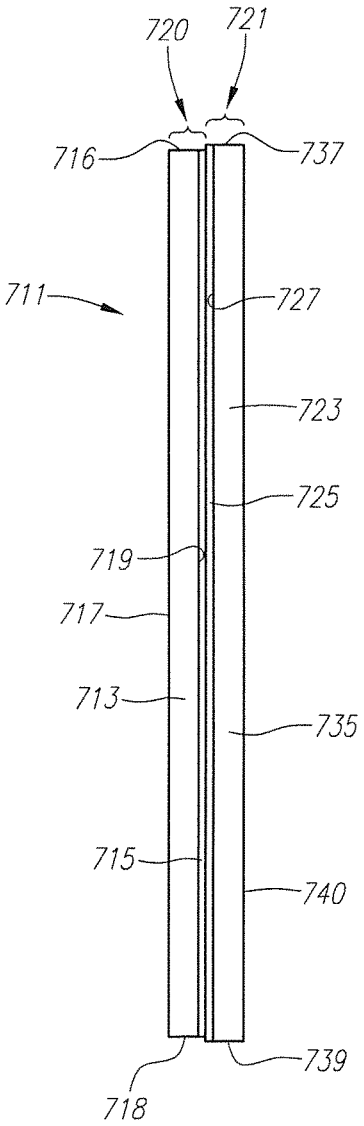
Figure 27F:
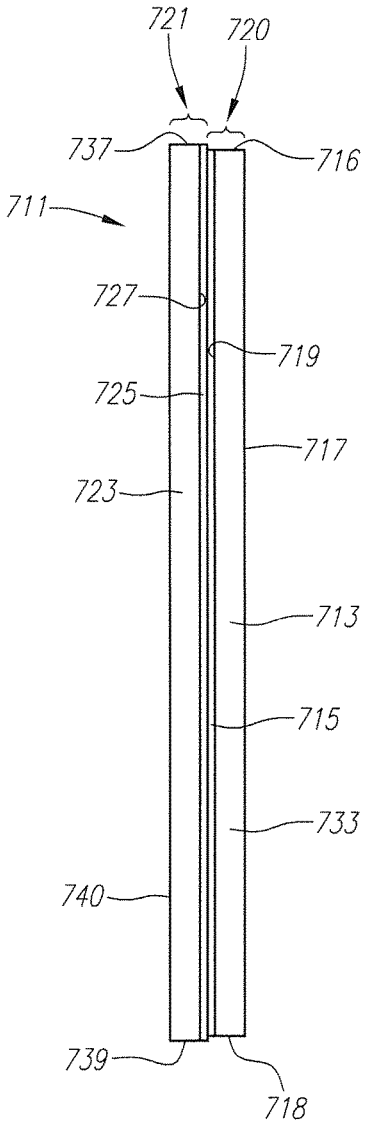

Referring now to FIG. 25, there is shown a flowchart, schematically depicting one embodiment of a method for using sheet construction 411, the method being represented generally by reference numeral 611. Method 611 can begin in a step 612-1 with the passing of sheet construction 411 through a printing device 613 (see also FIG. 26(*a*)), whereby indicia can be printed on one or more of print-receptive media 437-1 through 437-10. Because of the presence of leading compressed regions 451-1 and 451-2, trailing compressed regions 453-1 and 453-2, and side compressed regions 455-1 through 455-79 and 457-1 through 457-79 on sheet construction 411, the occurrence of "start of print off-registration" errors can be reduced. Method 611 can then conclude in a step 612-2 with the separation of one or more of print-receptive media 437-1 through 437-10 from one another and from the remainder of sheet construction 411 (see also FIG. 26(*b*)), one or more of said print-receptive media 437-1 through 437-10 preferably bearing printed indicia thereon. Such separation can be achieved, for example, by tearing sheet construction 411 along one or more appropriate lengthwise perforation lines 431-1 through 431-3 and widthwise perforation lines 433-1 through 433-6.

Figure 28:
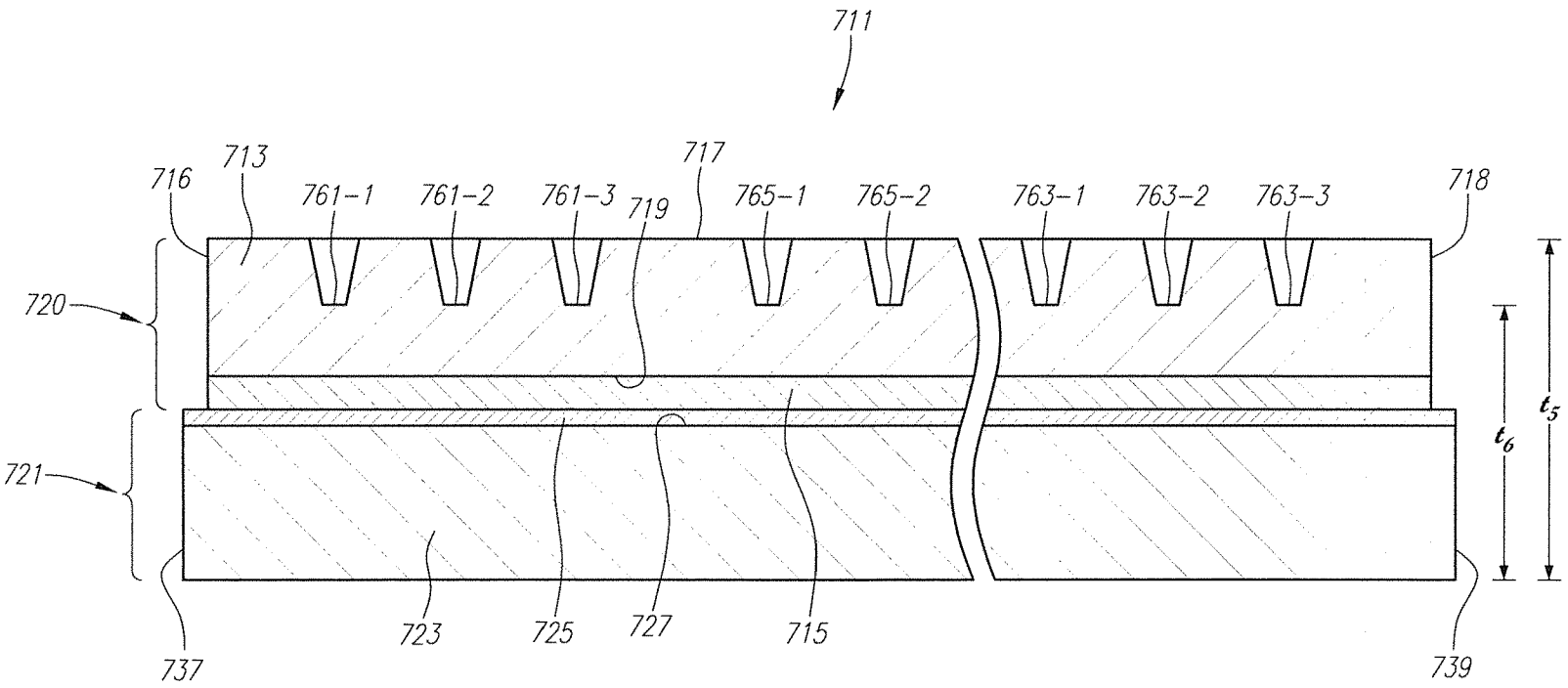
FIG. 28 is an enlarged fragmentary section view of the sheet construction of FIG. 27(*a*) taken along line 28'-28'.
Figure 29:
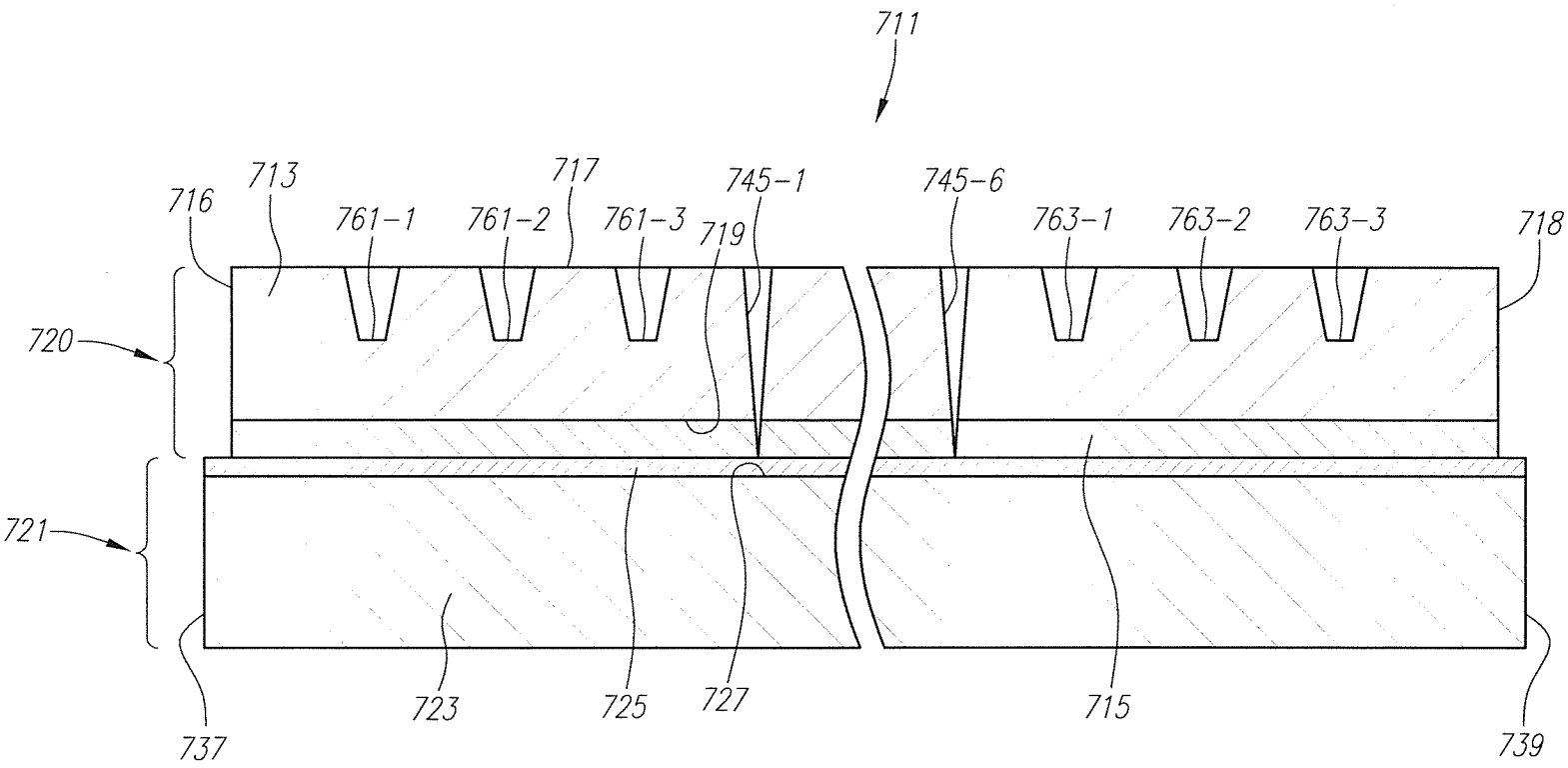
FIG. 29 is an enlarged fragmentary section view of the sheet construction of FIG. 27(*a*) taken along line 29'-29'.

Referring now to FIGS. 27(*a*) through 27(*f*), as well as FIGS. 28 and 29, there are shown various views of a ninth embodiment of a sheet construction made according to the present invention, the sheet construction being represented generally by reference numeral 711.

Sheet construction 711 can include a first material 713 and a second material 715. First material 713 can be a generally rectangular sheet-like structure of a standard paper size (e.g., letter-size, legal-size, A4, etc.) and can be shaped to include a first major surface 717 and an opposed second major surface 719. First major surface 717 can be receptive to markings of the type that can be made manually and/or with a printing device. Examples of markings of the type that can be made manually include, but are not limited to, hand-drawn pencil markings, hand-drawn pen markings, hand-drawn crayon markings, hand-drawn paint markings, hand-drawn dry-erase markings, hand-drawn chalk markings, hand-made stampings, including hand-made hot stampings, hand-made heat-transfers, and other hand-made markings known to those skilled in the art, as well as combinations thereof. Examples of markings of the type that can be made with a printing device include, but are not limited to, ink jet printer markings, laser printer markings, photocopier markings, and combinations thereof.

First material 713 can consist of a single layer or can include a multi-layer construction. Examples of single layer materials that can be used as material 713 can include certain paper materials and certain polymer films. Examples of such paper materials can include a sheet of adhesive label facestock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

Second material 715 can be a pressure-sensitive adhesive applied to second major surface 719 of first material 713. In one embodiment, second material 715 can be applied to the entirety of second major surface 719 of first material 713 so as to form a continuous coating thereon. In another embodiment, second material 715 can be pattern-coated onto predetermined portions of second major surface 719. The combination of first material 713 and second material 715 can comprise an adhesive assembly 720, which can be used as an adhesive-backed label. Depending on the particular intended use of adhesive assembly 720, a suitable adhesive can be selected for use as second material 715. Examples of adhesives that can be suitable can include pressure-sensitive adhesives, such as permanent adhesives, removable adhesives, ultraremovable adhesives, hot-melt adhesives, acrylic adhesives, and rubber-based adhesives. Suitable pressure-sensitive adhesives can include, for example, S-490 adhesive from Avery Dennison Corporation (Pasadena, Calif.) and AT-1 adhesive from Avery Dennison Corporation (Pasadena, Calif.). Adhesive assembly 720 can be a generally rectangular sheet-like structure including a first longitudinal edge 712, a second longitudinal edge 714, a leading edge 716, and a trailing edge 718.

Sheet construction 711 can further include a third material 721. Third material 721 can include a carrier 723, which can be, for example, a sheet of paper, and can also include a release coating 725, which can be, for example, a silicone-based release coating applied to a first major surface 727 of carrier 723. Second material 715 can be positioned in direct contact with release coating 725. Third material 721 can be slightly oversized relative to adhesive assembly 720 so that first longitudinal edge 712, second longitudinal edge 714, leading edge 716, and trailing edge 718 of adhesive assembly 720 are spaced slightly inwardly of a first longitudinal edge 733, a second longitudinal edge 735, a leading edge 737, and a trailing edge 739, respectively, of third material 721. For example, first longitudinal edge 712 of adhesive assembly 720 can be spaced inwardly relative to first longitudinal edge 733 of third material 721 by about 0.094 inch, second longitudinal edge 714 of adhesive assembly 720 can be spaced inwardly relative to second longitudinal edge 735 of third material 721 by about 0.094 inch, leading edge 716 of adhesive assembly 720 can be spaced inwardly relative to leading edge 737 of third material 721 by about 0.04 inch, and trailing edge 718 of adhesive assembly 720 can be spaced inwardly relative to trailing edge 739 of third material 721 by about 0.04 inch.

Sheet construction 711 can further include a plurality of lines defining one or more smaller-size print-receptive media. Such defining lines can be, for example, die-cut lines, partial die-cut lines, perforated lines including microperforated lines, lines of cuts and ties, etched lines, and lines made by other techniques known in the art. As exemplified by the present embodiment, the aforementioned defining lines can include six circumscribing lines 745-1 through 745-6 defining six generally rectangular print-receptive media 749-1 through 749-6, respectively, each in the form of an adhesive-backed label. A leading margin 751 in adhesive assembly 720 can extend from first longitudinal edge 712 to second longitudinal edge 714 and can be bounded by first longitudinal edge 712, second longitudinal edge 714, leading edge 716, and print-receptive media 749-1 and 749-2. A trailing margin 753 in adhesive assembly 720 can extend from first longitudinal edge 712 to second longitudinal edge 714 and can be bounded by first longitudinal edge 712, second longitudinal edge 714, trailing edge 718, and print-receptive media 749-5 and 749-6. A first side margin 755 in adhesive assembly 720 can be bounded by first longitudinal edge 712, leading margin 751, trailing margin 753, and print-receptive media 749-1, 749-3, and 749-5. A second side margin 757 in adhesive assembly 720 can be bounded by second longitudinal edge 714, leading margin 751, trailing margin 753, and print-receptive media 749-2, 749-4, and 749-6.

Circumscribing lines 741-1 through 741-6 can be formed, for example, by die-cutting or rotary knives and can extend entirely through adhesive assembly 720 but in some embodiments do not extend through third material 721.

It should be understood that the number, size, shape, and arrangement of print-receptive media 749-1 through 749-6 in the present embodiment are merely exemplary; consequently, the number of print-receptive media 749-1 through 749-6 can be increased or decreased, and the size, shape, and arrangement of print-receptive media 749-1 through 749-6 can be modified. For example, sheet construction 711 can be modified to include as few as one print-receptive medium or as many as eighty print-receptive media.

Sheet construction 711 can further include one or more leading compressed regions 761-1, 761-2, and 761-3, trailing compressed regions 763-1, 763-2, and 763-3, and side compressed regions 765-1 through 765-33 and 767-1 through 767-33, i.e., regions in which sheet construction 711 is compressed to a reduced thickness. As seen, for example, in FIG. 28, with respect to the aforementioned one or more compressed regions, the thickness of sheet construction 711 can be reduced by about 5% to about 35% from a non-compressed thickness $t_5$ of, for example, about 4 mils to about 14 mils, to a compressed thickness $t_6$ of, for example, about 2.6 mils to about 13.3 mils. The one or more compressed regions can be asymmetrically compressed relative to first major surface 717 of first material 713 and second major surface 740 of carrier 723 and, for example, can appear in first major surface 717, either with or without corresponding protrusions in second major surface 740 of carrier 723.

As viewed from the front of sheet construction 711, the one or more compressed regions can include straight compressed regions (as shown in FIG. 27(*a*)), arcuate compressed regions (as shown in FIG. 18), or a mixture of straight and arcuate regions (as shown in FIG. 19). The one or more compressed regions can be positioned in one or more of leading margin 751, trailing margin 753, first side margin 755, and second side margin 757. In the present embodiment, the one or more compressed regions can include leading compressed regions 761-1, 761-2, and 761-3 in leading margin 751, trailing compressed regions 763-1, 763-2, and 763-3 in trailing margin 753, side compressed regions 765-1 through 765-33 in first side margin 755, and side compressed regions 767-1 through 767-33 in second side margin 757.

It should be understood that the present embodiment discloses an exemplary number and arrangement of leading compressed regions 761-1, 761-2, and 761-3, trailing compressed regions 763-1, 763-2, and 763-3, and side compressed regions 765-1 through 765-33 and 767-1 through 767-33; consequently, the number of leading compressed regions 761-1, 761-2, and 761-3, trailing compressed regions 763-1, 763-2, and 763-3, and side compressed regions 765-1 through 765-33 and 767-1 through 767-33 can be increased or decreased, and the dimensions and placement of leading compressed regions 761-1, 761-2, and 761-3, trailing compressed regions 763-1, 763-2, and 763-3, and side compressed regions 765-1 through 765-33 and 767-1 through 767-33 can be modified. Notwithstanding the above, it is believed that sheet construction 711 can include, for example, from twenty-six to one hundred twenty compressed regions in one or both of first side margin 755 and second side margin 757 and can include, for example, from one to four compressed regions in one or both of leading margin 751 and trailing margin 753.

Sheet construction 711 can have a thickness of at least about 4 mils and, more specifically, can have a thickness of about 4 mils to about 14 mils, or about 4 mils to about 7 mils in the case of the sheet construction including label stock, or about 8 mils to about 14 mils in the case of the sheet construction including card stock.

Figure 30:
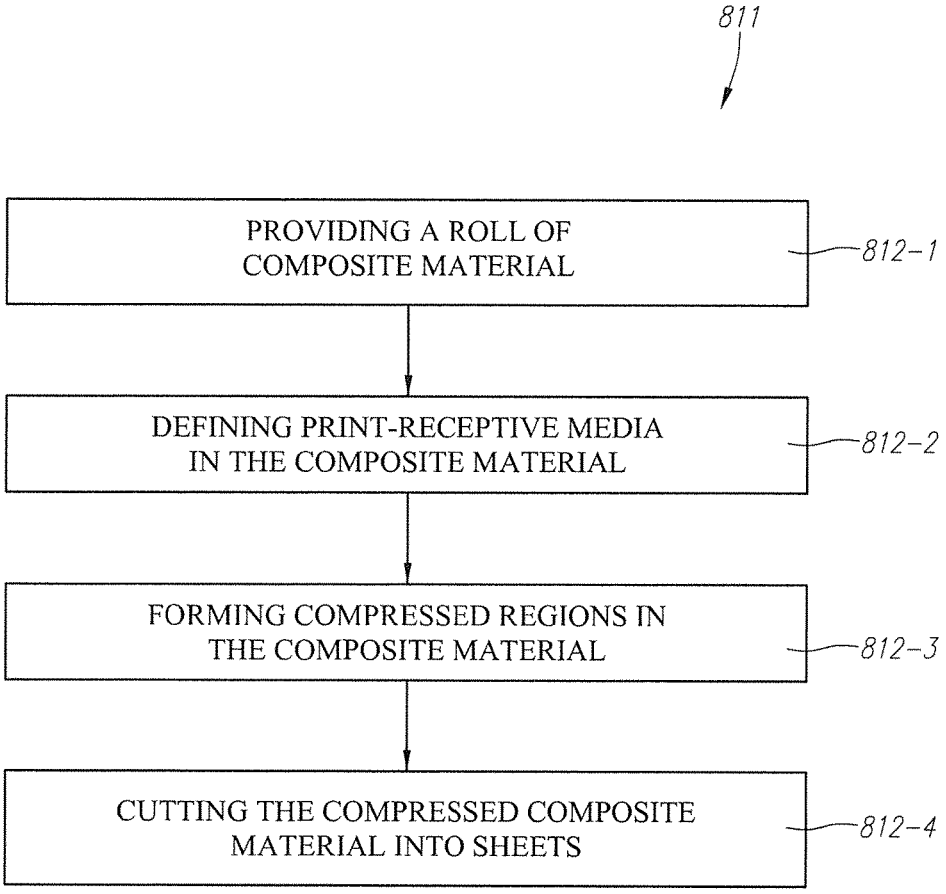
FIG. 30 is a flowchart, schematically depicting one method of making the sheet construction of FIGS. 27(*a*) through 27(*f*)

Referring now to FIG. 30, there is shown a flowchart, schematically depicting one embodiment of a method for making sheet construction 711, the method being represented generally by reference numeral 811. Method 811 can begin in a step 812-1 with the provision of a roll of composite material. The composite material can include, for example, a carrier 723, which can be paper, and a release coating 725, which can be a silicone release, applied to a first major surface 727 of carrier 723. The composite material can further include a second material 715, which can be a pressure-sensitive adhesive, positioned over release coating 725 and over any exposed portions of first major surface 727 of carrier 723. The composite material can further include a first material 713 laminated to second material 715, whereby first material 713 and second material 715 form adhesive assembly 720. As noted above, first material 713 can consist of a single layer or can include a multi-layer construction. Examples of single layer materials that can be used as material 713 can include certain paper materials and certain polymer films. Examples of such paper materials can include a sheet of adhesive label facestock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

Method 811 can then continue in a step 812-2 with the defining of print-receptive media 749-1 through 749-6. Such defining of print-receptive media 749-1 through 749-6 can be effected by cutting circumscribing lines 741-1 through adhesive assembly 720 but not through third material 721. Method 811 can then continue in a step 812-3 with the formation of leading compressed regions 761-1, 761-2, and 761-3, trailing compressed regions 763-1, 763-2, and 763-3, and side compressed regions 765-1 through 765-33 and 767-1 through 767-33 in adhesive assembly 720. The formation of leading compressed regions 761-1, 761-2, and 761-3, trailing compressed regions 763-1, 763-2, and 763-3, and side compressed regions 765-1 through 765-33 and 767-1 through 767-33 can be performed by pressing a scoring roller having protrusions that are complementary in shape to the compressed regions one wishes to create against first major surface 717 of first material 713. It should be understood that, although step 812-2 is described above as taking place before step 812-3, the order of these two steps could be reversed. Method 811 can then conclude in a step 812-4 with the cutting of the compressed roll into sheets, preferably of standard paper size.

Figure 31:
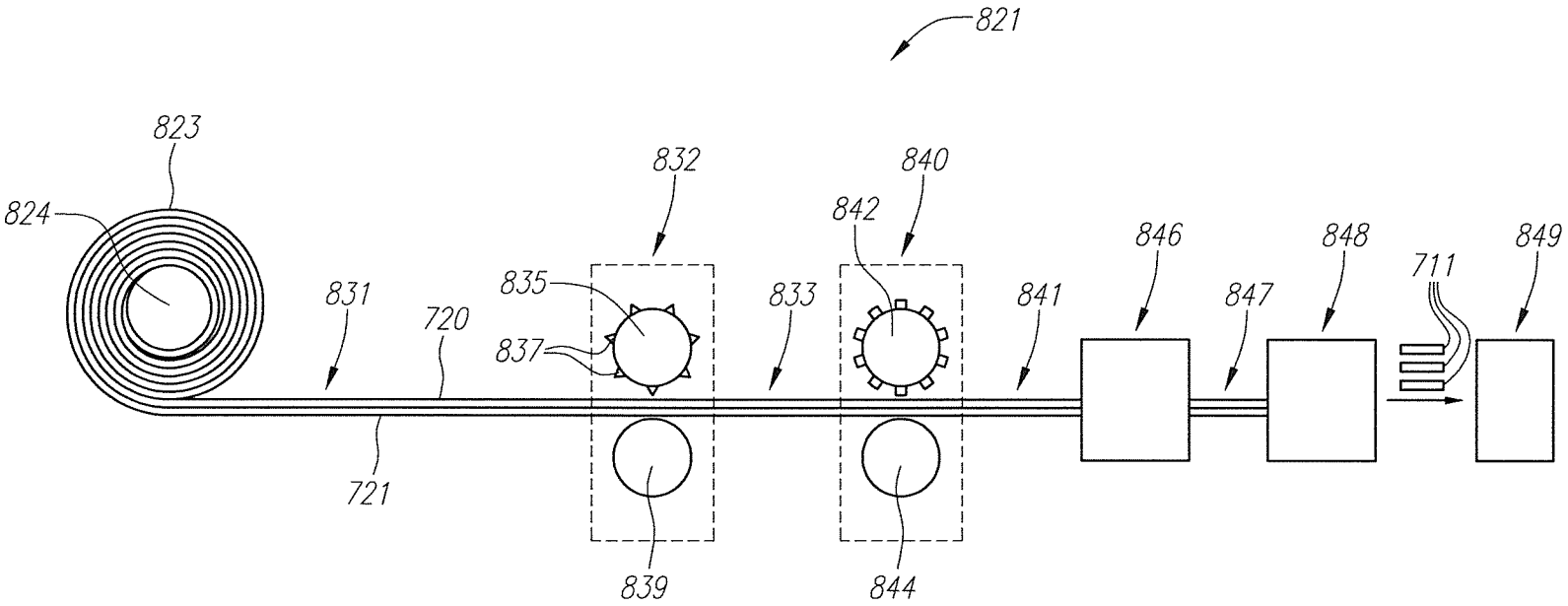
FIG. 31 is a simplified schematic view of one embodiment of an apparatus that can be used to make the sheet construction of FIGS. 27(*a*) through 27(*f*)

Referring now to FIG. 31, there is schematically shown an apparatus that can be used to make sheet construction 711, the apparatus being represented by reference numeral 821.

Apparatus 821 can include a supply roll 823 of composite material 831, composite material 831 including the combination of adhesive assembly 720 and third material 721. Supply roll 823 can be unwound from a reel 824. Apparatus 821 can further include a media defining station 832 through which composite material 831 can be passed so that individual media 749-1 through 749-6 can be defined in composite material 831, thereby yielding a first modified composite material 833. Station 832 can include the combination of a cylindrical die 835 having knife elements 837 arranged on its periphery and a smooth anvil roller 839.

Apparatus 821 can further include a compressing station 840 through which first modified composite material 833 can be passed so that leading compressed regions 761-1, 761-2, and 761-3, trailing compressed regions 763-1, 763-2, and 763-3, and side compressed regions 765-1 through 765-33 and 767-1 through 767-33 can be formed in first modified composite material 833, thereby yielding a second modified composite material 841. Station 840 can include the combination of a scoring roller 842 and a smooth anvil roller 844. Apparatus 821 can further include a printing station 846 through which material 841 can be passed so that indicia (e.g., trademarks, instructions, etc.) can be imprinted on first material 713 and/or third material 721, thereby yielding a third modified composite material 847. Apparatus 821 can further include a sheeting station 848 for cutting material 847 into standard paper-sized sheets, thereby yielding sheet construction 711. Apparatus 821 can further include a packaging station 849 for packaging one or more sheet constructions 711.

For sheet constructions in which at least a portion of the matrix, i.e., the non-print-receiving area, is removed from third material 721 during the manufacturing process (sheet construction 711 not being such a sheet construction), apparatus 821 can further include a conventional matrix removal station positioned after media defining station 832. Such a matrix removal station can include, for example, a pair of rollers, which can be used to remove the matrix, and a take-up reel, which can be used to collect the removed matrix.

Figure 32:
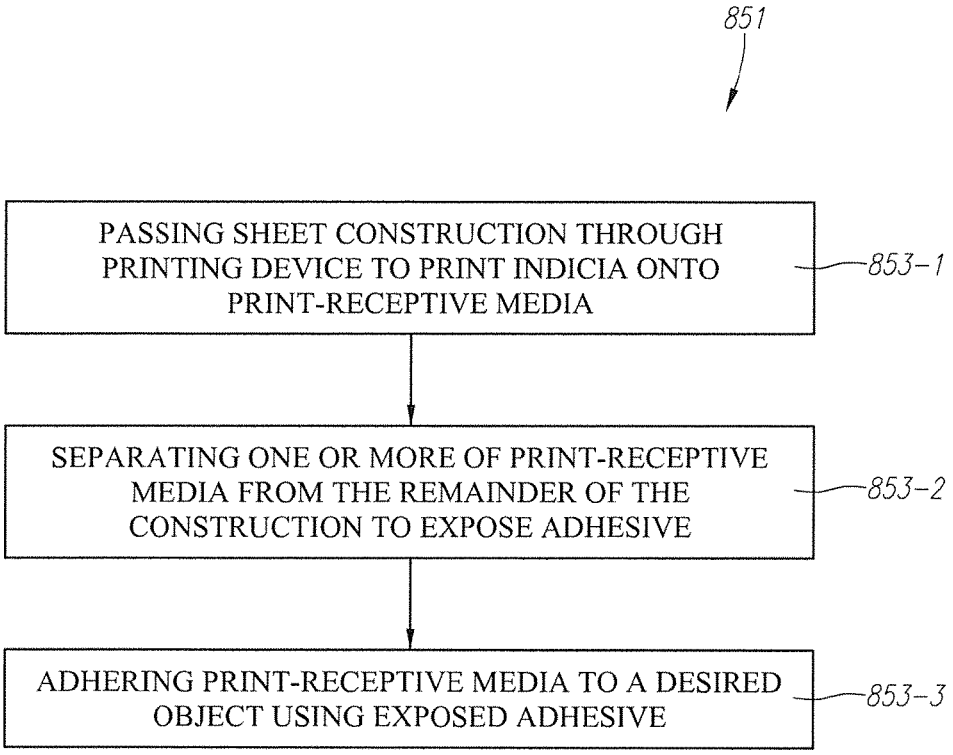
FIG. 32 is a flowchart, schematically depicting one method of using the sheet construction of FIGS. 27(*a*) through 27(*f*)
Figure 33A:
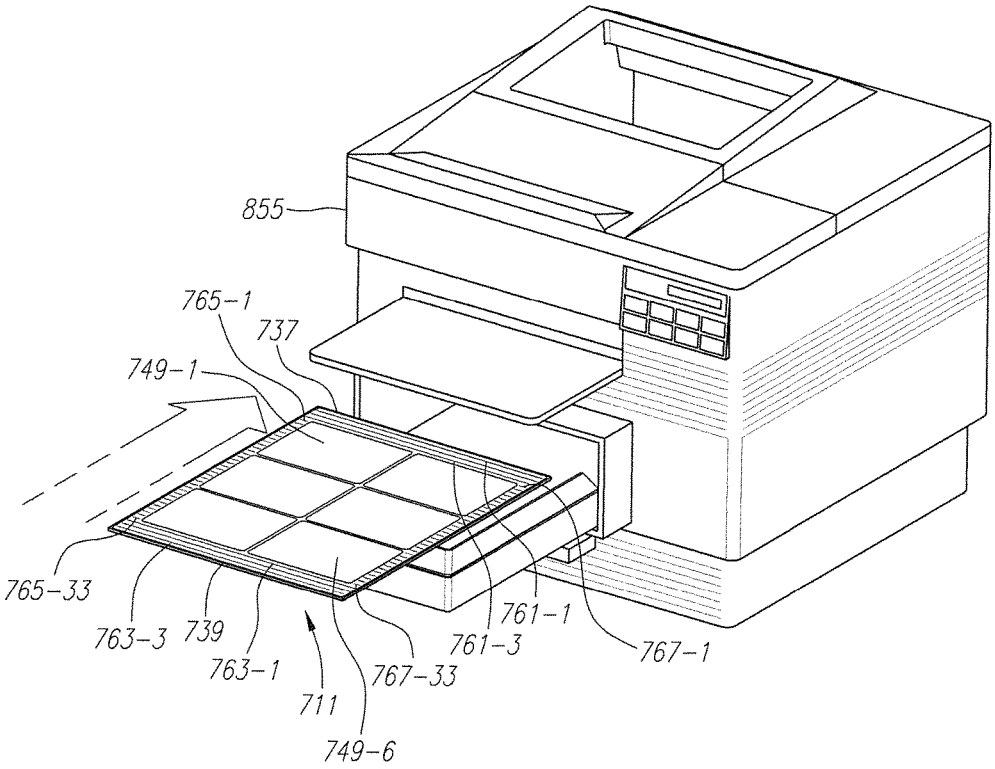
FIGS. 33(*a*) through 33(*c*) are views illustrating the performance of certain steps of the method of FIG. 32.
Figure 33B:
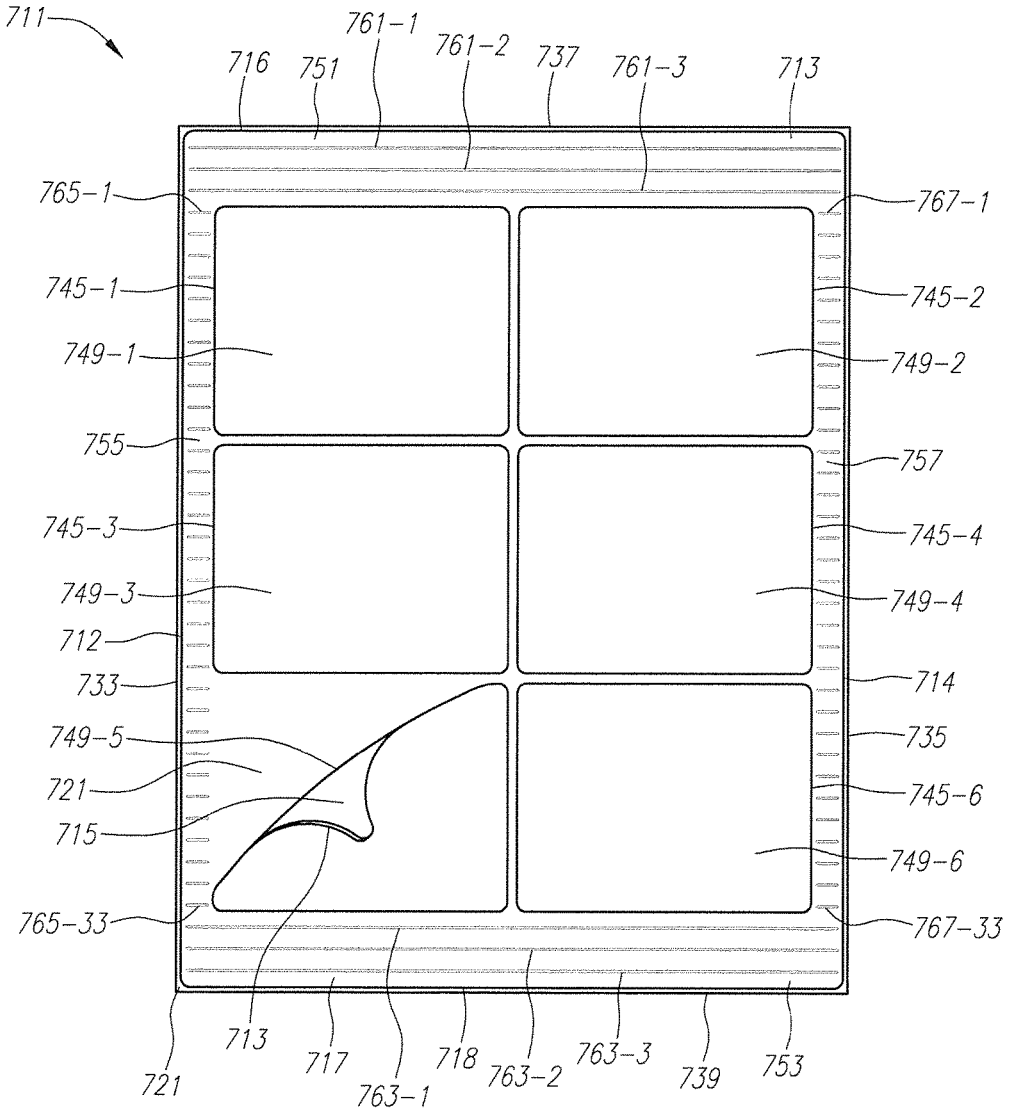
Figure 33C:
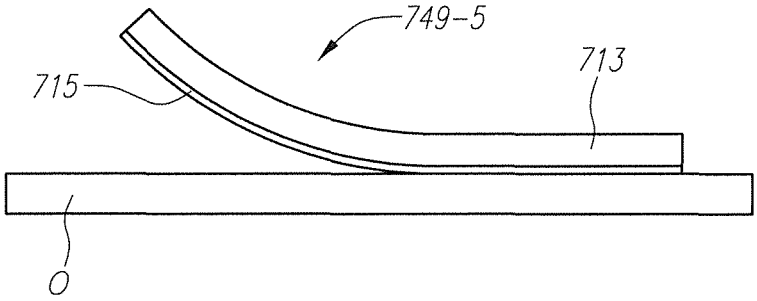
Figure 34A:
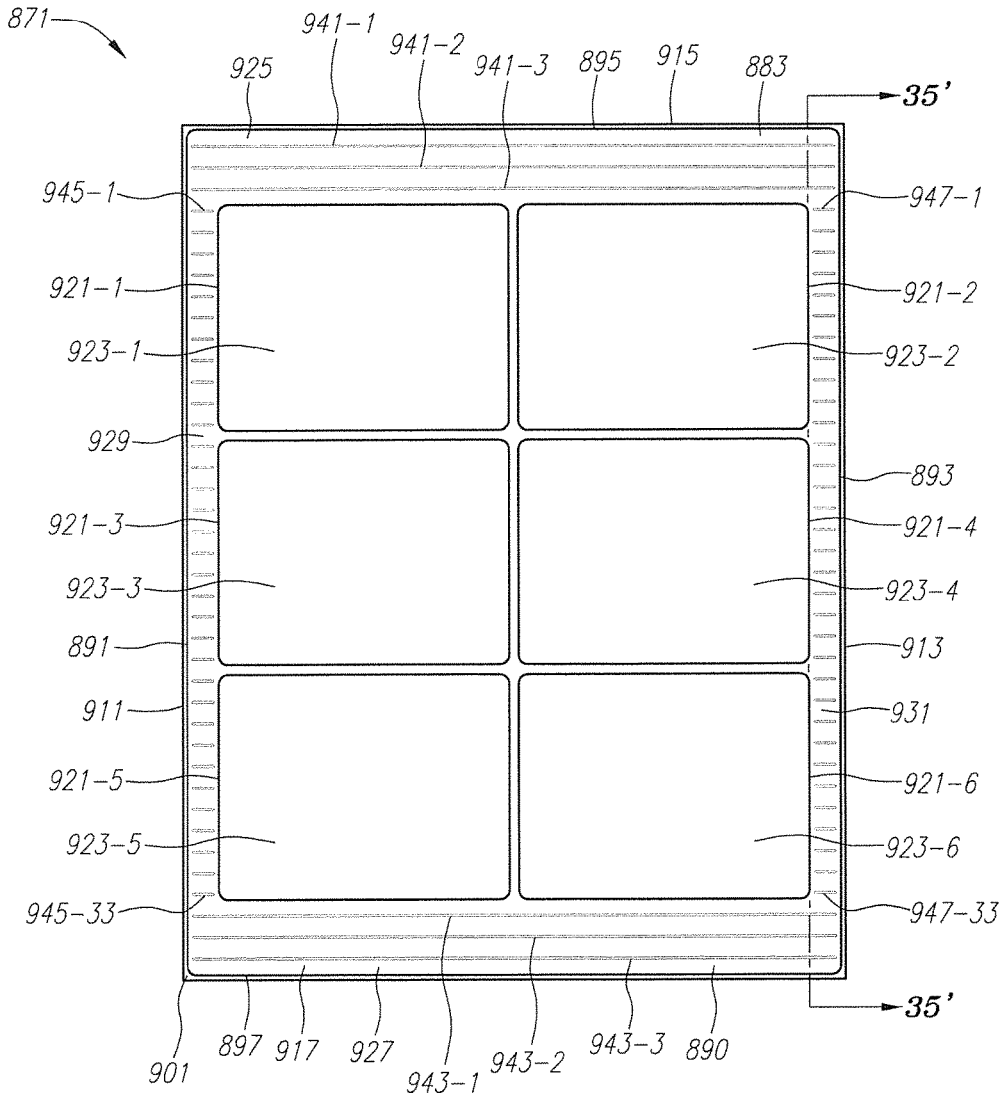
FIGS. 34(*a*), 34(*b*), 34(*c*), 34(*d*), 34(*e*), and 34(*f*) are front plan, rear plan, top elevation, bottom elevation, left-side elevation, and right-side elevation views, respectively, of a tenth embodiment of a sheet construction according to the present invention.
Figure 34B:
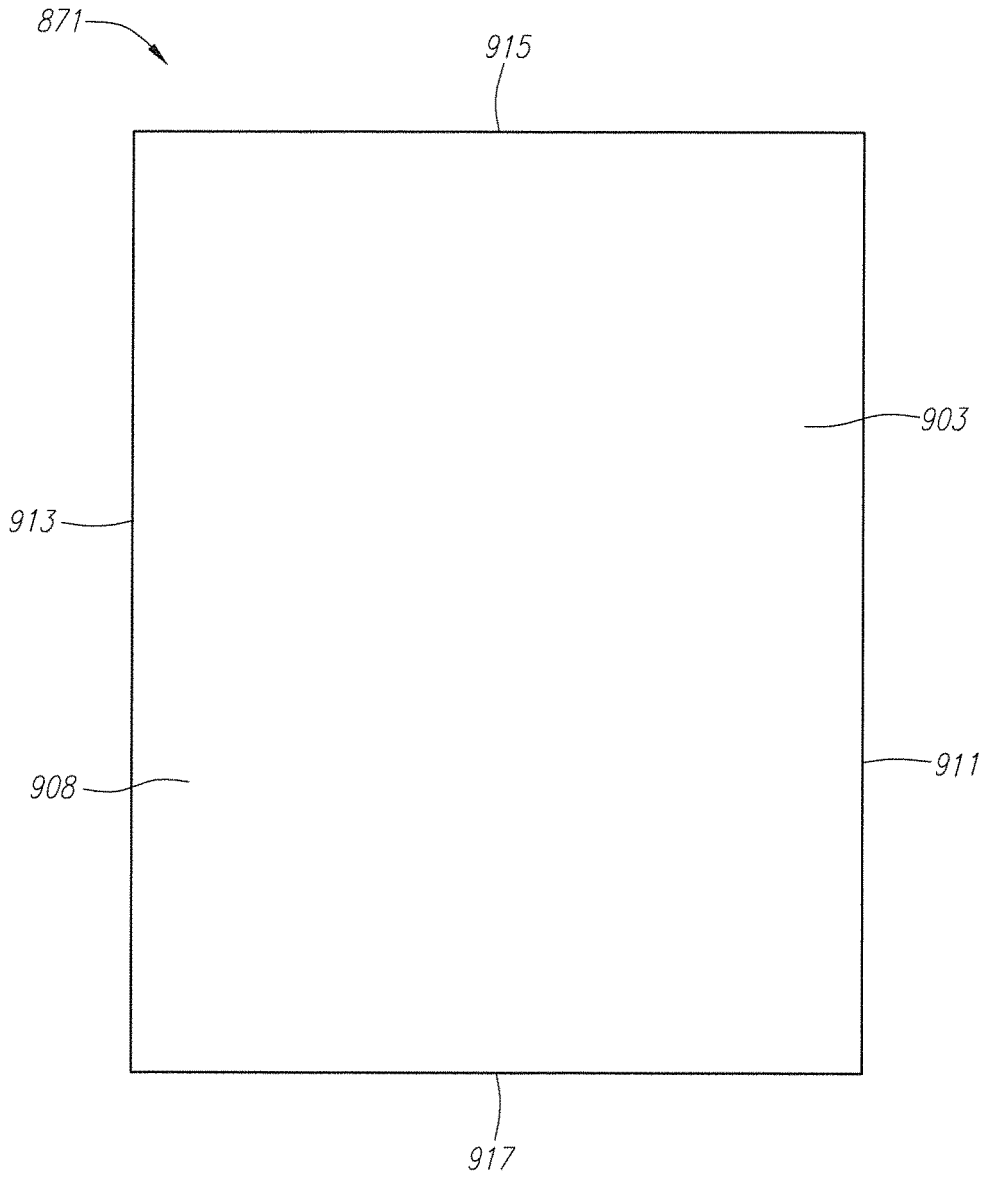
Figure 34C:
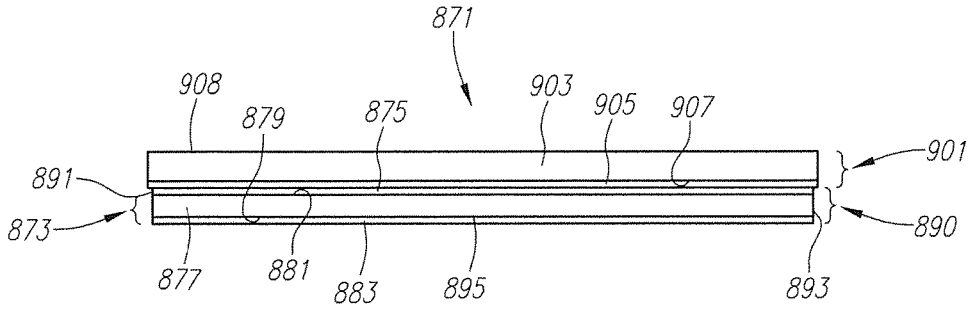
Figure 34D:
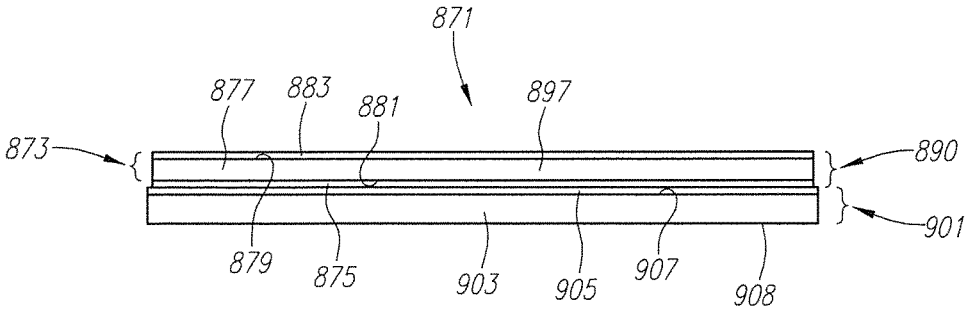
Figure 34E:
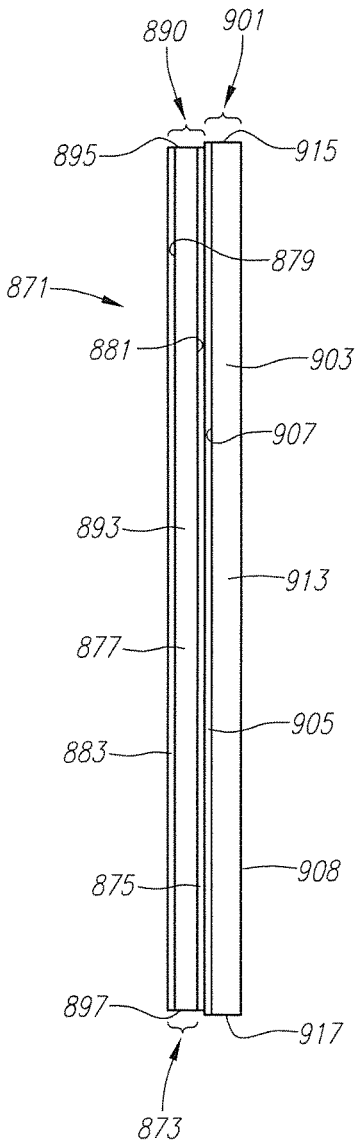
Figure 34F:
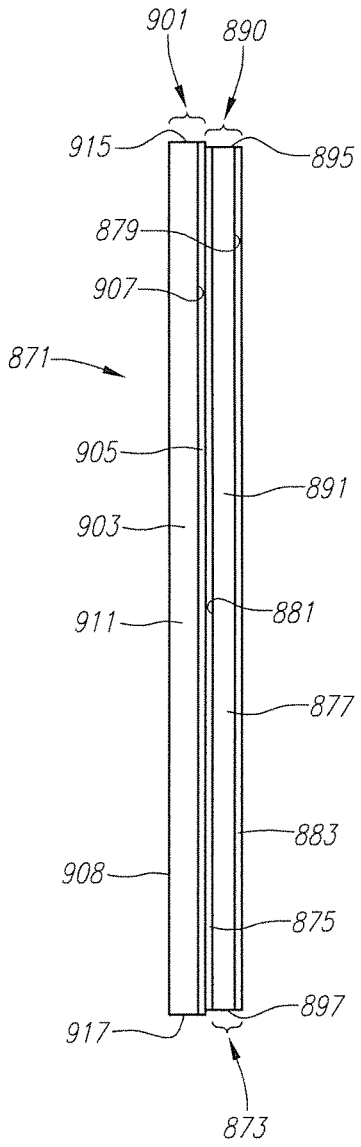

Referring now to FIG. 32, there is shown a flowchart, schematically depicting one embodiment of a method for using sheet construction 711, the method being represented generally by reference numeral 851. Method 851 can begin in a step 853-1 with the passing of sheet construction 711 through a printing device 855 (see also FIG. 33(*a*)), whereby indicia can be printed on one or more of print-receptive media 749-1 through 749-6. Because of the presence of leading compressed regions 761-1, 761-2, and 761-3, trailing compressed regions 763-1, 763-2, and 763-3, and side compressed regions 765-1 through 765-33 and 767-1 through 767-33 on sheet construction 711, the occurrence of "start of print off-registration" errors can be reduced. Method 851 can then continue in a step 853-2 with the separation of one or more of individual print-receptive media 749-1 through 749-6 from the remainder of adhesive-backed substrate 720 and from third material 721 so as to expose the adhesive second material 715 (see also FIG. 33(*b*)), one or more of said print-receptive media 749-1 through 749-6 (which are in the form of adhesive backed labels) preferably bearing printed indicia thereon. Method 851 can then conclude in a step 853-3 with the affixation of the one or more thus-separated print-receptive media 749-1 through 749-6 to desired object O, for example, by adhering the print-receptive media to the substrate using second material 715 (see also FIG. 33(*c*)).

Figure 35:
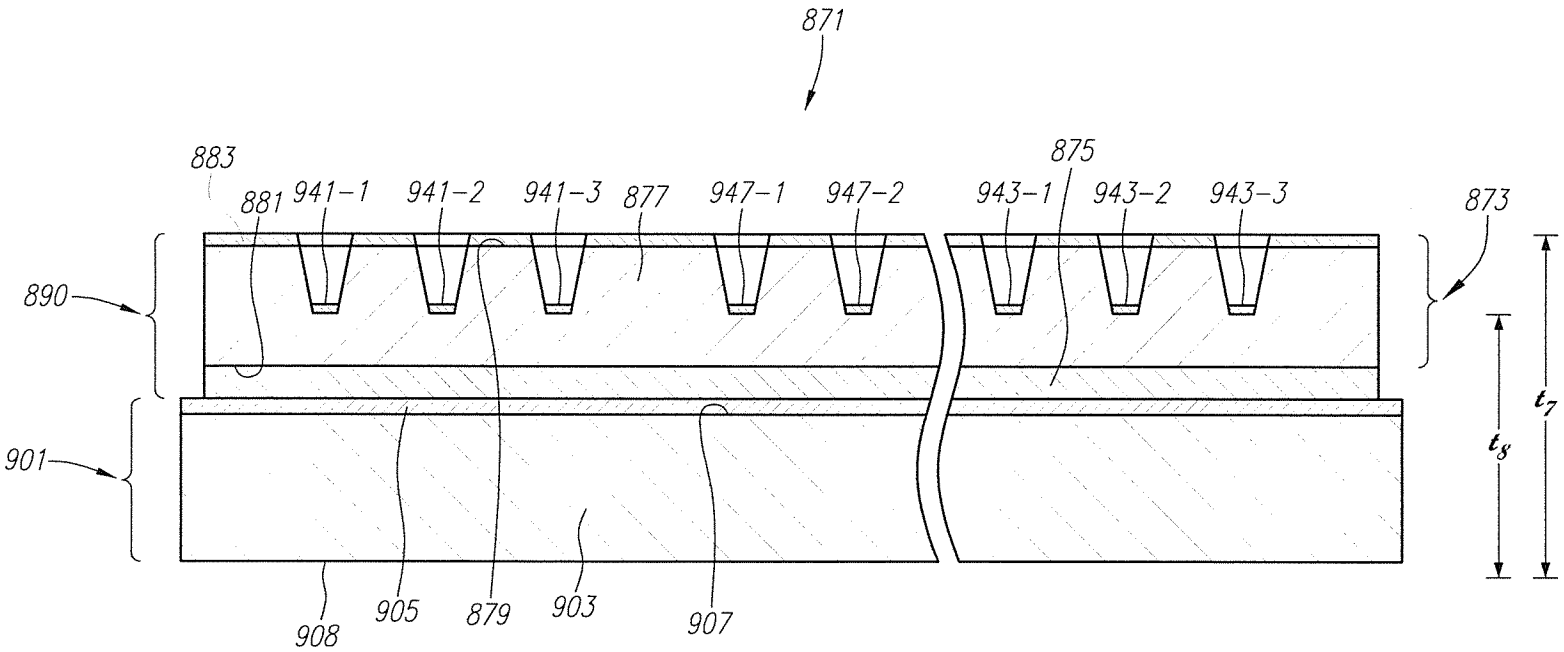
FIG. 35 is an enlarged fragmentary section view of the sheet construction of FIG. 34(*a*) taken along line 35'-35'.

Referring now to FIGS. 34(*a*) through 34(*f*), as well as FIG. 35, there are shown various views of a tenth embodiment of a sheet construction made according to the present invention, the sheet construction being represented generally by reference numeral 871.

Sheet construction 871, which can be similar in many respects to sheet construction 711, can include a first material 873. First material 873, in turn, can include a substrate 877 having a first major surface 879 and an opposed second major surface 881. Substrate 877 can consist of a single layer or can include a multi-layer construction. Examples of single layer materials that can be used as substrate 877 can include certain paper materials and certain polymer films. Examples of such paper materials can include a sheet of adhesive label facestock. Examples of such polymer films can include an oriented polyolefin film, a polyester film, and a polyurethane film. Examples of multi-layer constructions can include, for example, coated papers, laminated papers, coated polymer films, laminated polymer films, and combinations thereof.

First material 873 can further include a print-receptive coating 883 disposed directly on first major surface 879 of substrate 877. Print-receptive coating 883 can be any one or more print-receptive materials known to those skilled in the art for use in receiving markings made by hand or by a printing device. For example, where one wishes to make dry-erase markings on first material 873, print-receptive coating 883 can include a conventional dry-erase film, such as a polyethylene terephthalate (PET) film, a polypropylene film, or the like. Additional examples of materials suitable for use as print-receptive coating 883 can be found in previously incorporated U.S. Patent Application Publication No. US 2003/0148056 A1 in connection with the discussion therein of top material 130.

Second material 875 can be a pressure-sensitive adhesive applied to second major surface 881 of substrate 877. In one embodiment, second material 875 can be applied to the entirety of second major surface 881 of substrate 877 so as to form a continuous coating thereon. In another embodiment, second material 875 can be pattern-coated onto predetermined portions of second major surface 881. The combination of first material 873 and second material 875 can comprise an adhesive assembly 890, which can be used as an adhesive-backed label. Depending on the particular intended use of adhesive assembly 890, a suitable adhesive can be selected for use as second material 875. Examples of adhesives that can be suitable can include pressure-sensitive adhesives, such as permanent adhesives, removable adhesives, ultraremovable adhesives, hot-melt adhesives, acrylic adhesives, and rubber-based adhesives. Suitable pressure-sensitive adhesives can include, for example, S-490 adhesive from Avery Dennison Corporation (Pasadena, Calif.) and AT-1 adhesive from Avery Dennison Corporation (Pasadena, Calif.). Adhesive assembly 890 can be a generally rectangular sheet-like structure including a first longitudinal edge 891, a second longitudinal edge 893, a leading edge 895, and a trailing edge 897.

Sheet construction 871 can further include a third material 901. Third material 901 can include a carrier 903, which can be, for example, a sheet of paper, and can also include a release coating 905, which can be, for example, a silicone-based release coating applied to a first major surface 907 of carrier 903. Second material 875 can be positioned in direct contact with release coating 905. Carrier 903 can be slightly oversized relative to adhesive assembly 890 so that so that first longitudinal edge 891, second longitudinal edge 893, leading edge 895, and trailing edge 897 of adhesive assembly 890 are spaced slightly inwardly of a first longitudinal edge 911, a second longitudinal edge 913, a leading edge 915, and a trailing edge 917, respectively, of third material 901.

First material 873 and second material 875 can have a combined thickness of at least about 4 mils and, more specifically, can have a combined thickness of about 4 mils to about 14 mils, or about 4 mils to about 7 mils in the case of the sheet construction including label stock, or about 8 mils to about 14 mils in the case of the sheet construction including card stock.

Sheet construction 871 can further include a plurality of lines defining one or more smaller-size print-receptive media. Such defining lines can be, for example, die-cut lines, partial die-cut lines, perforated lines including microperforated lines, lines of cuts and ties, etched lines, and lines made by other techniques known in the art. As exemplified by the present embodiment, the aforementioned defining lines can include six circumscribing lines 921-1 through 921-6 defining six generally rectangular print-receptive media 923-1 through 923-6, respectively, each in the form of an adhesive-backed label. A leading margin 925 in adhesive assembly 890 can extend from first longitudinal edge 891 to second longitudinal edge 893 and can be bounded by first longitudinal edge 891, second longitudinal edge 893, leading edge 895, and print-receptive media 923-1 and 923-2. A trailing margin 927 in adhesive assembly 890 can extend from first longitudinal edge 891 to second longitudinal edge 893 and can be bounded by first longitudinal edge 891, second longitudinal edge 893, trailing edge 897, and print-receptive media 923-5 and 923-6. A first side margin 929 in adhesive assembly 890 can be bounded by first longitudinal edge 891, leading margin 925, trailing margin 927, and print-receptive media 923-1, 923-3, and 923-5. A second side margin 931 in adhesive assembly 890 can be bounded by second longitudinal edge 893, leading margin 925, trailing margin 927, and print-receptive media 923-2, 923-4, and 923-6.

Circumscribing lines 921-1 through 921-6 can be formed, for example, by die-cutting or rotary knives and can extend entirely through adhesive assembly 890 but preferably do not extend through third material 901.

It should be understood that the number, size, shape, and arrangement of print-receptive media 923-1 through 923-6 in the present embodiment are merely exemplary; consequently, the number of print-receptive media 923-1 through 923-6 can be increased or decreased, and the size, shape, and arrangement of print-receptive media 923-1 through 923-6 can be modified. For example, sheet construction 871 can be modified to include as few as one print-receptive medium or as many as eighty print-receptive media.

Sheet construction 871 can further include one or more leading compressed regions 941-1, 941-2, and 941-3, trailing compressed regions 943-1, 943-2, and 943-3, side compressed regions 945-1 through 945-33 and 947-1 through 947-33, i.e., regions in which sheet construction 871 is compressed to a reduced thickness. As seen, for example, in FIG. 35, with respect to the aforementioned one or more compressed regions, the thickness of sheet construction 871 can be reduced by about 5% to about 35% from a non-compressed thickness $t_7$ of, for example, about 4 mils to about 14 mils, to a compressed thickness $t_8$ of, for example, about 2.6 mils to about 13.3 mils. The one or more compressed regions can be asymmetrically compressed relative to print-receptive coating 883 and a second major surface 908 of carrier 903 and, for example, can appear in print-receptive coating 883, either with or without corresponding protrusions in second major surface 908 of carrier 903.

As viewed from the front of sheet construction 871, the one or more compressed regions can include straight compressed regions (as shown in FIG. 34(*a*)), arcuate compressed regions (as shown in FIG. 18), or a mixture of straight and arcuate regions (as shown in FIG. 19). The one or more compressed regions can be positioned in one or more of leading margin 925, trailing margin 927, first side margin 929, and second side margin 931. In the present embodiment, the one or more compressed regions can include leading compressed regions 941-1, 941-2, and 941-3 in leading margin 925, trailing compressed regions 943-1, 943-2, and 943-3 in trailing margin 927, side compressed regions 945-1 through 945-33 in first side margin 929, and side compressed regions 947-1 through 947-33 in second side margin 931.

It should be understood that the present embodiment discloses an exemplary number and arrangement of leading compressed regions 941-1, 941-2, and 941-3, trailing compressed regions 943-1, 943-2, and 943-3, side compressed regions 945-1 through 945-33, and side compressed regions 947-1 through 947-33; consequently, the number of leading compressed regions 941-1, 941-2, and 941-3, trailing compressed regions 943-1, 943-2, and 943-3, side compressed regions 945-1 through 945-33, and side compressed regions 947-1 through 947-33 can be increased or decreased, and the dimensions and placement of leading compressed regions 941-1, 941-2, and 941-3, trailing compressed regions 943-1, 943-2, and 943-3, side compressed regions 945-1 through 945-33, and side compressed regions 947-1 through 947-33 can be modified. Notwithstanding the above, it is believed that sheet construction 871 can include, for example, from twenty-six to one hundred twenty compressed regions in one or both of first side margin 929 and second side margin 931 and can include, for example, from one to four compressed regions in one or both of leading margin 925 and trailing margin 927.

Sheet construction 871 can be made and used similarly to sheet construction 711.

The following examples are provided for illustrative purposes only and are in no way intended to limit the scope of the present invention:

EXAMPLE 1

Edge Flexibility (mN)

The method hereinafter described was used to measure the bending resistance of certain paper and paperboard samples.

To prepare the samples, 3 sheets were randomly selected from each sample batch. The sample size was 0.5"×0.5". For a deflection measurement taken in the direction of $w_1$, the sample should be inserted in the clamp with the clamp jaws oriented in the $l_1$ direction. For a deflection measurement taken in the direction of $l_1$, the sample should be inserted in the clamp with the clamp jaws oriented in the $w_1$ direction. A cutter was used to cut the sample.

The testing equipment used was a TMI Bending Resistance Tester from Testing Machine Inc. of New Castle, Del. Related test methods of interest include ISO 2493, AS/NZ 1301-4535, BS 3748, DIN 53121, SCAN P29, TAPPI T556.

The following test procedure was used: (1) Turn ON the power switch on the right back side of the Stiffness tester. (2) The LCD display shows BENDING RESISTANCE TESTER (V2.7-1 N); press ENTER twice to the MENU screen. (3) Press #1 button=UNITS→select1=mN unit; then select #2 button=15 DEGREE. (4) Press #7 button (7=SETTINGS); the LCD display shows the following: UNIT=Taber units; BENDING ANGLE=15.0; BENDING LENGTH=5 mm; OPERATOR NUMBER=0; SAMPLE NUMBER=O; RETURN MODE=AUTOMATIC. (5) After checking the setting listed above, press "ENTER" button. (6) Place the sample (marked in vertical position) 6/32" into the clamp holder, between the jaw and the knife. (7) Make sure the sample is not touching the base. Press the "START" button. (8) The jaw automatically bends 15° towards the operator and stops. Measurements made in this orientation will be designated as "Bending towards Side 1." (9) Record the Stiffness reading in mN unit (Left deflection). (10) Use the same sample and turn the sample to the other side. (11) Place the sample between the jaw and the knife, repeating step (6) and make sure the sample is not touching the base. Press the "START" button. (12) Record the Stiffness reading in mN unit (right deflection). Measurements made in this orientation will be designated as "Bending towards Side 2." (13) Repeat steps 6 to step 12 on the sheet#2, Sheet#3, and so forth. (14) Press the OFF switch on the right back side of the BENDING RESISTANCE TESTER after the test is completed.

At least 3 measurements were taken per sample in each direction. The average of 3 measurements for the left deflection was recorded and then the average of 3 measurements for the right deflection was taken. The higher the values, the stiffer the material. The results of testing a leading compressed region of various samples are shown below in Table 1.

TABLE 1

| Physical Properties | Left Deflection 0.5" × 0.5" @ 5 mm 15 degrees | Right Deflection 0.5" × 0.5" @ 5 mm 15 degrees |
|---|---|---|
| 0.5" × 0.5" @ 5 mm 15° | | |
| Trial 1; Sheet 1 | 470.40 ± 29.98 | 375.86 ± 50.93 |
| Trial 1; Sheet 2 | 429.72 ± 17.49 | 392.58 ± 30.23 |
| Trial 1; Sheet 3 | 481.35 ± 41.06 | 361.35 ± 17.07 |
| Trial 2; Sheet 1 | 476.07 ± 154.03 | 410.13 ± 11.76 |
| Trial 3; Sheet 1 | 532.63 ± 41.61 | 463.14 ± 55.46 |
| Control Sample 1 | 716.08 ± 28.25 | 658.16 ± 19.09 |
| Control Sample 2 | 661.56 ± 27.92 | 639.95 ± 22.15 |

As can be seen from Table 1 above, the trial samples exhibited lower stiffness than the control samples at their respective leading edges. This difference is believed to allow the trial samples to bend more easily inside a printer and to contour more smoothly around the rollers of a printer, similar to what would be experienced for a thinner sheet. Additionally, the presence of compressed lines along the sides of the trial samples enables the rollers inside a printer to engage better with the trial samples, thereby enabling the trial samples to register more consistently during printing.

EXAMPLE 2

Micrographs of Sheet Constructions

Figure 36:
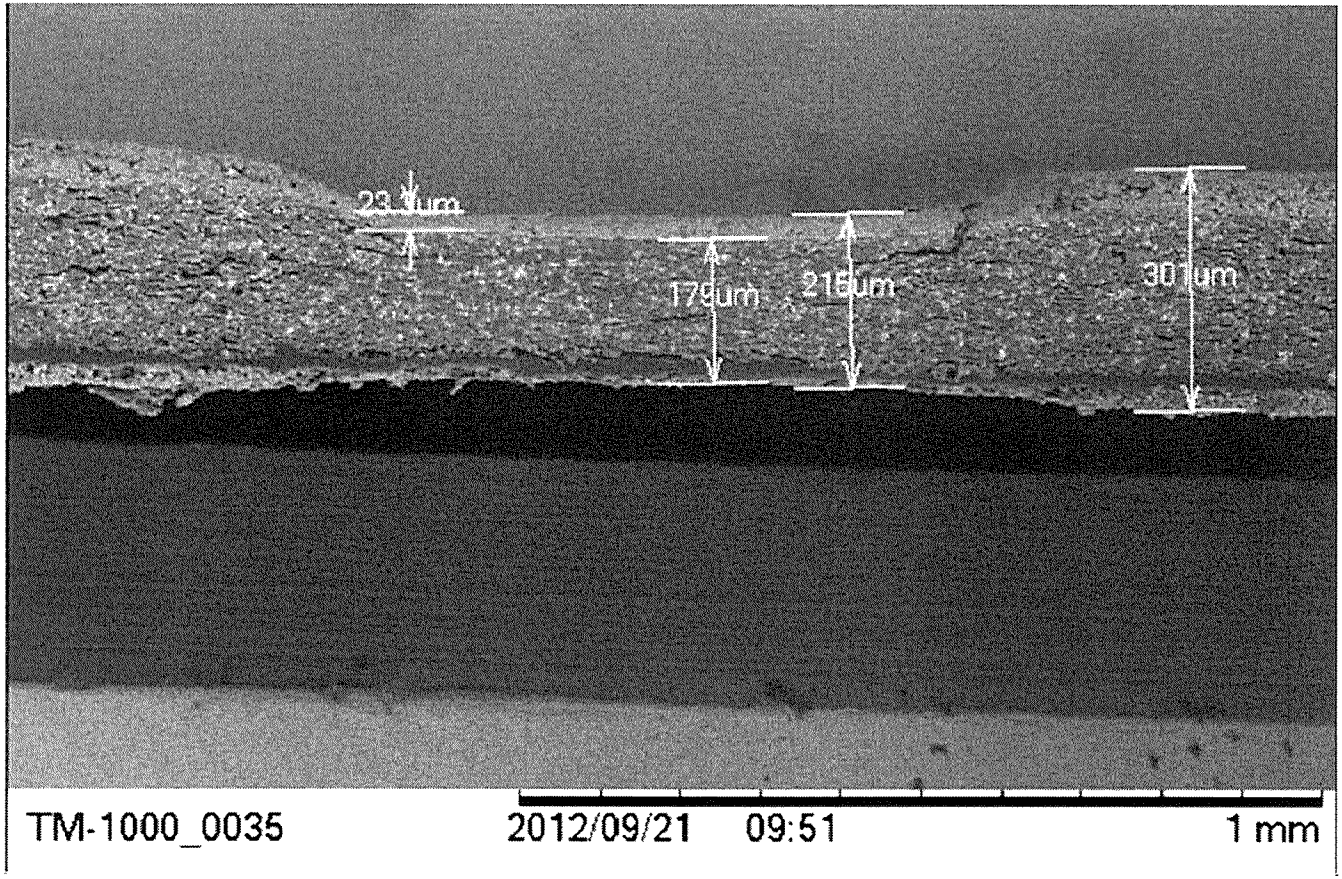
FIG. 36 is a micrograph of a portion of a sheet construction of the type depicted in FIG. 16(*a*) taken along line 36'-36', the micrograph showing one of the compressed regions in the leading margin of the sheet construction.

Referring now to FIG. 36, there is shown a micrograph of a portion of a sheet construction 271 of the type depicted in FIG. 16(*a*), the micrograph showing, in section taken along line 36'-36', one of the two leading compressed regions 307-1 and 307-2 located in the leading margin 303 of the sheet construction. As can be seen, the thickness of the sheet construction outside of the compressed region is 301 microns whereas the thickness of the sheet construction within the compressed region is 215 microns; consequently, the compressed region represents about a 29% reduction in thickness.

Figure 37:
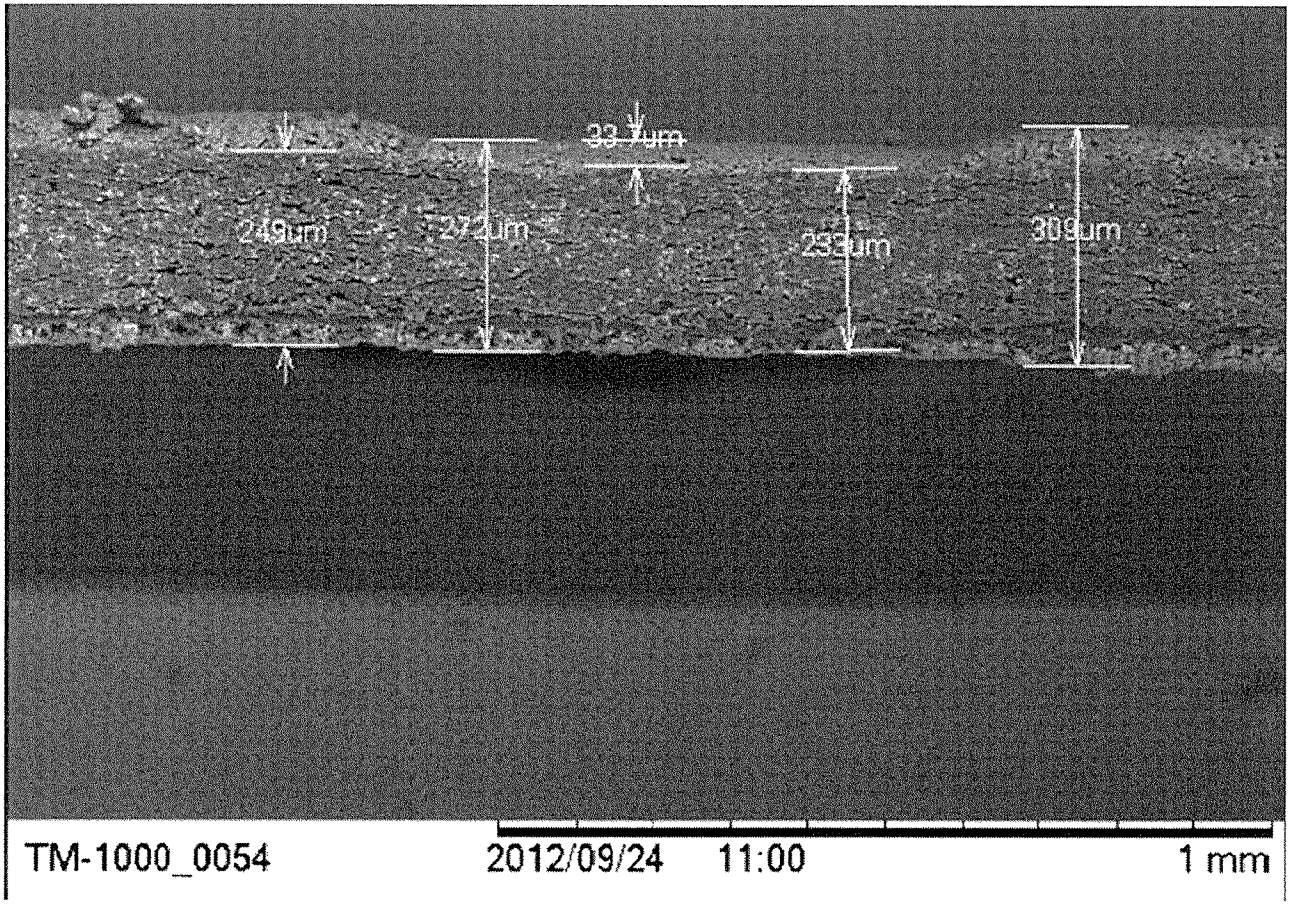
FIG. 37 is a micrograph of a portion of a sheet construction of the type depicted in FIG. 16(*a*) taken along line 17'-17', the micrograph showing one of the compressed regions in a side margin of the sheet construction.

Referring now to FIG. 37, there is shown a micrograph of a portion of a sheet construction 271 of the type depicted in FIG. 16(*a*), the micrograph showing, in section taken along line 17'-17', one of the seventy-nine side compressed regions 310-1 through 310-79 located in side margin 306 of the sheet construction. As can be seen, the thickness of the sheet construction outside of the compressed region is 309 microns whereas the thickness of the sheet construction within the compressed region is 272 microns; consequently, the compressed region represents about a 12% reduction in thickness.

All features disclosed in the specification, including the claims, abstract, and drawings, and all steps in any method or process disclosed, can be combined in any combination, except combinations where at least some of such features and/or steps are mutually exclusive. Each feature disclosed in the specification, including the claims, abstract, and drawings, can be replaced by alternative features serving the same, equivalent, or similar purpose, unless expressly stated otherwise. Thus, unless expressly stated otherwise, each feature disclosed is one example only of a generic series of equivalent or similar features.

The foregoing detailed description of the present invention is provided for purposes of illustration, and it is not intended to be exhaustive or to limit the invention to the particular embodiments disclosed. The embodiments can provide different capabilities and benefits, depending on the configuration used to implement the key features of the invention. Accordingly, the scope of the invention is defined only by the following claims.

What is claimed is:

1. A sheet construction comprising:

a first material, the first material including a leading edge, a trailing edge, a first longitudinal edge, and a second longitudinal edge forming a single non-continuous sheet, the first material defining a plurality of print-receptive media, wherein the first material is formed from a cardstock material;

a second material attached to the first material, wherein the second material is formed from a non-separating polymer carrier material;

a leading margin extending from the first longitudinal edge to the second longitudinal edge and bounded at least by the leading edge, the first longitudinal edge, the second longitudinal edge, and the plurality of print-receptive media; and a first side margin bounded at least in part by the leading margin, the first longitudinal edge, and the plurality of print-receptive media;

wherein the first side margin including includes at least one compressed region formed partially through at least the first material and the second material, the at least one compressed region decreasing stiffness of the first material generally preventing the plurality of print-receptive media from becoming off register during printing thereon by a printing device.

2. The sheet construction according to claim 1, wherein the first side margin includes a plurality of compressed regions.

3. The sheet construction according to claim 2, wherein the plurality of compressed regions of the first side margin includes greater than twenty-five compressed regions.

4. The sheet construction according to claim 3, wherein the plurality of compressed regions of the first side margin includes no more than one hundred twenty compressed regions.

5. The sheet construction according to claim 3, wherein the plurality of compressed regions of the first side margin includes seventy-nine compressed regions.

6. The sheet construction according to claim 3, wherein the plurality of compressed regions of the first side margin includes thirty-three compressed regions.

7. The sheet construction according to claim 1, wherein at least one of the at least one compressed region of the first side margin is straight.

8. The sheet construction according to claim 1, wherein the at least one compressed region of the first side margin is generally parallel to the leading edge.

9. The sheet construction according to claim 1, wherein the at least one compressed region of the first side margin is spaced from each of the first longitudinal edge and the first print-receptive medium by a distance from about 0 inch to about 0.079 inch.

10. The sheet construction according to claim 9, wherein the at least one compressed region of the first side margin is spaced from each of the first longitudinal edge and the first print-receptive medium by a distance from about 0.020 inch to about 0.079 inch.

11. The sheet construction according to claim 1, wherein the at least one compressed region of the first side margin has a length that is parallel to the first longitudinal edge, the length being from about 0.030 inch to about 0.039 inch.

12. The sheet construction according to claim 1, wherein at least one of the at least one compressed region of the first side margin is compressed to a depth of about 20 microns to about 110 microns.

13. The sheet construction according to claim 1, wherein at least one of the at least one compressed region of the first side margin has a thickness that is about 65% to about 95% of the total caliper of the sheet construction.

14. The sheet construction according to claim 1, wherein the sheet construction has a total thickness of about 4 mils to about 14 mils.

15. The sheet construction according to claim 14, wherein the sheet construction has a total thickness of about 4 mils to about 7 mils.

16. The sheet construction according to claim 14, wherein the sheet construction has a total thickness of about 8 mils to 14 mils.

17. The sheet construction according to claim 1, wherein the first material further defines a second side margin bounded at least in part by the leading margin and the second longitudinal edge, the second side margin including at least one compressed region.

18. The sheet construction according to claim 17, wherein the second side margin includes a plurality of compressed regions.

19. The sheet construction according to claim 18, wherein the plurality of compressed regions of the second side margin includes greater than twenty-five compressed regions.

20. The sheet construction according to claim 19, wherein the plurality of compressed regions of the second side margin includes no more than one hundred twenty compressed regions.

21. The sheet construction according to claim 17, wherein at least one of the at least one compressed region of the second side margin is straight.

22. The sheet construction according to claim 17, wherein the at least one compressed region of the second side margin is generally parallel to the leading edge.

23. The sheet construction according to claim 17, wherein the at least one compressed region of the second side margin is spaced from the second longitudinal edge by a distance from about 0 inch to about 0.079 inch.

24. The sheet construction according to claim 23, wherein the at least one compressed region of the second side margin is spaced from the second longitudinal edge by a distance from about 0.020 inch to about 0.079 inch.

25. The sheet construction according to claim 17, wherein the at least one compressed region of the second side margin has a length that is parallel to the second longitudinal edge, the length being from about 0.030 inch to about 0.039 inch.

26. The sheet construction according to claim 17, wherein at least one of the at least one compressed region of the second side margin is compressed to a depth of about 20 microns to about 110 microns.

27. The sheet construction according to claim 17, wherein at least one of the at least one compressed region of the second side margin has a thickness that is about 65% to about 95% of the total caliper of the sheet construction.

28. The sheet construction according to claim 1, wherein the leading margin includes at least one compressed region.

29. The sheet construction according to claim 28, wherein the leading margin includes a plurality of compressed regions.

30. The sheet construction according to claim 29, wherein the plurality of compressed regions of the leading margin includes no more than four compressed regions.

31. The sheet construction according to claim 28, wherein at least one of the at least one compressed region of the leading margin is straight.

32. The sheet construction according to claim 31, wherein the at least one compressed region of the leading margin is generally parallel to the leading edge.

33. The sheet construction according to claim 28, wherein at least one of the at least one compressed region of the leading margin is arcuate.

34. The sheet construction according to claim 28, wherein at least one of the at least one compressed region of the leading margin and the at least one compressed region of the first side margin is arcuate.

35. The sheet construction according to claim 28, wherein the at least one compressed region of the leading margin has a length that is parallel to the first longitudinal edge, the length being from about 0.030 inch to about 0.039 inch.

36. The sheet construction according to claim 28, wherein the first material has a width and wherein the at least one compressed region of the leading margin has a width that is about 0.040 inch to about 0.158 inch less than the width of the first material.

37. The sheet construction according to claim 28, wherein at least one of the at least one compressed region of the leading margin is compressed to a depth of about 85 microns to about 110 microns.

38. The sheet construction according to claim 28, wherein at least one of the at least one compressed region of the leading margin has a thickness that is about 65% to about 95% of the total caliper of the sheet construction.

39. A sheet construction comprising:

a material comprising a first material and a second material, where the second material is attached to the first material, the material including a leading edge, a trailing edge, a first longitudinal edge, and a second longitudinal edge, forming a single non-continuous sheet, the material defining a plurality of print-receptive media, wherein an edge of a first print-receptive media and an edge of a second print-receptive media are configured to at least one of: share a border; or be separated by a non-compressed region, wherein the first material is formed from a cardstock material and the second material is formed from a non-separating polymer carrier material;

a leading margin extending from the first longitudinal edge to the second longitudinal edge and bounded at least by the leading edge, the first longitudinal edge, the second longitudinal edge, and the a plurality of print-receptive media;

a trailing margin extending from the first longitudinal edge to the second longitudinal edge and bounded at least by the trailing edge, the first longitudinal edge, the second longitudinal edge, and the a plurality of print-receptive media;

a first side margin bounded by the leading margin, the trailing margin, the first longitudinal edge, and the a plurality of print-receptive media; and a second side margin bounded by the leading margin, the trailing margin, the second longitudinal edge, and the plurality of print-receptive media;

wherein the first side margin including at least one compressed region, the at least one compressed region decreasing force necessary to bend the material around internal bends of a printing device and wherein the at least one compressed region generally prevents the plurality of print-receptive media from becoming off register during printing thereon by a printing device.

40. The sheet construction as claimed in claim 39, wherein the second side margin includes at least one compressed region.

41. The sheet construction as claimed in claim 39, wherein the leading margin includes at least one compressed region.

42. The sheet construction as claimed in claim 39, wherein the trailing margin includes at least one compressed region.

43. The sheet construction as claimed in claim 39, wherein at least one of the second side margin, the leading margin, and the trailing margin includes at least one compressed region.

44. The sheet construction as claimed in claim 43, wherein each of the second side margin, the leading margin, and the trailing margin includes at least one compressed region.

45. The sheet construction according to claim 39, wherein the plurality of print-receptive media includes a sheet of printable business cards.

46. The sheet construction according to claim 39, wherein the plurality of print-receptive media includes a sheet of adhesive labels.

47. A method of making the sheet construction according to claim 1, the method comprising the steps of:

a) providing a first material having a top surface and a bottom surface, the first material being formed from a cardstock material, wherein the first material includes a leading edge, a trailing edge, a first longitudinal edge, and a second longitudinal edge;

b) providing a second material on the bottom surface of the first material, the second material formed from a non-separating polymer carrier material;

c) defining in the first material a plurality of print-receptive media, a leading margin extending from the first longitudinal edge to the second longitudinal edge and bounded at least by the first longitudinal edge, the second longitudinal edge, and the at least one print-receptive area, and a first side margin bounded at least in part by the leading margin, the first longitudinal edge, and the plurality of print-receptive media; and d) forming at least one compressed region partially through at least the first material in the first side margin.

48. The method according to claim 47, wherein the forming step includes rolling a scoring roller having at least one protrusion against the first material.

49. The method according to claim 47, wherein the at least one compressed region has a length that is parallel to the first longitudinal edge, the length being from about 0.030 inch to about 0.039 inch.

50. The method according to claim 47, wherein the at least one compressed region is compressed to a depth of about 20 microns to about 110 microns.

51. The method according to claim 47, wherein the at least one compressed region has a thickness that is about 65% to about 95% of the total caliper of the sheet construction.

52. The method according to claim 47, further including the step of forming at least one compressed region in the leading margin.

* * * * *